US008070273B2

(12) United States Patent
Kawasaki et al.

(10) Patent No.: US 8,070,273 B2
(45) Date of Patent: Dec. 6, 2011

(54) INK STORAGE CONTAINER

(75) Inventors: Masayuki Kawasaki, Saitama (JP); Takehiko Matsuo, Tokyo (JP); Kimio Watanabe, Yamanashi (JP); Hiroshi Muramatsu, Saitama (JP)

(73) Assignee: Jit Co., Ltd., Yamanashi (JP)

( * ) Notice: Subject to any disclaimer, the term of this patent is extended or adjusted under 35 U.S.C. 154(b) by 556 days.

(21) Appl. No.: 12/204,225

(22) Filed: Sep. 4, 2008

(65) Prior Publication Data

US 2009/0122121 A1 May 14, 2009

(30) Foreign Application Priority Data

Nov. 14, 2007 (JP) ..... 2007-294998
Mar. 26, 2008 (JP) ..... 2008-080402
Jul. 15, 2008 (JP) ..... 2008-184073

(51) Int. Cl.
*B41J 2/175* (2006.01)
*B41J 2/19* (2006.01)

(52) U.S. Cl. ..... 347/86; 347/92

(58) Field of Classification Search ..... 347/85–87, 347/92

See application file for complete search history.

(56) References Cited

U.S. PATENT DOCUMENTS 5,113,199 A 5/1992 Chan et al.
5,801,737 A 9/1998 Sato et al.
2001/0037629 A1* 11/2001 Mashiko et al. ..... 55/385.1
2003/0128261 A1 7/2003 Usui et al.
2004/0012648 A1 1/2004 Mizoguchi et al.
2004/0135854 A1 7/2004 Kuwabara et al.

FOREIGN PATENT DOCUMENTS

EP 0631872 A2 4/1995
EP 0684136 A2 5/1995
EP 1095792 A2 5/2001
EP 1839878 A2 3/2007
JP 7314709 A 12/1995
JP 8187874 A 7/1996
JP 200127777 A 10/2001
JP 2001277777 A 10/2001
JP 2002187600 A 7/2002
JP 2003237102 A 8/2003
WO 2008006139 A1 1/2008

* cited by examiner

*Primary Examiner* — Geoffrey Mruk

(74) *Attorney, Agent, or Firm* — Porzio, Bromberg & Newman, P.C.

(57) ABSTRACT

An ink storage container having a simply configured ink exchange function is provided, whereby the amount of stored ink is increased. An air flow control unit for controlling the flow of air between the inside and outside is disposed in an ink storage unit for storing ink. The air flow control unit includes: a valve element that is formed of an interconnected porous material and allows air to be exchanged between the inside and outside of the ink storage unit according to positive and negative changes in the internal pressure of the ink storage unit; and a liquid repellent membrane that has air permeability and liquid repellency and is disposed on an ink side of the valve element.

45 Claims, 35 Drawing Sheets

INK STORAGE CONTAINER

Cross Reference to Related Application:

This application claims the benefit of Japanese Patent Application No. 2007-294998, filed on Nov. 14, 2007, Japanese Patent Application No. 2008-080402, filed on Mar. 26, 2008 and Japanese Patent Application No. 2008-184073, filed on Jul. 15, 2008, the disclosures of which Applications are incorporated by reference herein.

BACKGROUND OF THE INVENTION

1. Field of the Invention

The present invention relates to an ink storage container.

2. Description of the Related Art

Examples of the ink storage container include ink tanks for writing instruments and ink cartridges (tanks) for ink-jet printers. Such ink tanks have a mechanism for introducing outside air to the tanks according to the amount of ink consumed for writing and printing characters and images so that the consumption of the ink is not adversely affected by a change in pressure inside the tanks. Examples of such a mechanism include a mechanism including a simple hole formed as an inlet of outside air and a mechanism including a ventilation passage with a valve mechanism for providing ventilation as necessary.

However, with the mechanism including a simple hole formed as an inlet of outside air, the ink may leak through the hole. Moreover, in writing instruments and also in ink-jet printers, their ink-ejecting means such as nibs or printer heads receive water head pressure caused by the weight of ink (the pressure corresponds to force per horizontal unit area that is exerted on the bottom surface of a liquid column extending from the bottom surface to the liquid level). Therefore, with the mechanism including a simple hole formed as an inlet of outside air and with a mechanism including a membrane that allows gas to pass therethrough but does not allow liquid to pass therethrough, the water head-pressure can cause the ink to flow out from the ejection hole since the pressure inside the ink tanks or the ink cartridges is the same as the atmospheric pressure. Hence, an ink absorbing body such as sponge must be disposed in at least a part of an ink storage unit above the ink ejection hole to retain the ink.

However, when the ink absorbing body such as sponge is used to retain the ink, the amount of ink stored in the ink storage unit is less than the amount of ink stored in an ink storage unit that has the same volume as the above ink storage unit and does not include the ink absorbing body, and the number of printable characters is reduced accordingly.

Therefore, users need to replace the ink storage container frequently. In commercial products, the ink capacity of a black ink storage container is generally greater than those for other colors, and the large ink capacity is achieved by simply increasing the size of the storage container. However, this results in an increase in the size of printers. As described above, the conventional ink storage containers cause various inefficiencies. In view of this, various improvement techniques have been proposed based on the idea of using a small valve element.

For example, an ink storage container has been proposed in which a ventilation passage with a valve mechanism for providing ventilation as necessary is formed in an upper lid portion of the storage container so as to be substantially embedded therein. In this ink storage container, the reduction in the amount of stored ink, which occurs in the ink storage container having the ink absorbing body disposed thereinside, can be prevented, and the outflow of the ink can also be prevented.

A conventional technique for providing the ventilation passage with a valve mechanism for providing ventilation is described in, for example, Japanese Patent Application Laid-Open No. 2001-277777. The technique described in Japanese Patent Application Laid-Open No. 2001-277777 is related to an ink cartridge. Specifically, an interconnected porous body serving as a valve element is disposed in a concave-shaped valve-attaching portion formed in a lid-attaching portion, and a lid having a ventilation hole is placed on the porous body. A protruding portion having a slit-like opening is provided below a hole portion. The lid is welded and secured to the lid-attaching portion by ultrasonic welding, whereby the valve element is enclosed in the valve-attaching portion.

In the structure described above, an elastic material is basically used to form an interconnected porous body, and the interconnected porous body is compressed to substantially close the interconnected pores, whereby the valve element including a plurality of ventilation pores with valve covers is formed. In this manner, the ejection of the ink can be appropriately controlled, irrespective of whether the change in pressure is small or large.

Japanese Patent Application Laid-Open No. Hei 8-187874 discloses an ink tank including a one-way valve and a ventilation membrane disposed below the one-way valve. The ventilation membrane is air-permeable, and the surface thereof facing the ink has been subjected to liquid repellent treatment to inhibit or prevent the ink from passing therethrough. With such a ventilation membrane, the ink is prevented from flowing upward therethrough and adhering to the one-way valve.

In the valve element used in the ink storage container disclosed in Japanese Patent Application Laid-Open No. 2001-277777, the slit-like opening is formed in the side wall of the protruding portion. In this manner, the ink is prevented from adhering to the valve element. However, the valve element is always in communication with the ink side. Therefore, although the protruding portion is provided, the ink can come in contact with or adhere to the valve element when the ink storage container is reciprocally moved during printing or is tilted at a certain angle when carried. When the ink comes into contact with or adheres to the valve element, the interconnected ventilation pores are clogged with the ink, and therefore the ventilation properties deteriorate. As described above, the ink can come into contact with the valve element, and this causes a difficulty in appropriately controlling the ejection of the ink over a range of from a small pressure change to a large pressure change. In such a case, the ventilation cannot be appropriately controlled. For example, when the ink storage container is used as a cartridge of an ink-jet printer, the above difficulty can cause faint printing due to ink depletion or ink shortage or can cause ink leakage from the head or excessive ejection of the ink.

Moreover, when the lid is ultrasonically welded to the lid-attaching portion, the valve element is adversely affected by the heat and is thereby hardened. Therefore, the valve element itself undergoes thermal stress caused by the thermal deformation and can be deformed. The valve element must have an air flow control function that is provided by elastic deformation of the very fine interconnected pores caused by the pressure difference between the inside and outside of the ink storage container. However, in the above case, the air flow control function intrinsic to the valve element can deteriorate. Moreover, although the valve element itself does not allow the ink to pass therethrough, the ink may leak from the circumference of the valve element when the valve element is not properly held.

The valve element disclosed in Japanese Patent Application Laid-Open No. 2001-277777 is basically a very good valve element. Specifically, the valve element is small in size and can control pressure bidirectionally. In addition, unlike plate-like valves and rubber-made bell-like valves, the valve element does not suffer deterioration in its function due to adhesion of dust. However, the only drawback is that the effective area varies due to adhesion of liquid. Therefore, Japanese Patent Application Laid-Open No. 2001-277777 provides some measures. For example, when a valve element is used which is formed of a liquid repellent material, or when a valve element is used which is not formed of a liquid repellent material but has been subjected to liquid repellent treatment to impart liquid repellency thereto, the ventilation interconnected pores of the valve element can be prevented from being clogged with the ink. However, this is difficult to achieve for the following reasons. Specifically, when a liquid repellent material such as a fluorine-based material is used to produce the valve element, it is difficult to produce an interconnected porous body and a compressed porous body having good elasticity. Moreover, when a liquid repellent valve element is produced from a non-liquid repellent material by subjecting a preformed valve element to liquid repellent treatment, it is difficult to form a liquid repellent film that exhibits good adherence even when environmental conditions such as temperature and pressure are changed, when shocks and vibrations are applied, and as the film ages. Specifically, it is difficult to produce an interconnected porous body and a compressed porous body with a liquid repellent film that resists peeling.

The present inventors have conducted tests on ink storage containers including: a valve element subjected to liquid repellent treatment; and a protruding portion having a slit-like opening formed in the side wall thereof. Specifically, the ink storage containers have been produced according to the description in Japanese Patent Application Laid-Open No. 2001-277777. The test results (not being publicly known at the time of filing the subject application) have shown that a small amount of liquid first adheres to a very shallow part of the valve element, the adhering liquid infiltrates into the valve element as the valve element is repeatedly opened and closed, and finally the liquid disturbs the opening and closing operations of the valve element to cause a reduction and instability in performance. In the state in which a small amount of liquid adheres to a very shallow part of the valve element, if the temperature inside the ink storage container increases, the internal pressure increases. The increased internal pressure also causes the liquid to infiltrate into the valve element. Moreover, during intermittent use at long intervals, the degree of infiltration of the liquid into the valve element increases, and finally the opening and closing operations of the valve element is disturbed. The liquid repellent treatment applied to the valve element and the infiltration prevention mechanism such as the protruding portion have conventionally been considered to be adequate measures and can actually suppress the infiltration of liquid into the valve element to some extent. However, the test results have shown that these measures are insufficient to completely prevent the infiltration of liquid into the valve element that undergoes long-term changes in environmental conditions such as temperature and pressure changes and to maintain the function of the valve element for a long period of time. According to the tests, the inventors have recognized that it is not sufficient to employ the idea of "suppressing the infiltration of liquid into the valve element" as described in Japanese Patent Application Laid-Open No. 2001-277777 and that it is required to employ a novel idea of "completely preventing the infiltration of liquid into the valve element."

SUMMARY OF THE INVENTION

The present invention has been made to solve the above problems, and the utilization efficiency of the ink storage space of an ink storage container is maximized. Accordingly, it is a main object of the invention to provide an ink storage container in which the ink is reliably prevented from adhering to or coming into contact with a valve element. In this ink storage container, the valve element is incorporated in the ink storage container so as not to be influenced by heat during the assembling process of the valve element, to prevent the ventilation control function (air flow control function) of the valve element from deteriorating. Accordingly, the controllability of ventilation through the valve element can be maintained and improved, and furthermore, the ejection of the ink can be suitably and reliably controlled over a range of from a small pressure change to a large pressure change.

The present invention solves the foregoing problems as follows.

One aspect of the present invention for achieving the foregoing object is an ink storage container including an ink storage unit that stores an ink, the ink storage unit including an air flow control unit that controls an amount of air flow between inside and outside of the ink storage unit, wherein the air flow control unit includes: a valve element that is formed of an interconnected porous material and allows air to be exchanged between the inside and outside of the ink storage unit according to positive and negative changes in internal pressure of the ink storage unit; and a liquid repellent membrane having air permeability and liquid repellency, the liquid repellent membrane being disposed on an ink side of the valve element.

In the present invention, the air exchange function of the valve element and the liquid repellent function of the liquid repellent membrane are provided separately and independently. Therefore, both the functions can be maintained over a long period of time in a synergistic manner. Specifically, the liquid repellent function of the liquid repellent membrane prevents the adhesion of the ink or the like to the valve element, so that the air exchange function of the valve element can be maintained. The air exchange function of the valve element according to a change in the internal pressure can suppress an abrupt change in the internal pressure. Therefore, deformation and damage of the liquid repellent membrane caused by air passing therethrough can be suppressed, and the liquid repellent function can thereby be maintained. Moreover, if the valve element itself is coated with a liquid repellent agent, the air exchange function of the valve element may become unstable, and the function of the valve element may vary with time. In addition, the liquid repellent function of the liquid repellent agent may deteriorate due to the elastic deformation of the valve element. Therefore, in the present invention, the valve element and the liquid repellent membrane are provided separately and independently. In this manner, the qualities of these elements can be stably maintained at a high level over a long period of time.

In the ink storage container configured as described above, the valve element may be elastically deformable.

In this case, the valve element detects a change in internal pressure based on the amount of elastic deformation thereof, and the amount of air to be exchanged can thereby be spontaneously controlled.

In the ink storage container configured as described above, a gap for allowing elastic deformation of the valve element may be formed on each side of the valve element in a flow direction of air.

The gap allows the valve element to be elastically deformed without external contact. In this case, the liquid repellent membrane is, of course, spaced away from the valve element. When the internal pressure of the ink storage unit is higher than the external pressure, the valve element is elastically deformed toward the outside of the ink storage unit. When the internal pressure of the ink storage unit is lower than the external pressure, the valve element is elastically deformed toward the inside of the ink storage unit. As a result, the valve element can correctly detect the change in the internal pressure, so that the exchange of air can be appropriately controlled.

In the ink storage container configured as described above, the air flow control unit may further include an annular holding member that holds the valve element such that a portion near a circumference of the valve element is held thereby.

For example, if part of the valve element is locally held, the valve element is prevented from being elastically deformed in a natural manner. Therefore, difficulty arises in correctly detecting a change in the internal pressure. In the present invention, the entire circumferential portion of the valve element is held by the annular holing member in a well-balanced manner, so that the valve element is allowed to be elastically deformed in an appropriate manner according to the change in the internal pressure.

In the ink storage container configured as described above, the valve element may be a sheet member having a thickness of 0.5 mm or more and 5.0 mm or less.

When the thickness of the valve element is 0.5 mm or more, the stiffness of the held portion of the valve element made of an interconnected porous material is high, and the amount of air flowing therethrough (leaking therefrom) can be reduced. The function of exchanging air according to a pressure change is obtained by utilizing the thickness of the valve element. When the thickness is 0.5 mm or more, the valve element having a suitable air exchange function can be easily produced. In particular, the exchange of air can be controlled at very low pressures. Meanwhile, when the thickness is 5.0 mm or less, the flow passage of air is prevented from being excessively complicated, and a suitable passage length can be obtained, so that the rate of response of air exchange is increased. Therefore, the ink can be supplied quickly, and faint printing can be reduced.

In the ink storage container configured as described above, the valve element may have an outer dimension of 4 mm or more and 20 mm or less.

When the outer dimension is 4 mm or more, the area of the air exchange portion at the center of the valve element can be large enough to reduce the influence of the constrained circumferential held portion, so that the valve element is allowed to be elastically deformed in an appropriate manner according to a change in pressure. In this manner, the responsivity of air exchange to a very small pressure change in the ink storage container is improved. When the outer dimension is 20 mm or less, the area of the air exchange portion at the center of the valve element can be prevented from being excessively increased. In this manner, the air exchange region of the valve element is prevented from being deflected and deformed as a whole due to a very small pressure change in the ink storage container. Therefore, the valve element is elastically deformed in an appropriate manner according to a very small pressure change, so that the responsivity of air exchange can be improved. In addition, the valve element can be installed in a small space in an upper lid.

In the ink storage container configured as described above, the liquid repellent membrane may be formed of a fluorocarbon resin or a fluorocarbon rubber.

In the ink storage container configured as described above, the liquid repellent membrane may have a plurality of fine pores of a diameter of 0.01 μm or more and 5 μm or less, and the liquid repellent membrane may have a critical surface tension of 25 dyn/cm or less.

When the pore diameter is 5 μm or less, the ink is prevented from entering into the pores even when dropping and vibration impacts are applied, so that the air exchange function can be obtained stably. When the pore diameter is 0.01 μm or more, the responsivity of air exchange is improved, and the ink is smoothly supplied, so that faint printing can be reduced.

In the ink storage container configured as described above, the air flow control unit may further include an annular pressing ring having flat surfaces on upper and lower sides thereof and having a through hole in a central portion thereof, and the liquid repellent membrane, the pressing ring, and the valve element may be held in a pressed manner.

In the above configuration, the air flow control unit includes the liquid repellent membrane, the pressing ring, and the valve element, and these three components are stacked in layers. In this manner, the liquid repellent membrane is flattened since it comes into contact with the pressing ring having a predetermined flatness, so that the ink is prevented from leaking. Moreover, since the circumferential portion of the valve element is annularly held by the pressing ring, the air exchange function can be stably obtained. Specifically, by simply interposing the pressing ring between the valve element and liquid repellent membrane, the hermeticity of the liquid repellent membrane is prevented from being affected by the irregularity of the valve element. In addition, the valve element can be held while the gap for elastic deformation is provided in a simple manner.

Moreover, by holing the liquid repellent membrane, the pressing ring, and the valve element in a pressed manner, uniform surface pressure is applied to each of the contact surfaces between the upper and lower surfaces of the liquid repellent membrane and their contacting members. In particular, since the elastic valve element presses the pressing ring against the liquid repellent membrane, the dimension errors of the components and storage space can be absorbed, and a very good contact condition can be maintained between the liquid repellent membrane and the pressing ring.

Preferably, the pressing ring is formed of metal. This is because, when metal is used, the smoothness of the upper and lower surfaces of the pressing ring can be improved.

In the ink storage container configured as described above, the air flow control unit may further include an annular lower-side support ring that has a communication hole formed in a central portion thereof and abuts against a lower surface side of the valve element, and an area of the communication hole of the lower-side support ring may be less than an area of an communication region on an upper side of the valve element.

In the above configuration, the area of the communication hole, which is a communication region on the inner side of the valve element, is smaller than the area of the communication region of the outer side of the valve element. Therefore, the valve element is not easily deformed elastically toward the ink side (the inner side of the container) but is easily deformed elastically toward the side opposite to the ink side (the outer side of the container). Since the extent of the elastic deformation is asymmetric as described above, the flow of air from the inner side to the outer side of the container can be facilitated, and the flow of air from the outer side to the inner side of the container can be suppressed, so that a reduction in the pressure inside the ink storage unit can be further facilitated.

In the ink storage container configured as described above, the pressing ring may be disposed so as to abut against the ink side of the valve element, and an area of the through hole of the pressing ring may be smaller than an area of a communication region on a side opposite to the ink side of the valve element.

In the above configuration, as in the lower-side support ring, the pressing ring that improves the hermeticity of the liquid repellent membrane is effectively used to allow the valve element to be deformed asymmetrically in the inward-outward direction, so that the air flow control unit can be made compact.

In the ink storage container configured as described above, an object-accommodating portion may be provided on an upper surface portion of the ink storage unit, and a liquid repellent membrane-placing portion for placing the liquid repellent membrane may be formed in the object-accommodating portion. In addition, a ventilation hole may be formed in a bottom portion of the object-accommodating portion, and the air flow control unit is mounted in the object-accommodating portion.

In the above configuration, the air flow control unit is compactly accommodated on the upper surface of the ink storage unit, so that the amount of ink stored in the ink storage unit can be greatly increased.

In the ink storage container configured as described above, the liquid repellent membrane-placing portion may have an annular smooth surface that comes into intimate contact with the liquid repellent membrane.

In the above configuration, since the liquid repellent membrane-placing portion also has a smooth surface, a very intimate contact is obtained between each of the upper and lower surfaces of the liquid repellent membrane and the corresponding contacting member. Therefore, even when the ink adheres to the liquid repellent membrane, each contact surface resists the infiltration of the ink. In particular, since the liquid repellent membrane has low wettability, a good sealing function can be obtained when the liquid repellent membrane is brought into intimate contact with the smooth surfaces, and the infiltration of the ink can thereby be prevented. In other words, when this liquid repellent membrane is used, the central portion thereof provides air permeability and liquid repellency, and the circumferential portion thereof provides the sealing function. Teflon (registered trademark) is preferably used as the material for the liquid repellent membrane. Since the Teflon membrane also has flexibility, its contact condition with the smooth surfaces is improved, and therefore both high sealing characteristics and high liquid repellency can be obtained.

In the ink storage container configured as described above, the liquid repellent membrane-placing portion may be formed as an annular dent and may be formed of an olefin-based resin.

In the above configuration, since the olefin-based resin also has low wettability, the ink is prevented from infiltrating into the smooth surface of the liquid repellent membrane-placing portion. Moreover, since the liquid repellent membrane-placing portion formed as the annular dent receives the liquid repellent membrane without positional displacement, the assembling work of the air flow control unit can be performed efficiently.

The ink storage container configured as described above further includes a cap that is mounted on an upper side of the object-accommodating portion.

In the above configuration, after the air flow control unit is installed in the object-accommodating portion, the object-accommodating portion is covered with the cap. In this manner, the air flow control unit can be prevented from falling off. Moreover, the assembling work of the air flow control unit can be greatly facilitated.

In the ink storage container configured as described above, the cap may include: a plurality of ventilation holes formed in a ceiling portion thereof; and a valve element-placing portion for supporting the valve element, the valve element-placing portion being formed on a lower side of the ceiling portion and formed as an annular dent.

In the above configuration, the valve element is supported by the valve element-placing portion, and the air flow control unit can be smoothly installed and accommodated between the cap and the bottom portion of the object-accommodating portion. Therefore, the assembling work of the air flow control unit can be performed efficiently. Moreover, the plurality of ventilation holes are formed in the ceiling portion of the cap. Therefore, if the ink accidentally adheres to one of the ventilation holes provided in the valve element-placing portion of the ceiling portion of the cap through the hand of a user at the time of replacing the ink storage container attached to the carriage of a printer, or if droplets of water adhere to one of the ventilation holes, the rest of the ventilation holes ensure the ventilation between the inside and outside. Moreover, the air flow control function of the air flow control unit can be maintained at a high level. Since the valve element-placing portion is formed as an annular dent, the valve element is received by the valve element-placing portion without positional displacement, so that the installation accuracy can be improved.

In the ink storage container configured as described above, the cap may include a tubular circumferential portion axially extending from a circumferential portion of the ceiling portion. When the cap is attached to the object-accommodating portion, a lower end of the tubular circumferential portion may abut against the bottom portion of the object-accommodating portion and may become a stopper.

In the above configuration, the lower end of the circumferential portion of the cap is formed so as to abut against the bottom portion. Therefore, if the pressing force of the cap is excessively large when the air flow control unit is mounted by pressing the cap into the object-accommodating portion, the lower end functions as the stopper. The valve element is thereby prevented from being excessively compressed by the cap and from being stretched and is prevented from being elastically deformed into an irregular shape. Therefore, the air flow control function of the valve element can be prevented from being impaired.

In the ink storage container configured as described above, a thin-wall annular elastic hinge may be provided on an inner base portion of the tubular circumferential portion of the cap. In addition, an engaging portion may be formed on an outer surface of the circumferential portion of the cap, and an engaged portion that is engaged with the engaging portion may be formed on an inner circumferential wall of the object-accommodating portion.

In the above configuration, the elastic hinge formed on the inner side of the ceiling portion facilitates deflection of the circumferential portion with the inner base portion serving as a fixed point. Therefore, when the cap is pressed and fitted into the object-accommodating portion, the cap can be smoothly pressed thereinto without causing the pressing force to be exerted on the valve element through the cap. In addition, since the amount of deformation of the valve element-placing portion (being the ceiling portion) that holds the valve element can be reduced, the valve element is prevented from being elastically deformed into an irregular shape. In other words, the elastic deformation of the valve element can be reduced as much as possible. Therefore, the valve element can be attached without any deterioration of its intrinsic air flow control function, and unnecessary ink leakage can be prevented.

Moreover, the engaging portion on the cap side is fitted to the engaged portion on the inner circumferential wall on the object-accommodating portion side. Therefore, the cap is prevented from coming off the object-accommodating portion in the axial direction and from rotating. Therefore, the cap is tightly fitted into the object-accommodating portion and is stably held without exerting external force on the air flow control unit composed of the valve element, the pressing ring, and the liquid repellent membrane. This can prevent the air flow control function of the valve element from being impaired.

In the ink storage container configured as described above, the engaging portion and the engaged portion may form a plurality of fit portions disposed in an axial direction of the circumferential portion. One of the plurality of fit portions may prevent the cap from coming off the object-accommodating portion in the axial direction, and the rest of the plurality of fit portions may prevent the cap from rotating in a circumferential direction of the tubular circumferential portion.

In the above configuration, one of the plurality of fit portions formed by the engaging portion and the engaged portion functions to prevent the cap from coming off the object-accommodating portion in the axial direction, and the rest of the plurality of fit portions functions to prevent the cap from rotating in the circumferential direction. Therefore, the air flow control unit can be held more stably.

In the ink storage container configured as described above, a conically tapered surface tapered upwardly may be formed on an inner circumference of the ventilation hole formed in the bottom portion of the object-accommodating portion.

In the above configuration, even when the ink adheres to the lower surface of the liquid repellent membrane or the tapered surface, the ink easily flows along the tapered surface and drops into the container. Therefore, the amount of ink adhering to the liquid repellent membrane can be always suppressed to a low level.

In the ink storage container configured as described above, at least the conically tapered surface may be subjected to liquid repellent treatment.

In the above configuration, the amount of ink remaining on the tapered surface can be further reduced, and the amount of ink adhering to the liquid repellent membrane can be reduced.

In the ink storage container configured as described above, a buffering portion having a disk-like shape may be formed below the ventilation hole formed in the bottom portion, the buffering portion restricting the motion of the ink toward the ventilation hole. The buffering portion may have a conical surface on a ventilation hole side thereof, a center of the conical surface protruding toward the ventilation hole.

In the above configuration, the buffering portion reduces the amount of ink directly flowing into the air flow control unit. Moreover, when the ink adhering to the lower surface of the Teflon membrane drops on the buffering portion, the ink drop easily flows along the conical surface and returns to the container, and the ink is prevented from remaining on the conical surface.

Preferably, the object-accommodating portion of the ink storage container is a recessed portion formed in the upper surface portion of the ink storage unit. In this case, the air flow control unit can be assembled by sequentially dropping its components from the upper surface portion side of the ink storage unit. Therefore, the assembling work of the air flow control unit can be performed efficiently.

In the ink storage container configured as described above, a distance between an upper surface of the valve element and a lower surface of the liquid repellent membrane may be 1.5 mm or more and 20 mm or less.

In the above configuration, the air flow control unit is small in size, so that the internal space of the ink storage unit can be increased.

In the ink storage container configured as described above, the valve element may be a compressed body formed by compressing an interconnected porous elastic material.

In the ink storage container configured as described above, a minimum dimension of a communication region of the valve element that is in communication with the ink side may be at least two times of a thickness of the valve element.

In this case, the valve element can be elastically deformed in the direction of air flow in a flexible manner, so that air can be exchanged in quick response to a small change in internal pressure. Specifically, the valve element is slightly stretched due to the small change in internal pressure, and this causes the porous material in the valve element to be expanded, whereby an air exchange passage is formed to provide ventilation.

In the ink storage container configured as described above, the minimum dimension of the communication region of the valve element that is in communication with the ink side may be at most 15 times of the thickness of the valve element.

In this case, the valve element can be elastically deformed in the direction of air flow in amore flexible manner, so that the responsivity to a change in internal pressured can be improved.

The ink storage container configured as described above may further include an ink utilization valve that is disposed inside the ink storage unit, the ink utilization valve being in communication with the air flow control unit. The ink utilization valve may include an ink absorbing body that absorbs the ink, to thereby allow air to prevent from passing therethrough under normal conditions and allow air to pass therethrough according to a change in pressure-inside the ink storage unit. The ink utilization valve is configured such that resistance to flow of air passing through the ink absorbing body increases as the ink absorbing body absorbs the ink.

In this manner, the air flow control function of the air flow control unit and the air flow resistance control function of the ink utilization valve are synergistically combined, and the negative pressure inside the ink storage container can thereby be increased significantly and can be stably maintained. Therefore, unnecessary leakage of the ink can be effectively prevented, and the consumption of the ink can be efficiently improved. Specifically, the ink in the ink storage container is absorbed by the ink absorbing body by capillarity, whereby the ink absorbing body increases its resistance to air flow into the ink storage container. For example, the negative pressure can be increased to about −140 $mmH_2O$, whereby a good pressure balance can be attained. Therefore, the ejection amount of the ink can be controlled to an optimal value, and printing can be performed while the amount of ink consumption is effectively reduced.

The ink storage container configured as described above may further include a retaining portion that is disposed in the ink storage unit or the air flow control unit and is partially or fully immersed in the ink in the ink storage unit, and the ink absorbing body may be mounted in the retaining portion.

In the ink storage container configured as described above, the ink utilization valve may further include a liquid repellent membrane body that is disposed above the ink absorbing body, the liquid repellent membrane body having air permeability and having been subjected to liquid repellent treatment.

In the above configuration, even when the ink absorbing body absorbs a large amount of the ink and is saturated with the ink, the liquid repellent membrane body prevents the ink absorbed by the ink absorbing body from reaching a level above the liquid repellent membrane body. Therefore, the ink does not reach the valve element disposed above the ink utilization valve, so that the function of the air flow control unit is reliably prevented from deteriorating or being reduced. Moreover, even when the ink absorbing body is saturated with the ink, the valve element of the air flow control unit allows the negative pressure in the container to be maintained at a predetermined level.

In the ink storage container configured as described above, an air layer may be allowed to intervene between the air flow control unit and the ink utilization valve.

In the above configuration, the air layer is allowed to intervene between the air flow control unit and the ink utilization valve. Therefore, even when the ink leaks from the ink utilization valve, the ink is stored by means of the air layer and is therefore prevented from reaching the air flow control unit.

In the ink storage container configured as described above, the ink storage unit may further include a bank portion protruding from a bottom surface of the ink storage unit, and the ink utilization valve may be configured such that the ink absorbing body can absorb the ink remaining in a region on the bottom surface that is partitioned by the bank portion.

In the ink storage container configured as described above, the ink storage unit may further include an ink retaining recessed portion recessed from a bottom surface of the ink storage unit, and the ink utilization valve may be configured such that the ink absorbing body can absorb the ink remaining in the ink retaining recessed portion.

In the above configuration, even when the amount of the ink is reduced, the ink absorbed state of the ink utilization valve can be maintained to the end.

The ink storage container configured as described above may serve as an ink cartridge of an ink-jet printer.

In this case, the ink cartridge of the ink-jet printer can be produced at low cost.

In the ink storage container configured as described above, the internal pressure, when the ink is discharged to an ink-jet printer, may be −20 $mmH_2O$ to −350 $mmH_2O$.

In the above configuration, the inside of a cartridge of the ink-jet printer can be held at a suitable negative pressure during printing.

According to the present invention, the inner space of the ink storage container can be effectively used. For example, the entire internal volume of the ink storage container can be used for ink storage purpose without placing an ink absorbing material or other members in the ink storage container. Therefore, the ink cartridge needs to be replaced less frequently than conventional commercial products. Similarly, a smaller ink storage container can be used for printing a predetermined number of sheets.

Moreover, according to the present invention, the liquid repellent membrane having liquid repellency is provided separately from the valve element, so that the valve element can be completely shielded from the ink. Therefore, the air exchange function can be stably maintained over a long period of time.

In the present invention, the ink is prevented from interfering with the ventilation control of the valve element. Therefore, the air flow control function can be stably maintained, and the ejection of the ink can be suitably controlled over a range of from a small pressure change to a large pressure change. In addition, the ink storage container can be produced at low cost.

BRIEF DESCRIPTION OF THE DRAWINGS

The above and other objects, features and advantages of the present invention will become apparent from the following description and appended claims, taken in conjunction with the accompanying drawings.

DETAILED DESCRIPTION OF THE PREFERRED EMBODIMENTS

Hereinbelow, ink storage containers according to preferred embodiments of the present invention will be described with reference to the drawings. In each of the embodiments, the ink storage container is exemplified as an ink cartridge of an ink-jet printer.

(Ink Storage Container)

Figure 1:
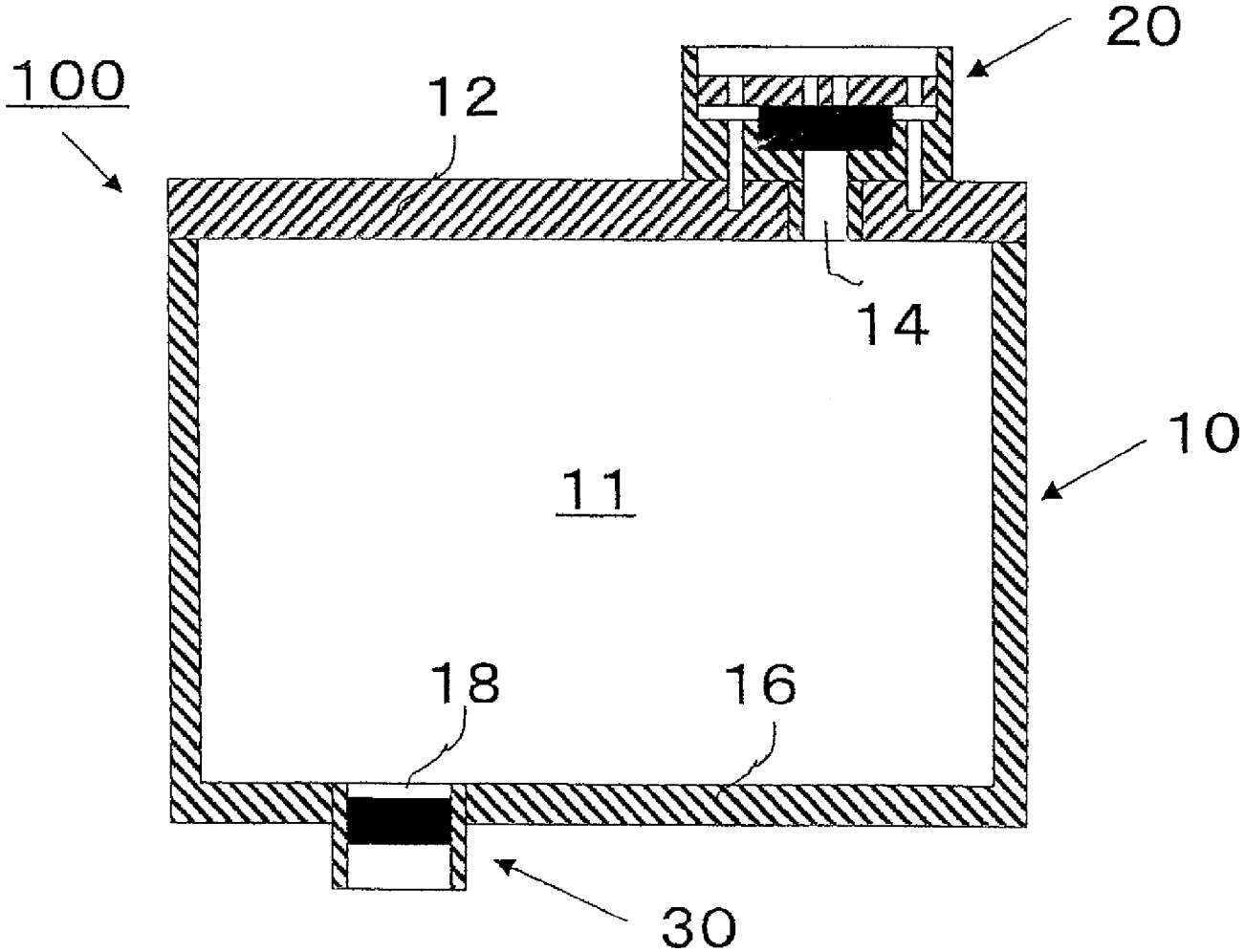
FIG. 1 is a schematic cross-sectional view of an ink storage container according to a first embodiment of the present invention.

FIG. 1 is a schematic cross-sectional view of an ink storage container 100 of a first embodiment which is used as an ink cartridge of an ink-jet printer. The ink storage container 100 of the first embodiment is configured to include: an ink storage unit 10 that has a casing portion including an upper surface portion 12 and a bottom surface 16 and stores ink in its inner space 11; an air flow control unit 20 that is disposed in the upper surface portion 12 and controls the air flow from the outside to the inside of the ink storage unit 10 through a ventilation hole 14; and an ink ejection unit 30 that is disposed in the bottom surface 16 and controls the ejection of the ink stored in the inner space 11 of the ink storage unit 10 from an ink ejection hole 18.

In the first embodiment, the air flow control unit 20 and the ink ejection unit 30 are disposed on opposite sides of the ink storage container 100 with the ink storage unit 10 interposed therebetween, but the arrangement of the air flow control unit 20 and the ink ejection unit 30 is not limited thereto. Moreover, in the first embodiment, since the ink storage container 100 is used as an ink cartridge of an ink-jet printer, the ink ejection unit 30 must be provided. When the container 100 is used for different applications, the ink ejection unit 30 may not be necessary. In FIG. 1, the air flow control unit 20 includes a portion protruding above the upper surface of the ink storage unit 10. However, the air flow control unit 20 may be embedded in the upper surface portion 12 of the ink storage unit 10 to a greater extent or may be fully embedded in the upper surface portion 12. In such a case, the portion protruding above the upper surface portion 12 of the ink storage unit 10 can be eliminated, and this is preferable for space saving.

(Ink Storage Unit)

The ink storage unit 10 having the inner space 11 includes the ventilation hole 14 provided in the upper surface portion 12 serving as a part of the casing and the ink ejection hole 18 provided in the bottom surface 16 and is a container enclosed by the casing except for the ventilation hole 14 and the ink ejection hole 18. The air flow control unit 20 for controlling the air flow through the ventilation hole 14 is disposed in the ventilation hole 14, and the ink ejection unit 30 for controlling the ejection amount of the ink is provided in the ink ejection hole 18.

In the first embodiment, the ink is stored in an empty space since it is preferable not to use an ink storage material that can cause a reduction in the amount of stored ink. However, the invention is not limited thereto, and the ink storage unit 10 may be partially or fully filled with an ink storage material.

(Air Flow Control Unit)

Figure 2:
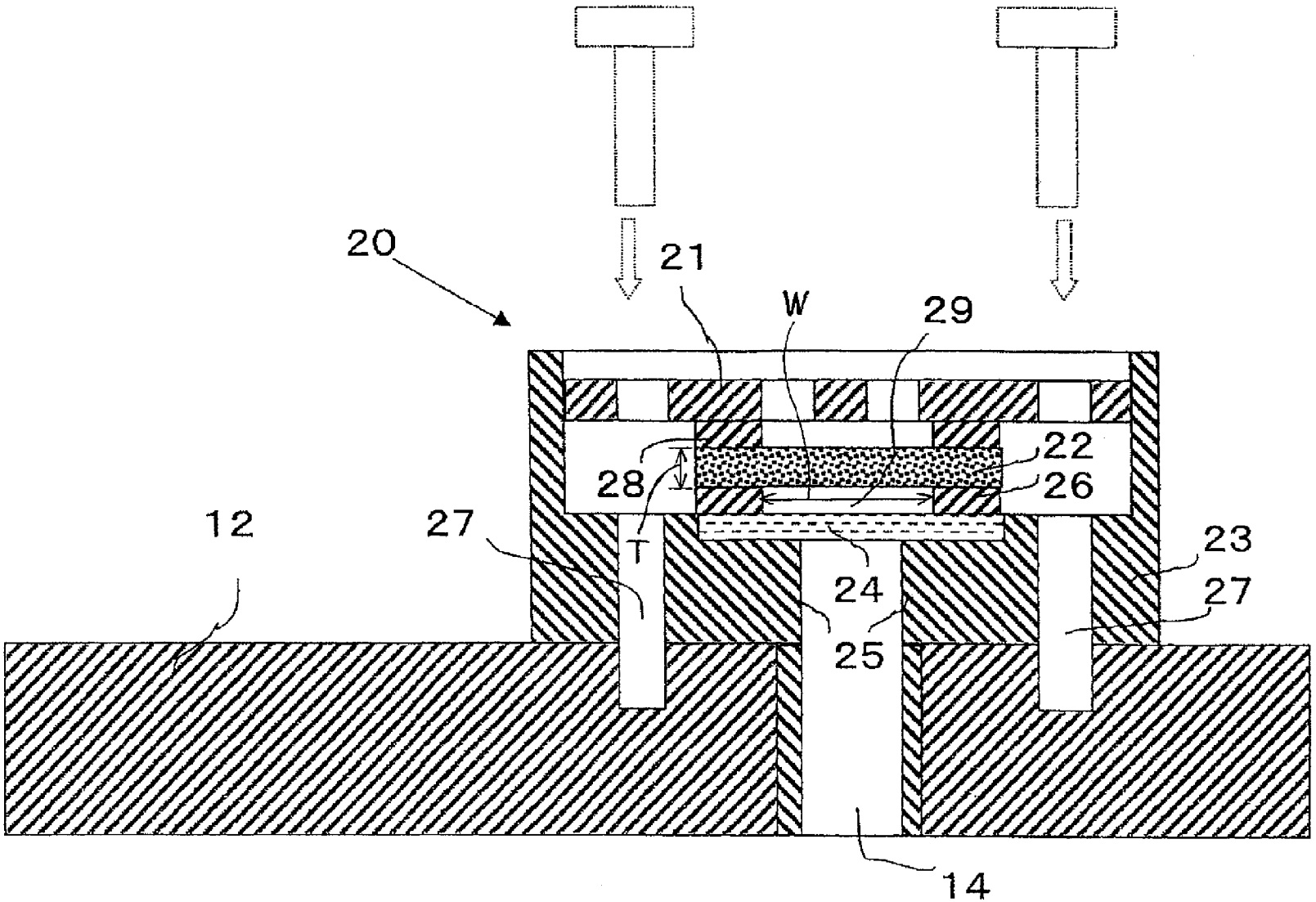
FIG. 2 is a schematic cross-sectional view of an air flow control unit, and the vicinity thereof, of the ink storage container.
Figure 2A:
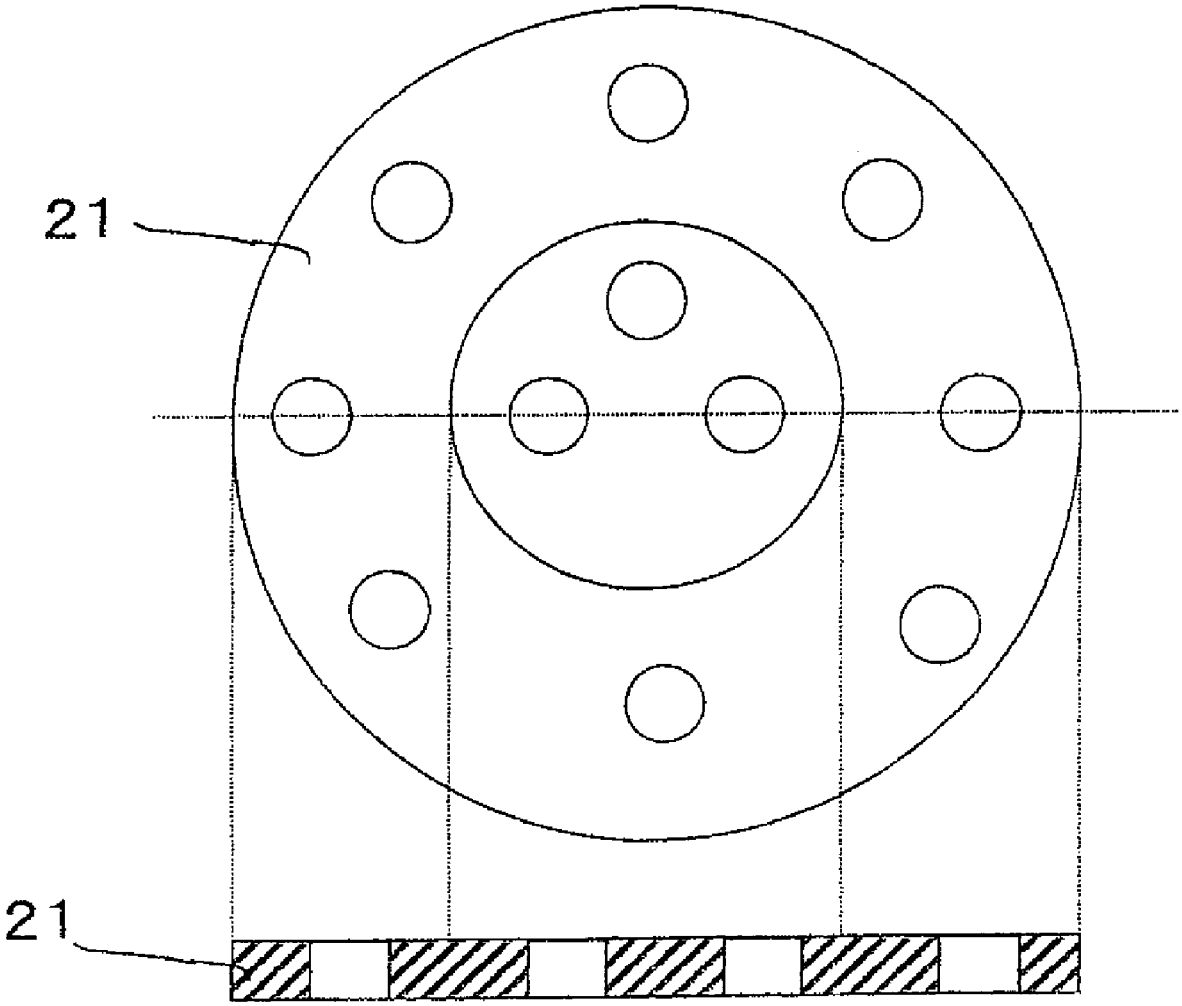
FIG. 2A is a schematic view of a component of the air flow control unit.
Figure 2B:
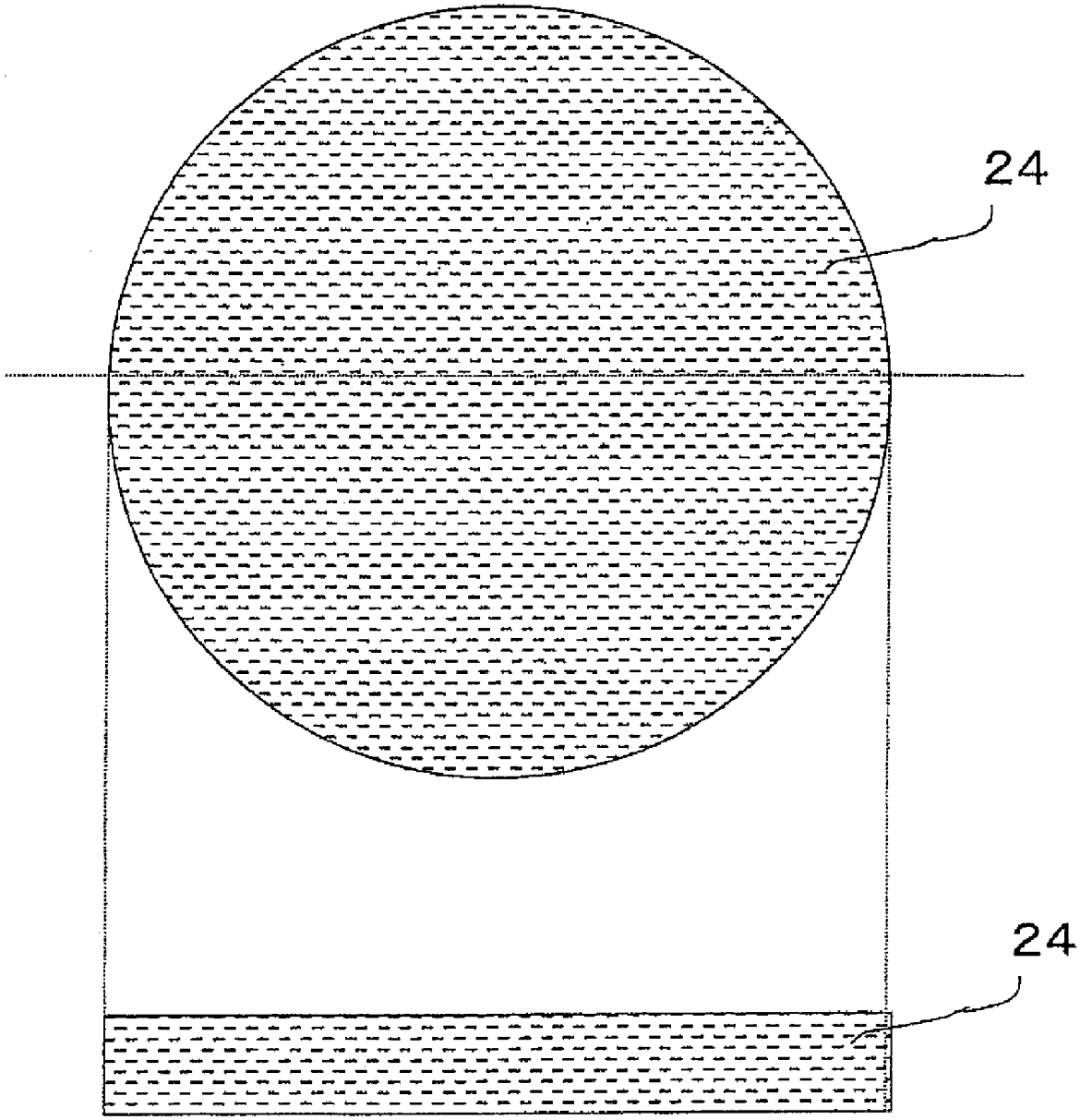
FIG. 2B is a schematic view of another component of the air flow control unit.
Figure 2C:
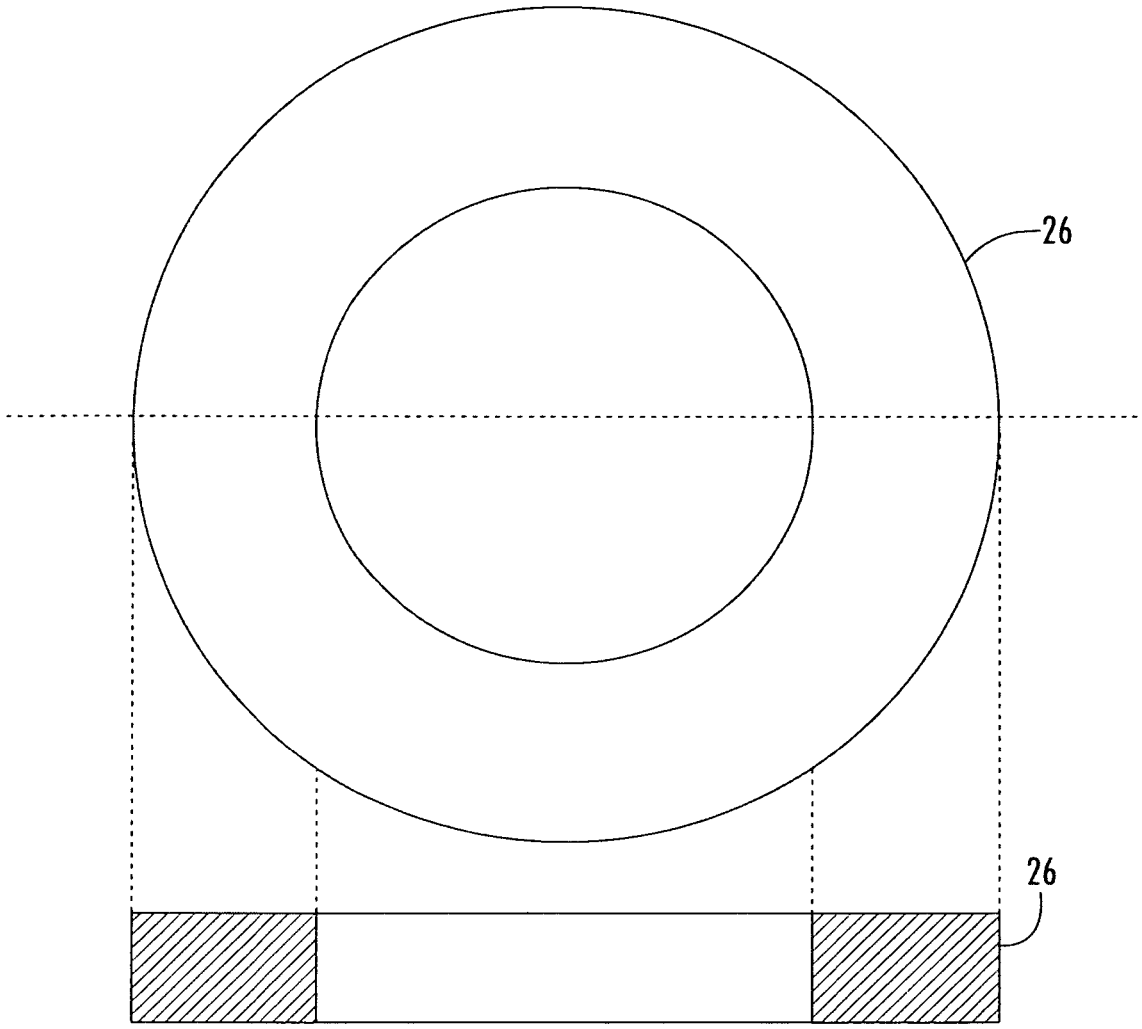
FIG. 2C is a schematic view of another component of the air flow control unit.
Figure 2D:
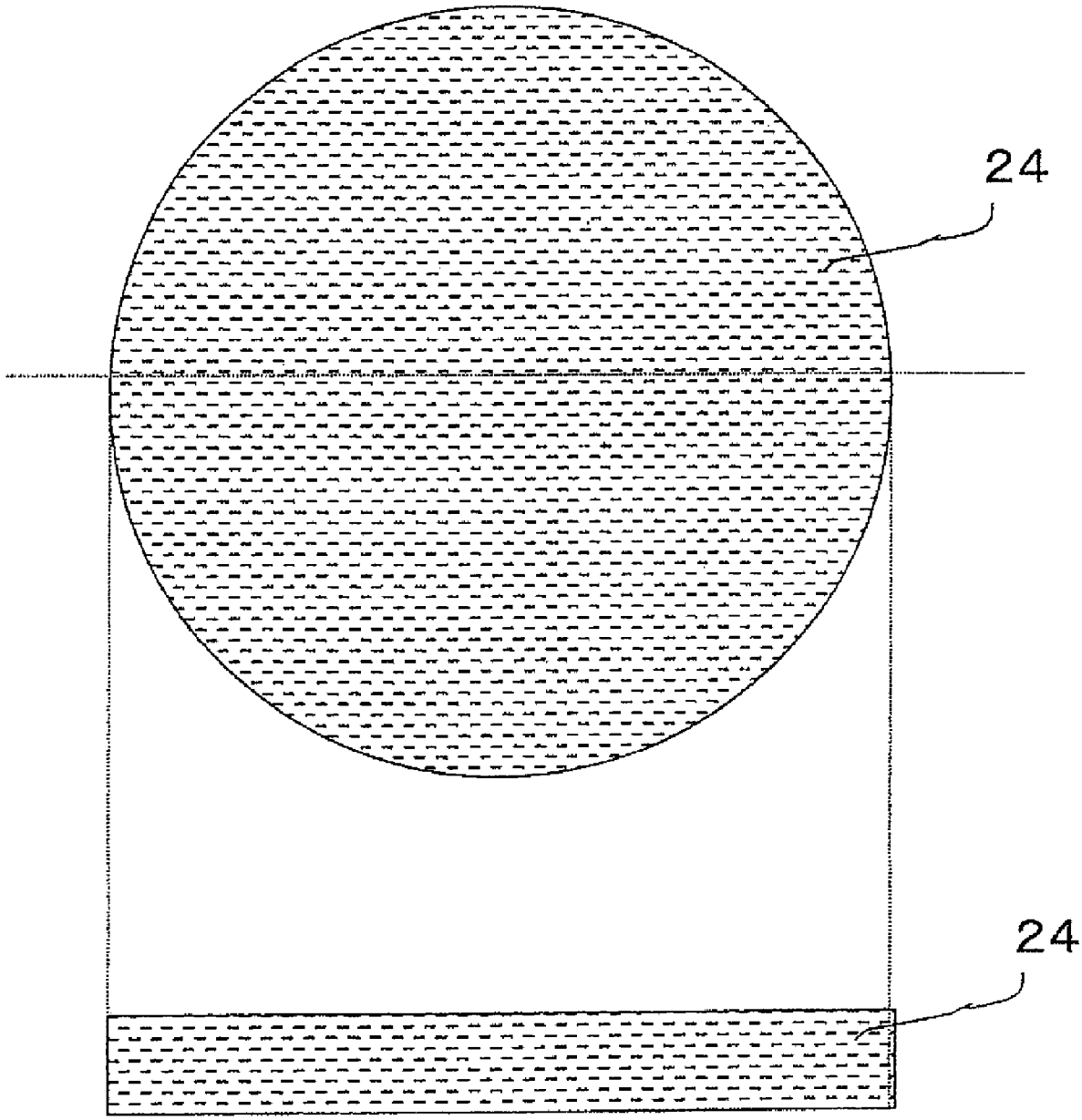
FIG. 2D is a schematic view of another component of the air flow control unit.
Figure 2E:
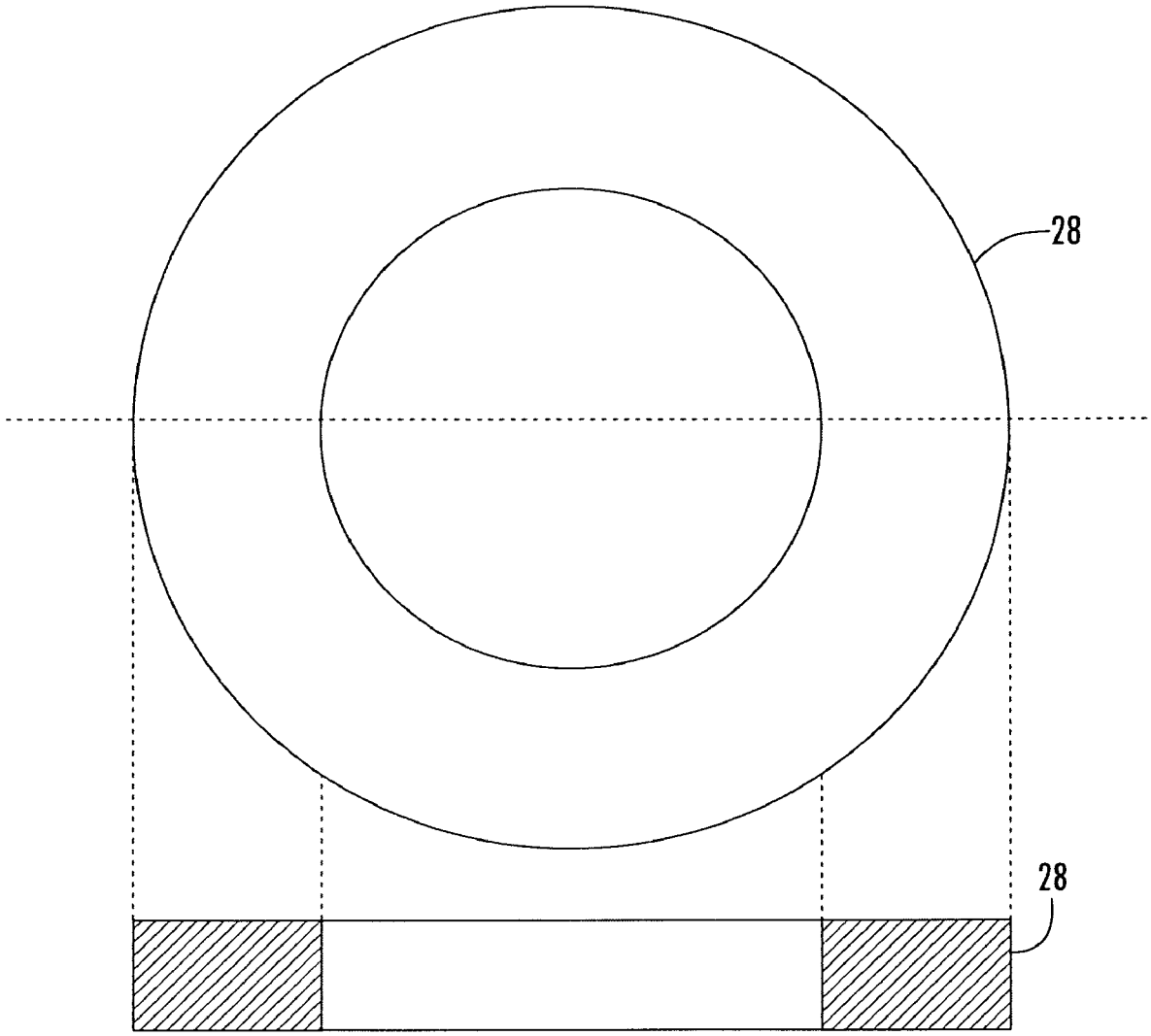
FIG. 2E is a schematic view of another component of the air flow control unit.
Figure 2F:
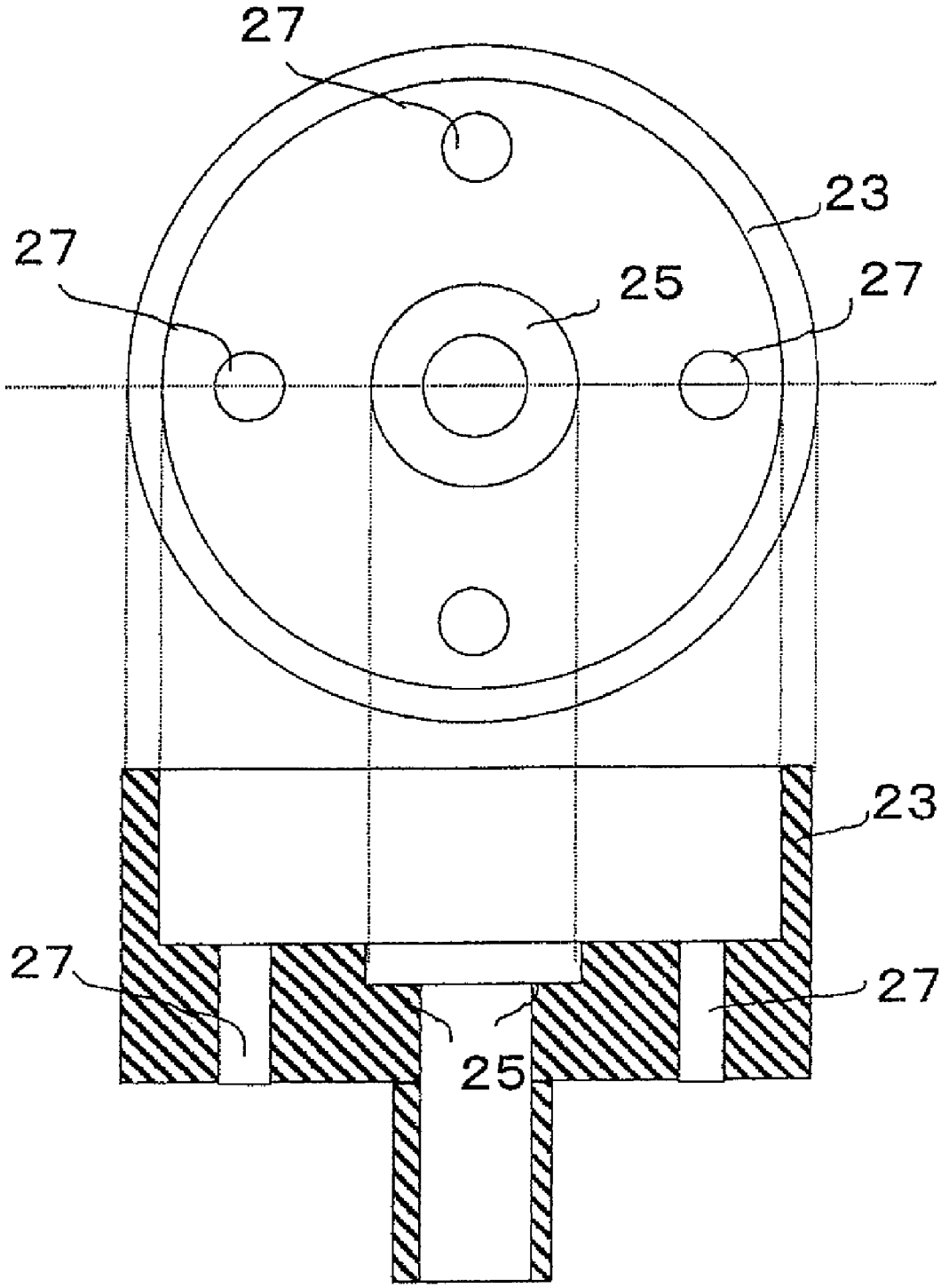
FIG. 2F is a schematic view of another component of the air flow control unit.

FIG. 2 is a schematic cross-sectional view of the air flow control unit 20 and the vicinity thereof. FIGS. 2A to 2F are schematic top views of the members (described later) constituting the air flow control unit 20 and schematic cross-sectional views taken along dotted lines in the top views.

The air flow control unit 20 includes a valve 22 and an ink proof membrane 24 provided between the valve 22 and the ink storage unit 10 for preventing the ink from reaching the valve 22. The valve 22 is formed of an elastic material including a plurality of interconnected fine pores, and the amount of air passing through the fine pores is changed according to the pressure difference between the ink storage unit 10 and the outside. The valve 22 thereby has a function of controlling the amount of air flow from the outside to the ink storage unit 10. In the first embodiment, the air flow control unit 20 further includes a flat plate (pressing ring) 26 having a holed portion and serving as an air layer forming member, the flat plate 26 being disposed between the ink proof membrane 24 and the valve 22 so as to be sandwiched therebetween. The air flow control unit 20 further includes a water proof membrane 28 for preventing water from reaching the valve 22, the water proof membrane 28 being disposed between the outside and the valve 22 and being a flat plate having a holed portion. In the first embodiment, the water proof membrane 28 and the flat plate 26 function as securing members that press and secure the valve 22. The water proof membrane 28 and the flat plate 26 are pressed by an upper lid (cap) 21 and a base portion 23 (an end portion 25 of the ventilation hole). The upper lid 21 is fastened to the base portion 23 and the upper surface portion 12 of the ink storage unit by bolts passing through bolt holes 27. When the upper lid 21 is fastened by the bolts, the pressing force from the upper lid 21 and the reaction thereof from the end portion 25 causes the valve 22 to be uniformly pressed by the water proof membrane 28 and the flat plate 26.

As described above, the valve 22 is formed of an elastic material including the plurality of interconnected fine pores, and the amount of air passing through the fine pores is changed according to the pressure difference between the ink storage unit 10 and the outside. The valve 22 thereby has the function of controlling the amount of air flow from the outside to the ink storage unit 10. No particular limitation is imposed on the material and structure of the valve 22, and the valve disclosed in the previous Japanese Patent Application Laid-Open No. 2001-277777 or a commercially available valve may be used as the valve having the above function. The valve 22 is a flat plate having a substantially circular shape. The thickness of the valve 22 is set to 0.5 mm or more and 5.0 mm or less. When the thickness of the valve 22 is 0.5 mm or less, the stiffness of the circumferential held portion of the valve 22 is high, so that the amount of air flowing therethrough (leaking therefrom) can be reduced. The function of exchanging air according to a pressure change is obtained by utilizing the thickness of the valve 22. When the thickness is 0.5 mm or more, the valve 22 having a suitable air exchange function can be easily produced. In particular, the exchange of air can be controlled at very low pressures. Meanwhile, when the thickness is 5.0 mm or less, the flow passage of air in the valve 22 is prevented from being excessively complicated, and a suitable passage length can be obtained, so that the rate of response of the air exchange is increased. Therefore, the ink can be supplied quickly, and faint printing can be reduced. The outer dimension of the valve 22 (the diameter of the disk) is set to 4 mm or more and 20 mm or less. When the outer dimension is 4 mm or more, the area of the air exchange portion at the center of the valve 22 can be large enough to reduce the influence of the constrained circumferential held portion, so that the valve 22 is allowed to be elastically deformed in an appropriate manner according to a change in pressure. In this manner, the responsivity of air exchange to a very small pressure change in the ink storage unit 10 is improved. When the outer dimension is 20 mm or less, the area of the air exchange portion at the center of the valve 22 can be prevented from being excessively increased. In this manner, the air exchange region of the valve 22 is prevented from being deflected and deformed as a whole due to a very small pressure change in the ink storage unit 10. Therefore, the valve 22 is elastically deformed in an appropriate manner according to a very small pressure change, so that the responsivity of air exchange can be improved. In addition, the valve 22 can be installed in a small space in an upper lid.

In the first embodiment, the valve 22 is a compressed body that does not exhibit air permeability when compressed. Specifically, the compressed body is a compressed porous body produced by compressing an interconnected porous body formed of an elastic material until its air permeability is lost. In this manner, a good air flow control function can be attained. Such a compressed porous body has thereinside a large number of irregularly shaped spaces that are defined by the squeezed and folded elastic material forming the interconnected porous body and does not exhibit air permeability when compressed. However, the irregularly shaped spaces formed inside the compressed porous body are in communication with each other. Therefore, when a pressure difference is generated between the inside and outside of the ink storage unit 10, the valve 22 is stretched. When the generated pressure difference is equal to or greater than a predetermined level, air is introduced from the outside to the inside of the compressed porous body. The introduced air forces open ventilation holes connecting the spaces interconnected in the compressed porous body and deforms the valve. Accordingly, the air moves to the opposite side of the compressed porous body or the ink storage unit 10 side, whereby air permeability is created. The amount of ventilation (the amount of air flow) is determined how much air is allowed to pass through the spaces interconnected in the compressed porous body. When the pressure difference is large, the valve 22 is stretched to a great extent. Therefore, the flow of air through the spaces interconnected in the compressed porous body is facilitated, and the amount of ventilation increases. When the pressure difference is equal to or greater than the predetermined pressure difference level but is small, the valve 22 is stretched to a lesser extent. In this case, the amount of air passing through the spaces interconnected in the compressed porous body is reduced, and therefore the amount of ventilation is reduced. When the pressure difference is reduced by ventilation through the valve 22, the valve 22 is contracted, and therefore the amount of ventilation is reduced. When the pressure difference is further reduced to less than the predetermined pressure difference level, the valve 22 is again compressed, and the air permeability of the valve 22 is lost. As described above, since the amount of ventilation is changed according the pressure difference, the pressure inside the ink storage unit 10 can be rapidly and appropriately adjusted and is held constant. In order to sufficiently exert the elastic deformation function, the minimum outer dimension W of the communication region of the valve 22 that is in communication with the ink side is set to at least two times of the thickness T of the valve 22. Specifically, the minimum outer dimension W is set to at most 15 times of the thickness T. In this manner, the valve 22 can be elastically deformed in the direction of air flow in a flexible manner, so that air can be exchanged in quick response to a small change in internal pressure. For example, when the internal pressure is slightly reduced, the valve 22 is slightly stretched inwardly. This causes the porous material in the valve 22 to be expanded, whereby an air exchange passage is formed to provide inward ventilation.

The level of the pressure difference between the ink storage unit 10 and the outside (the atmosphere) that provides the air permeability of the valve 22 can be determined by appropriately selecting the interconnected pores and the degree of compression. It is preferable to compress the interconnected porous body such that the valve 22 dose not exhibit air permeability when the pressure difference is, for example, 20 $mmH_2O$ or less and exhibits air permeability when the pressure difference is, for example, 20 $mmH_2O$ or greater. Preferably, the air exchange function is provided such that the internal pressure when the ink is discharged from the ink storage container 100 to an ink-jet printer is set to −20 $mmH_2O$ to −350 $mmH_2O$. This is because the inside of a cartridge of the ink-jet printer can be held at a suitable negative pressure during printing.

Any elastic material having a plurality of fine pores and allowing air to pass through the fine pores when stretched can be appropriately used as the elastic material forming the valve 22. Examples of such an elastic material include polypropylene, various rubbers, and various elastomers. Examples of the interconnected porous body include: interconnected porous bodies formed by mixing an inert gas, a decomposable foaming agent, and/or a volatile organic liquid with a rubber and/or plastic material and foaming the mixture to form interconnected pores; and interconnected porous bodies formed by producing a plate-like body of a kneaded product of inorganic powder such as calcium carbonate and a rubber-plastic raw material and dissolving and removing the inorganic powder to form interconnected pores. Examples of the rubber and/or plastic material include elastic materials such as natural rubbers, styrene-butadiene rubbers, acrylonitrile-butadiene rubbers, chloroprene rubbers, neoprene rubbers, polyvinyl chlorides, polyethylenes, polypropylenes, acrylonitrile butadienes, polystyrenes, polyamides, polyurethanes, silicone resins, epoxy resins, phenolic resins, urea resins, and fluorocarbon resins. Of these, ether-based polyurethane resins are particularly preferred in terms of the durability against liquid, the ease of forming the interconnected porous body, and the productivity.

As described above, the elastic material forming the valve 22 is stretched when a pressure difference is present between the inside and outside the ink storage container. The pressure difference decreases as ventilation proceeds, and the ventilation no longer occurs when the original state is recovered. It is preferable that the original compressed state in which the valve 22 does not exhibit air permeability be always recovered even after the above procedure is repeated. In order to achieve this, it is preferable that the compressed body be excellent in compression set properties. In addition, the Young's modulus of the valve 22 is preferably 1 MPa or more and 5,000 MPa or less, and the hardness of the valve 22 measured using an ASKER F type hardness meter is preferably 30 or more and less than 100.

When the valve 22 is formed from a material in which the number of pores per unit length (cm) before compression is 4 or more and 1,000 or less, the internal pressure can be easily controlled. Moreover, when a disk-shaped sample having a thickness of 8 mm is formed from a compressed material that has been subjected to compression under heating or while heat is applied through high frequency heating, the hardness of the disk-shaped sample measured using an ASKER C type hardness meter is preferably 20 or more and less than 100. Preferably, the compression is performed such that the compressibility ratio (the thickness ratio of the compressed material to the material before compression) is 5% or more and 40% or less. In this manner, reliable sealing can be easily obtained when the pressure difference is less than the predetermined level.

The valve 22 is disposed and secured in the air flow control unit 20 by placing the valve 22 on the flat plate 26 and placing the holed flat plate-like water proof membrane 28 on the valve 22. With the securing method described above, the valve 22 can be easily disposed. In the first embodiment, the valve 22 is uniformly pressed since a large area thereof is pressed by the flat water proof membrane 28 as well as by the flat plate 26. Therefore, the valve 22 is prevented from being excessively stretched, so that the amount of ventilation can be prevented from increasing excessively.

In the first embodiment, a liquid repellent material having air permeability is preferably used for forming the ink proof membrane 24, but the present invention is not limited thereto. Any water proof material and any membrane that can prevent the ink from coming into contact with the valve 22 can be used. In addition, a material having a large critical surface tension can be used. The ink proof membrane 24 may not have air permeability when the membrane does not cover the entire portion of the ventilation hole 14 and at least a part of the ventilation hole 14 is open.

Any liquid repellent material having air permeability can be used as the liquid repellent material used in the first embodiment. In particular, a liquid repellent material having a critical surface tension of 25 dyn/cm or less is preferably used. Examples of such a liquid repellent material include resin membranes and inorganic membranes. Fluorocarbon resins and fluorocarbon rubbers can be preferably used, and polytetrafluoroethylene is more preferable.

The ink proof membrane 24 has a plurality of interconnected fine pores for providing air permeability, and the diameter of the plurality of fine pores is preferably 5 μm or less and 0.01 μm or more, and more preferably 0.1 μm or less. When the pore diameter is 5 μm or less, the ink is prevented from entering into the pores even when dropping and vibration impacts are applied, so that the air exchange function can be obtained stably. When the pore diameter is 0.01 μm or more, the responsivity of air exchange is improved, and the ink is smoothly supplied, so that faint printing can be reduced.

The ink proof membrane 24 is disposed and secured in the air flow control unit 20 by placing the ink proof membrane 24 on the base portion 23 so as to cover the ventilation hole 14 and placing the flat plate 26 on the ink proof membrane 24. With the above securing method, environmental conditions such as temperature and pressure are not changed, and shocks and vibrations are applied. Moreover, since the ink proof membrane 24 is simply placed on the base portion 23 and is not required to be bonded with an adhesive, the securing method is simple and easy.

The flat plate 26 has a substantially circular disk shape, and the holed portion is a substantially cylindrical through hole. Therefore, the flat plate 26 is a doughnut-like flat plate. An air layer 29 is formed between the ink proof membrane 24 and the valve 22 through the flat plate 26. Even when the ink stored in the ink storage unit 10 passes through the ink proof membrane 24, the air layer 29 preferably prevents the ink from reaching the valve 22. In the first embodiment, the doughnut-like flat plate is used as the flat plate 26, but the invention is not limited thereto. Any structure capable of forming the air layer 29 can be used as the flat plate 26. Specifically, any structure capable of forming an air layer between the ink proof membrane 24 and the valve 22 can be used irrespective of the shape and position thereof. In the first embodiment, the holed disk-like flat plate is used as described above since such a flat plate can preferably press the valve 22 uniformly.

No particular limitation is imposed on the material for the water proof membrane 28, and any water repellent material that can provide air permeability can be used. Of course, liquid repellent materials such as fluorocarbon resins can be used. In the first embodiment, the water proofing properties are improved by using the holed disk-like flat plate (O-ring) to form the air layer, but the invention is not limited thereto. The water proof membrane 28 is placed above the flat plate 26 and is pressed and secured with the upper lid 21.

As described above, in the first embodiment, the air flow control unit 20 is secured using the simple securing method. Specifically, the ink proof membrane 24, the flat plate 26, the valve 22, the water proof membrane 28, and the upper lid 21 are placed in that order on the end portion 25 of the ventilation hole 14 in the base portion 23. Then, the upper lid 21 is fastened with the bolts passing through the bolt holes 27, whereby the assembly including the ink proof membrane 24, the flat plate 26, the valve 22, and the water proof membrane 28 is secured.

With the simple structure described above, the distance between the upper surface of the valve 22 of the air flow control unit 20 (the surface on the side opposite to the ink side) and the lower surface of the water proof membrane 28 (the surface on the ink side) is set to 1.5 mm or more and 20 mm or less. As a result, the air flow control unit 20 is small in size, so that the internal space of the ink storage unit 10 can be increased. Moreover, an ink absorbing material or other members are not required to be placed in the ink storage unit 10, so that the entire internal volume of the ink storage unit 10 can be used for ink storage purpose.

In the first embodiment, the ink proof membrane 24 and also the air layer 29 provided by the flat plate 26 prevent the ink from reaching the valve 22, and therefore the air flow can be controlled with improved accuracy. The water proof membrane 28 prevents water contained in the outside air from reaching the valve 22, and therefore the air flow can be controlled with improved accuracy. Moreover, since a large area of the valve 22 is uniformly pressed from both sides by the flat plates, the amount of stretch of the valve 22 can be controlled with improved accuracy, and therefore the air flow can be controlled with improved accuracy.

(Ink Ejection Unit)

Figure 3:
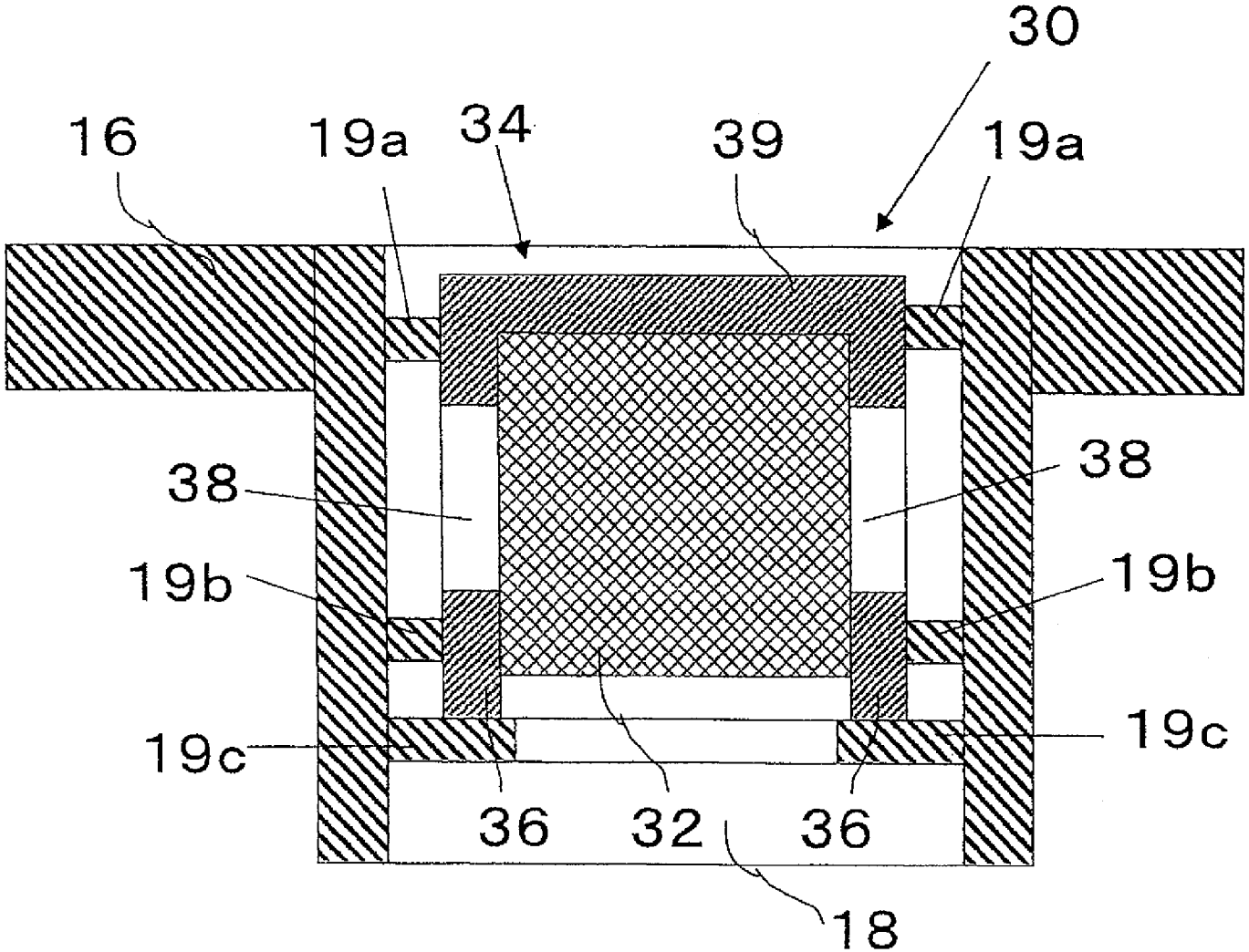
FIG. 3 is a schematic cross-sectional view of an ink ejection unit, and the vicinity thereof, of the ink storage container.

FIG. 3 is a schematic cross-sectional view of the ink ejection unit 30 and the vicinity thereof.

The ink ejection unit 30 is disposed in the ink ejection hole 18 of the ink storage unit 10 and includes: a pressure-contacting body 32 that is brought into a pressure-contacting state when the ink is supplied to an ink-jet printer; and a moving valve 34 that is joined and integrated with the pressure-contacting body 32. Protruding portions 19*a*, 19*b*, and 19*c* are provided in the ink ejection hole 18 so as to protrude from the bottom surface 16 toward the center of the ink ejection hole 18. The integrated body of the pressure-contacting body 32 and the moving valve 34 is configured such that a lower end 36 of the moving valve 34 is placed on the protruding portion 19*c* when the ink is not supplied.

The moving valve 34 is a water proof member that is made of, for example, a metal and prevents the ink from leaking from the ink ejection hole 18 through the pressure-contacting body 32. The moving valve 34 has through holes 38 that are provided in areas in contact with the pressure-contacting body 32 and are located between the protruding portions 19*a* and 19*b* when the ink is not supplied. When the ink is not supplied, an upper surface portion 39 of the moving valve 34 and the protruding portion 19*a* prevent the ink in the ink storage unit 10 from leaking from the ink ejection hole 18.

Figure 3A:
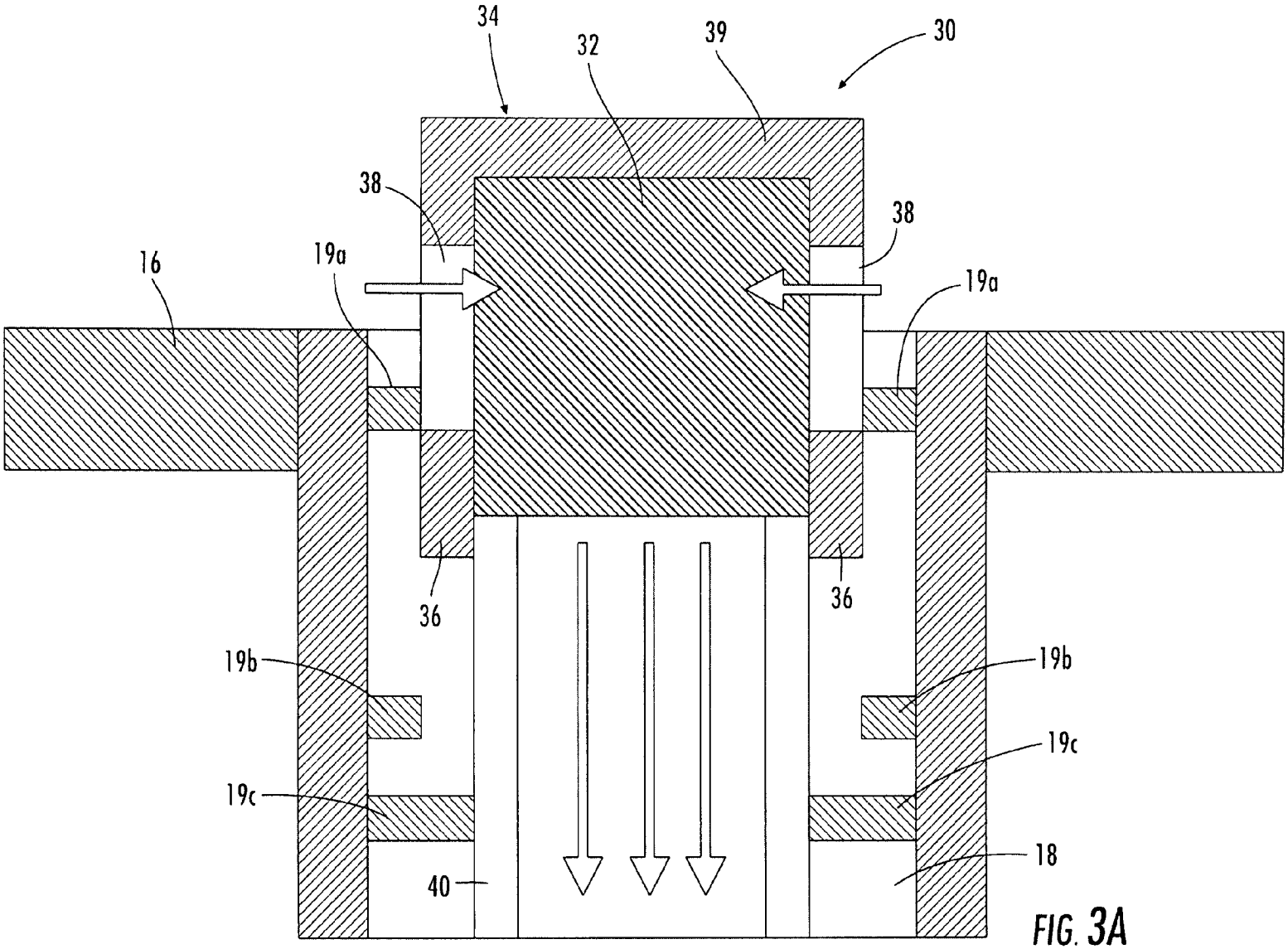
FIG. 3A is a schematic cross-sectional view of the ink ejection unit, and the vicinity thereof, of the ink storage container.

As shown in FIG. 3A, when the ink storage container 100 is installed in an ink-jet printer and the ink is supplied, the integrated body of the pressure-contacting body 32 and the moving valve 34 is pushed up inside the ink storage unit 10 by a corresponding contacting member 40 of the ink-jet printer. Then, at least portions of the through holes 38 are located above the protruding portion 19*a*, and the ink flows into the pressure-contacting body 32 through the portions of the through holes 38 that are located above the protruding portion 19*a*, as shown by the arrows. Therefore, the ink is supplied to corresponding contacting member 40 of the ink-jet printer from the pressure-contacting body 32.

When the ink storage container 100 is removed from the ink-jet printer, the integrated body of the pressure-contacting body 32 and the moving valve 34 returns to the original state in which the lower end 36 is placed on the protruding portion 19*c*, whereby the ink is again prevented from leaking. The leakage of the ink from the edge of the ink ejection hole 18 is prevented by the three protruding portions, i.e., not only by the protruding portion 19*a* but also by the protruding portions 19*b* and 19*c*. The protruding portions 19*a* and 19*b* may not be provided. In this case, the side surface of the moving valve 34 may be brought into intimate contact with the side wall of the ink ejection hole 18, whereby the leakage of the ink is prevented.

Although an ink absorbing material is not used, the leakage of the ink from the ink ejection hole 18 can be prevented by providing the ink ejection unit 30 described above. In addition, when the ink is supplied, the ink can be rapidly supplied to the ink-jet printer through the through holes 38 and the pressure-contacting body 32.

Figure 4:
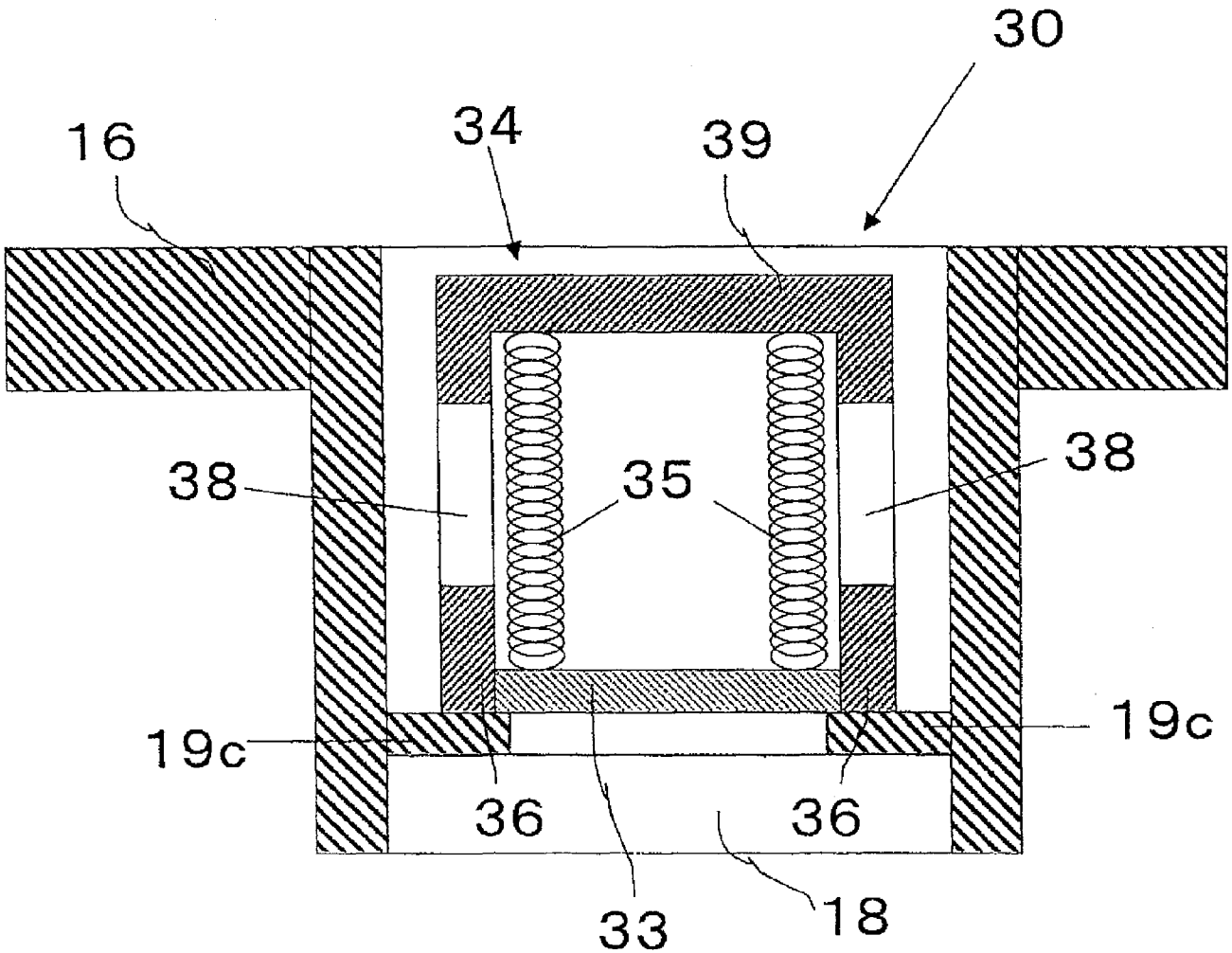
FIG. 4 is a schematic cross-sectional view of an ink ejection unit, and the vicinity thereof, in a modified embodiment of the first embodiment.

FIG. 4 is a schematic cross-sectional view of an ink ejection unit 30, and the vicinity thereof, of a modified embodiment.

This ink ejection unit 30 is provided in the ink ejection hole 18 of the ink storage unit 10 and includes the moving valve 34 that moves when the ink is supplied to an ink-jet printer. In this modified embodiment, only the protruding portion 19*c* is provided in the ink ejection hole 18 so as to protrude from the bottom surface 16 toward the center of the ink ejection hole 18.

The moving valve 34 includes a lower valve 33 and the upper surface portion 39, and the lower valve 33 and the upper surface portion 39 are connected to each other by springs 35 used as elastic members. When the ink is not supplied, the lower valve 33 prevents the ink from leaking.

Figure 4A:
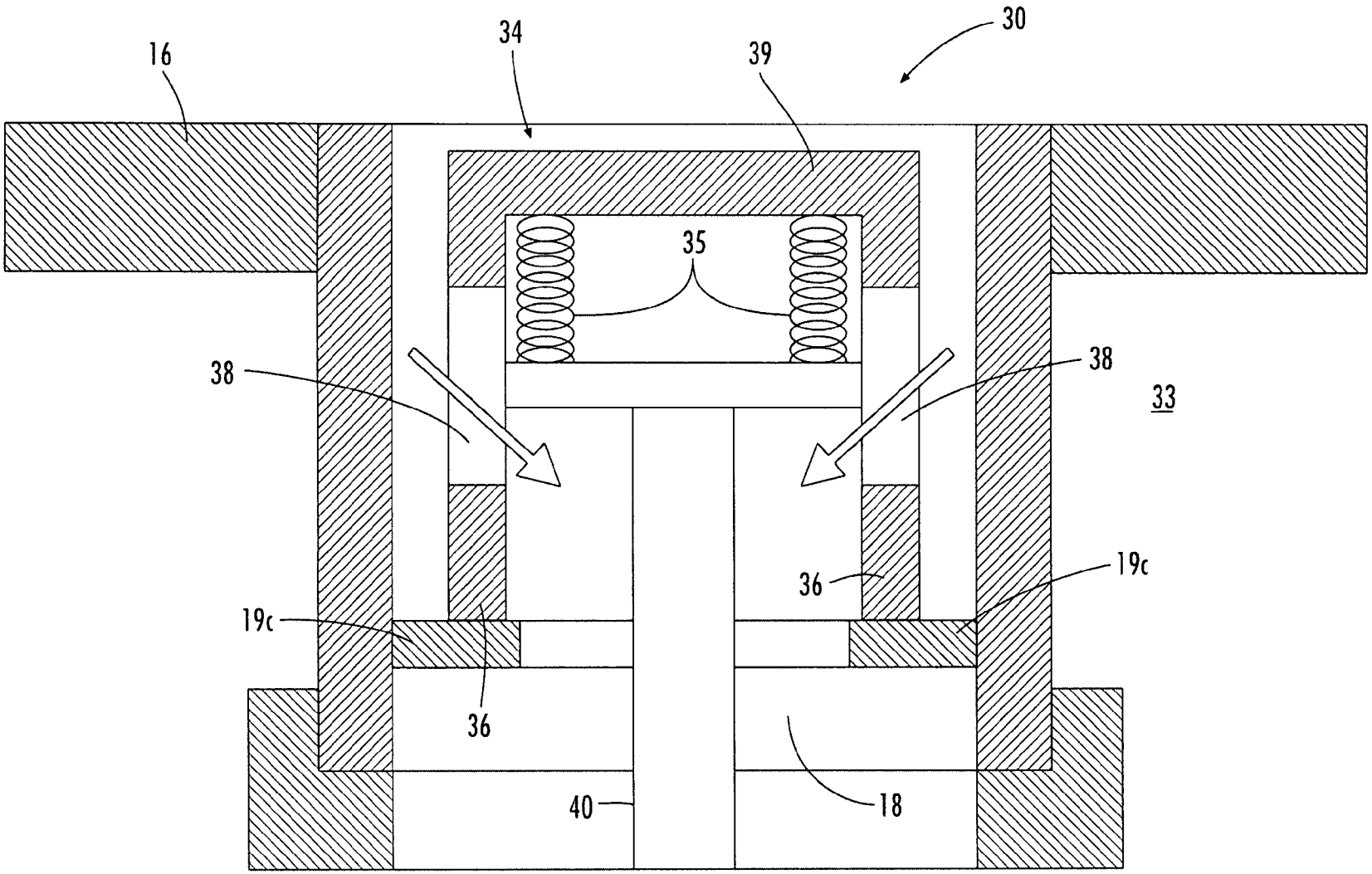
FIG. 4A is a schematic cross-sectional view of the ink ejection unit, and the vicinity thereof, in the modified embodiment.

The moving valve 34 has the through holes 38 in its side wall. As shown in FIG. 4A, when the ink storage container 100 is installed in an ink-jet printer and the ink is supplied, the springs 35 are compressed by a corresponding contacting member 40 of the ink-jet printer, and the lower valve 33 of the moving valve 34 is moved upward and is located above the protruding portion 19*c*. Then, the ink flows through the generated gaps as shown by the arrows and is supplied to the corresponding contacting member 40 of the ink-jet printer.

When the ink storage container 100 is removed from the ink-jet printer, the springs 35 extend, and the lower valve 33 returns to the level substantially the same as the level of the protruding portion 19*c*, whereby the ink is again prevented from leaking.

In the above modified embodiment, although the ink absorbing material and the pressure-contacting body are not used, the leakage of the ink from the ink ejection hole 18 can be prevented by providing the ink ejection unit 30. In addition, when the ink is supplied, the ink can be rapidly supplied to the ink-jet printer through the through holes 38.

A second embodiment of the present invention will now be described with reference to FIGS. 5 to 12. Components the same as or equivalent to those of the first embodiment are designated by the same reference numerals used in the first embodiment. As shown in the vertical cross-sectional view of FIG. 5, an ink storage container 100 includes: a main body 10*a* formed of a suitable synthetic resin; and an upper surface portion 10*b* that is fitted to the main body 10*a* so as to cover the main body 10*a*, and the main body 10*a* and the upper surface portion 10*b* are connected to each other at portion B. The shape of the ink storage container 100 is a rectangular parallelepiped having a width in the depth direction smaller than the height. Two chambers 11*a* and 11*b* separated by a partition wall 10*d* having a through hole 10*c* in its lower portion are provided in the inner space 11 of the ink storage container 100. An air flow control unit 20 described later is provided in portion A, and an ink ejection unit 30 is provided in portion C.

Figure 5:
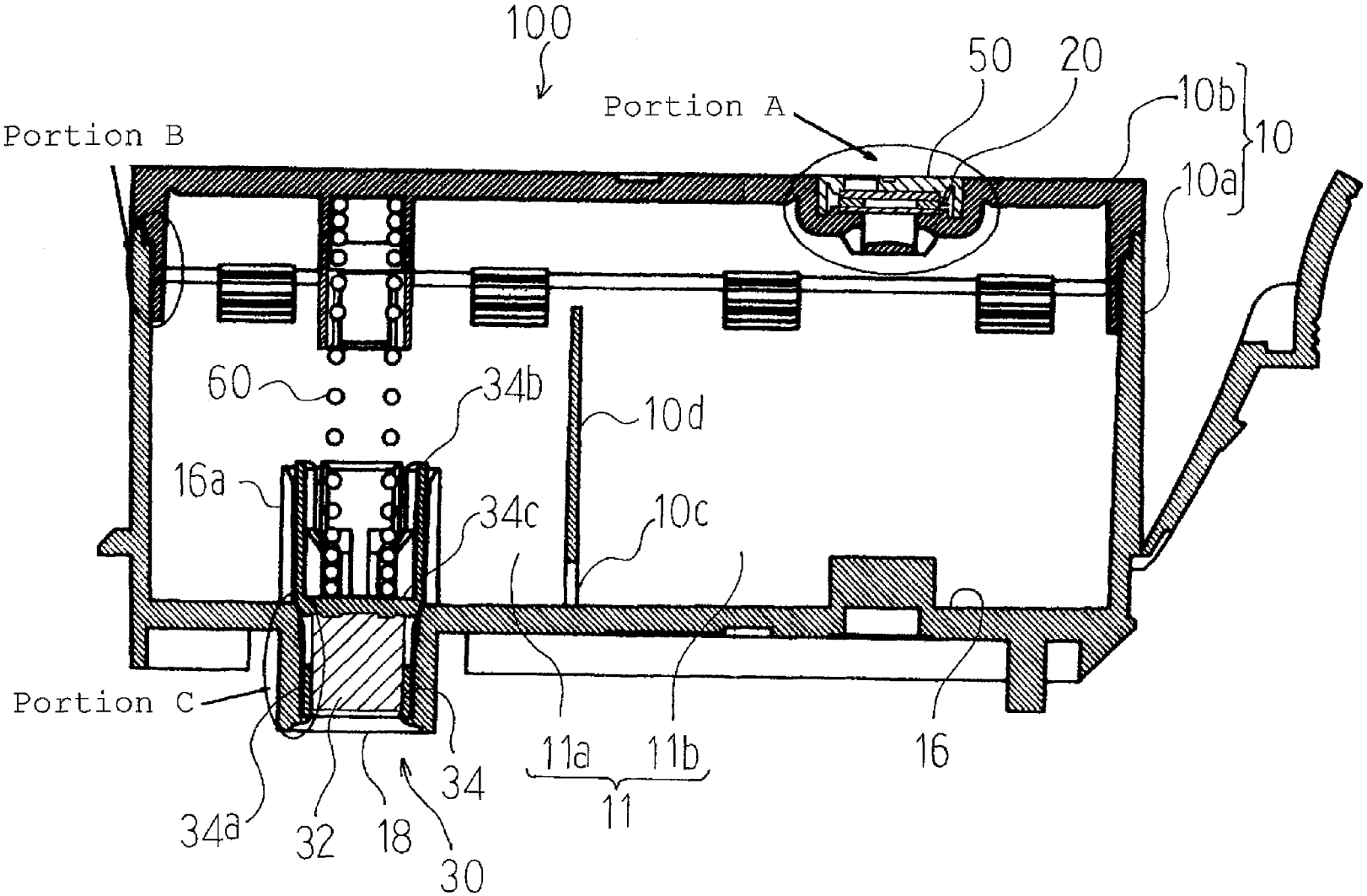
FIG. 5 is a vertical cross-sectional view of an ink storage container of a second embodiment of the present invention.
Figure 6:
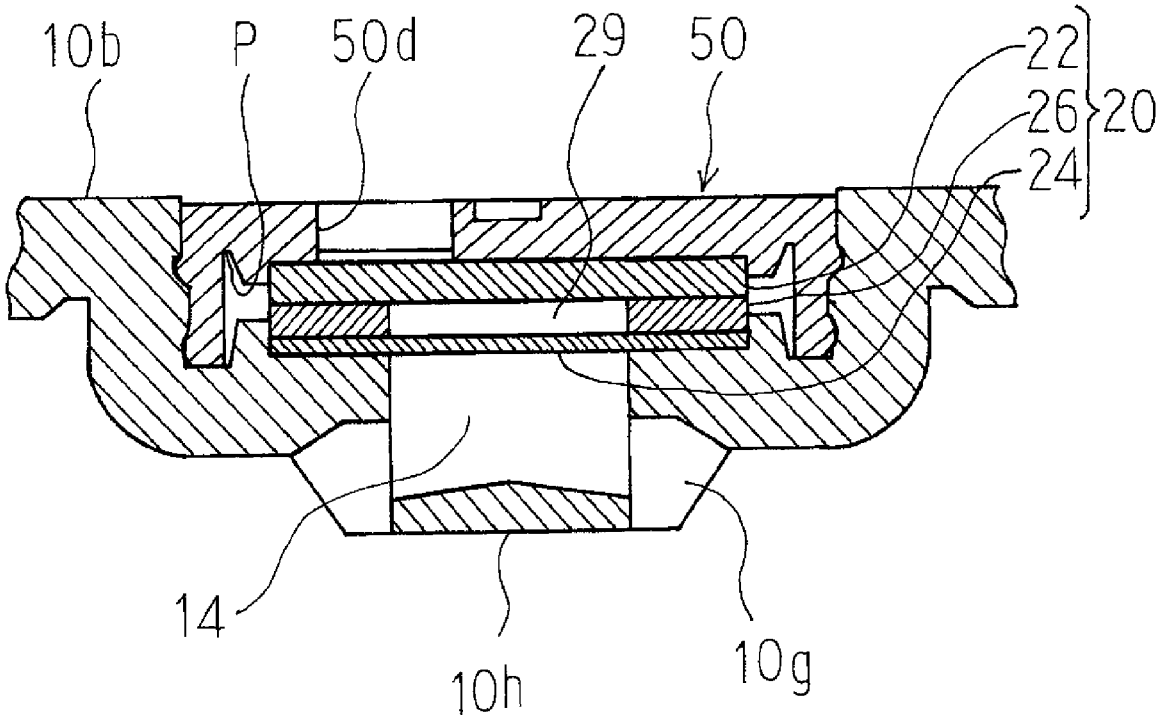
FIG. 6 is an enlarged cross-sectional view of portion A in FIG. 5.
Figure 7:
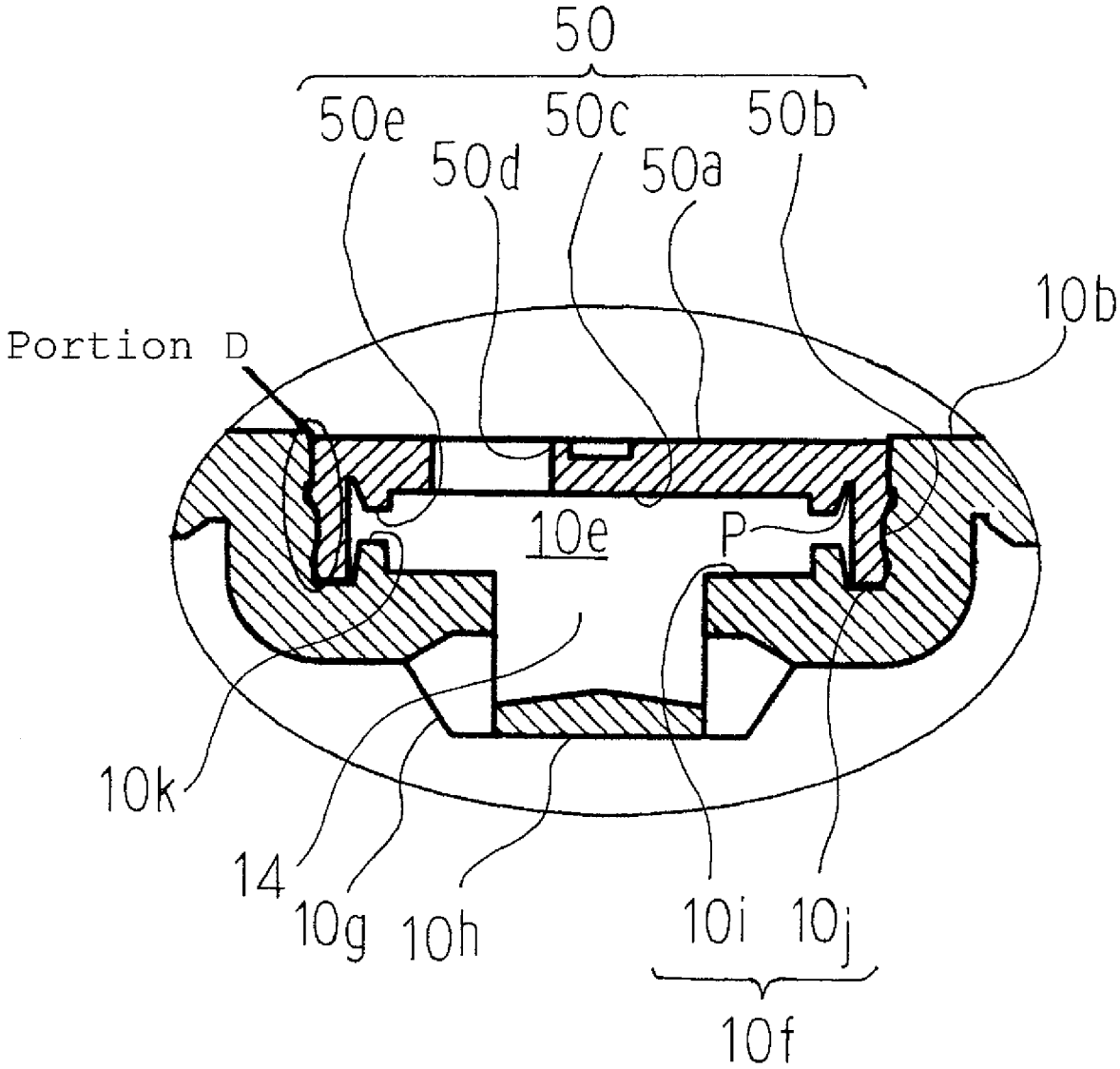
FIG. 7 is an enlarged cross-sectional view similar to FIG. 6, in which the air flow control unit shown in FIG. 6 is not shown.

The portion A in FIG. 5 is a portion in which the air flow control unit 20 is provided, and the structure of a recess 10*e* in which the air flow control unit 20 is mounted is described in FIGS. 6 and 7. The recess 10*e* having a circular cross-sectional shape is formed in the upper surface portion 10*b* and is covered with a cap 50. A ventilation hole 14 in communication with the inner space 11 of the container is drilled in the central portion of a bottom portion 10*f* of the recess 10*e*, and a buffering portion 10*h* is provided below the ventilation hole 14 through a slit portion 10*g*. The upper surface of the buffering portion 10*h* is a conical surface with the center protruding toward the ventilation hole 14, so that the ink is prevented from being accumulated in the buffering portion 10*h*. Moreover, a Teflon membrane-placing portion 10*i* and a lower edge-receiving portion 10*j* are provided in the bottom portion 10*f*. The Teflon membrane-placing portion 10*i* is an annular dented portion (annular step portion) that receives a Teflon membrane 24, which is a component of the air flow control unit 20, and determines the position of the Teflon membrane 24. The lower edge-receiving portion 10*j* is an annular groove provided concentrically with the outer circumference of the Teflon membrane-placing portion 10*i* and is configured to receive the lower edge of a circumferential portion 50*a* of the cap 50. When the cap 50 is mounted in the recess 10*e*, the lower edge of the circumferential portion 50*a* temporarily abuts against the lower edge-receiving portion 10' and therefore functions as a stopper. Therefore, the valve element 22 and the Teflon membrane 24 are prevented from receiving an excessive load at the time of assembling, and a reduction in the function of the air flow control unit 20 can be suppressed. After completion of the assembling, the cap 50 is urged upward by the restoring force of the air flow control unit 20, and therefore a small gap is formed between the lower edge of the circumferential portion 50*a* of the cap 50 and the lower edge-receiving portion 10*j*. In the manner described above, the air flow control unit 20 is held in the inner space of the recess 10*e* that is formed by placing the cap 50. Hereinbelow, the structure around the air flow control unit 20 is specifically described.

Figure 8:
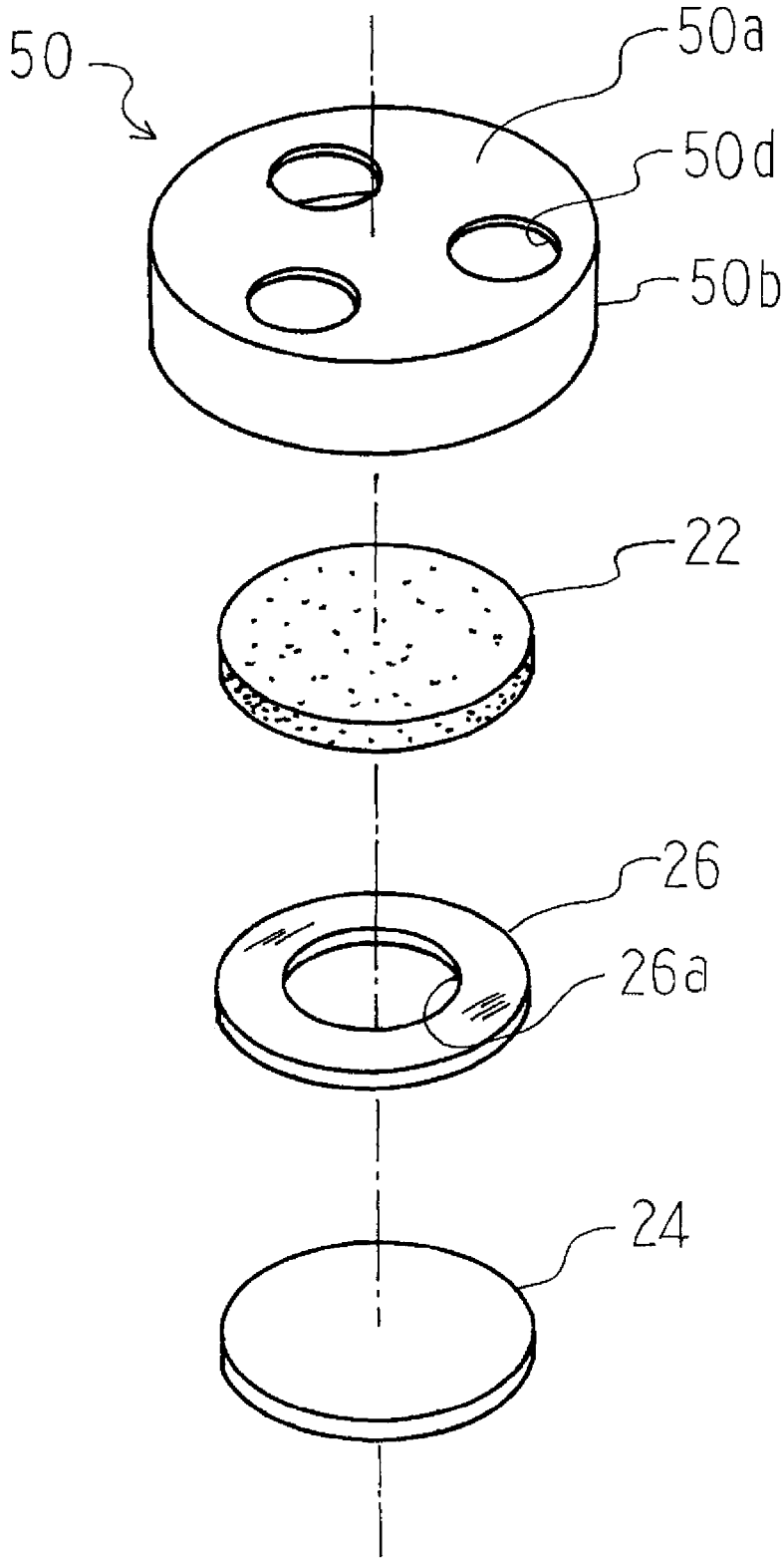
FIG. 8 is an exploded view of the cap and the air flow control unit in the second embodiment.

As shown in FIGS. 6 to 8, the air flow control unit 20 includes: the disk-like Teflon membrane 24 (corresponding to the ink proof membrane in the first embodiment) placed on the Teflon membrane-placing portion 10*i*; an annular (washer-like) pressing ring 26 (corresponding to the flat plate in the first embodiment) placed on the upper surface of the Teflon membrane 24; and the valve element 22 (corresponding to the valve in the first embodiment) placed on the upper surface of the pressing ring 26. The disk-like Teflon membrane 24 has air permeability and has been subjected to liquid repellent treatment. The pressing ring 26 has flat upper and lower surfaces and has a through hole 26*a* in the central portion thereof, and the through hole 26*a* corresponds to the ventilation hole 14. The valve element 22 is formed of an elastically-deformable interconnected porous material. The valve element 22 does not allow air to pass therethrough under normal conditions but allows air to be exchanged between the outside and the inner space 11 according to a change in the internal pressure of the inner space 11. The above components 24, 26, and 22 are stacked in that order from the bottom, whereby the air flow control unit 20 is formed.

The above valve element 22 has substantially the same structure as that of the valve 22 in the first embodiment. Specifically, the valve element 22 is produced as a disk-like compressed porous body formed of, for example, polyurethane. Under normal conditions, i.e., when no pressure difference is present between the outside and the inner space 11, the air permeability is lost, and air does not pass through the valve element 22. However, when the pressure difference is equal to or greater than a predetermined level, the valve element 22 is elastically deformed to a small extent and is stretched, and the fine pores are forced open, so that the air permeability is provided. Therefore, air flows from a high-pressure side to a low pressure side, whereby the function of controlling the air flow is obtained.

In contrast to the flat plate 26 in the first embodiment, the pressing ring 26 is formed of a metal. In this manner, the degree of flatness of the upper and lower surfaces of the pressing ring 26 is improved. Therefore, uniform surface pressure is applied to the valve element 22 and the Teflon membrane 24, and the contact condition between the contact surfaces thereof is improved, whereby the ink is prevented from leaking.

In contrast to the ink proof membrane 24 in the first embodiment, the Teflon membrane 24 is formed from a sheet-like body of Teflon, and the liquid repellency of the membrane prevents the ink from adhering thereto as much as possible.

The Teflon membrane-placing portion 10*i* is formed of an olefin-based resin and is formed as a smooth surface having improved smoothness. In this manner, when the Teflon membrane 24 is placed on the placing portion 11, the contact condition between the Teflon membrane 24 and the placing portion 10*i* is improved, so that the ink is prevented from infiltrating into the gap between the contact surfaces as much as possible. Moreover, an annular protruding portion 10*k* is formed around the Teflon membrane-placing portion 10*i* to separate the Teflon membrane-placing portion 10*i* from the lower edge-receiving portion 10*j*. In this manner, the Teflon membrane 24 is prevented from being displaced in the horizontal direction, and the protruding portion 10*k* functions as a guide for facilitating the placement of the circumferential portion of the cap 50 described later (see FIG. 7). Since the olefin-based material has low wettability, its liquid repellent effect is high. Therefore, when the placing portion 10*i* is in intimate contact with the Teflon membrane 24, the ink is prevented from infiltrating into the gap therebetween. Examples of the olefin-based resin include polypropylene and polyethylene. In the present embodiment, polypropylene is used.

The structure of the cap 50 will now be described. As shown in FIGS. 6 to 8, the cap 50 is formed of a resin material having suitable stiffness and includes a circular ceiling portion 50*a* and a tubular circumferential portion 50*b* that axially extends from the circumference of the ceiling portion 50*a*. The ceiling portion 50*a* has a flat valve element-placing portion 50*c* on a side facing the Teflon membrane-placing portion 10*i*, and three ventilation holes 50*d* are provided in the valve element-placing portion 50*c*. The number of the ventilation holes 50*d* is not limited to three, and the number of the ventilation holes 50*d* may be different from one and three.

An elastic hinge portion P having a small thickness is provided in the inside corner between the ceiling portion 50*a* and the circumferential portion 50*b*, i.e., the lower circumferential portion of the ceiling portion 50*a* (the inner base portion of the circumferential portion 50*b*). The hinge portion P is located immediately outside a circular protruding portion 50*e* forming the valve element-placing portion 50*c*. In this manner, the circumferential portion 50*b* is easily deformed elastically with the hinge portion P serving as a fixed point. The lower end of the circumferential portion 50*b* is formed so as to be capable of abutting against the lower edge-receiving portion 10*j*. The inserted depth of the cap 50 is limited to a certain level since the lower edge of the circumferential portion 50*b* abuts against the lower edge-receiving portion 10*j*, whereby the air flow control unit 20 is prevented from being compressed excessively.

Figure 9:
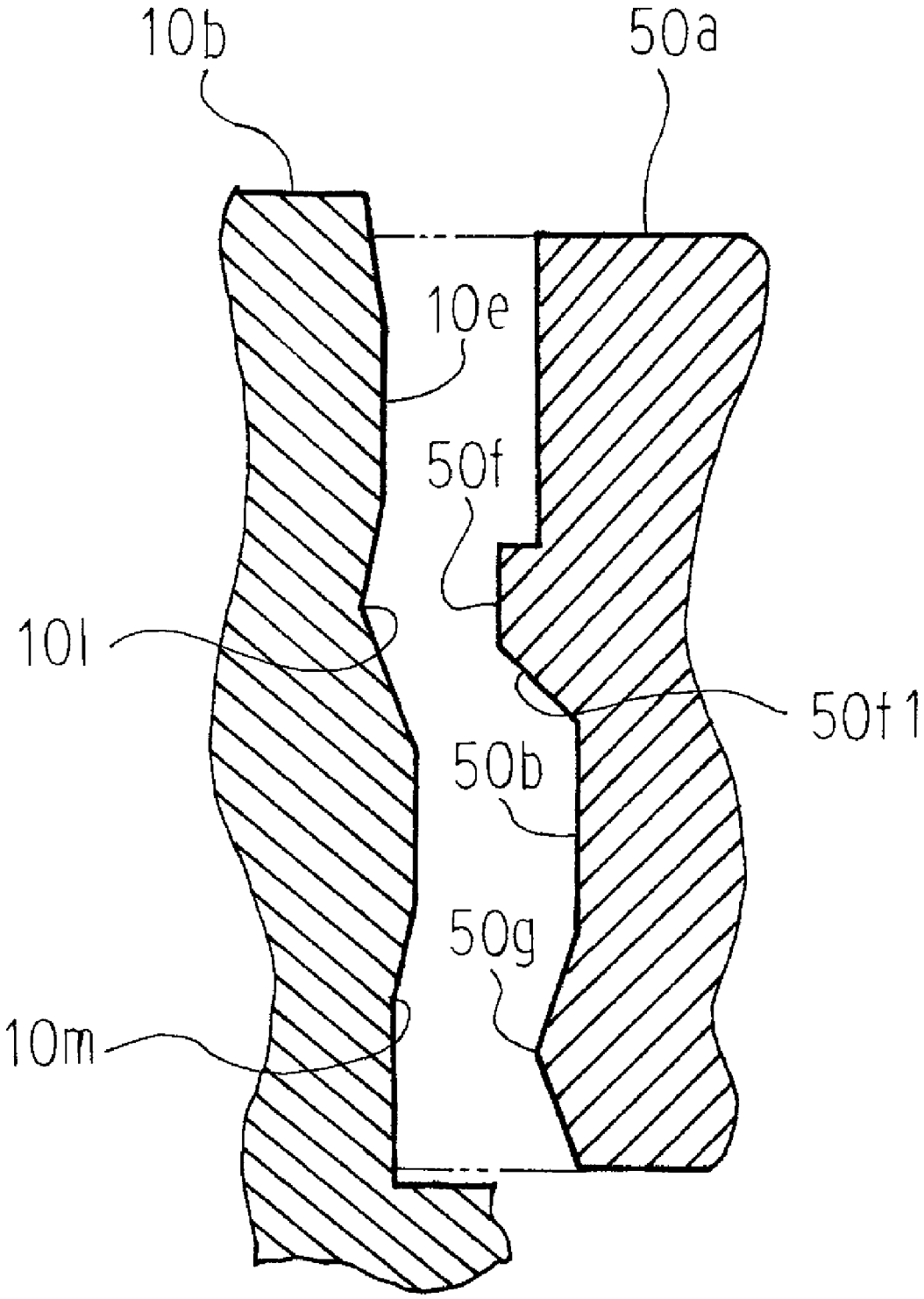
FIG. 9 is an enlarged exploded cross-sectional view of a main part in portion D in FIG. 7.
Figure 10:
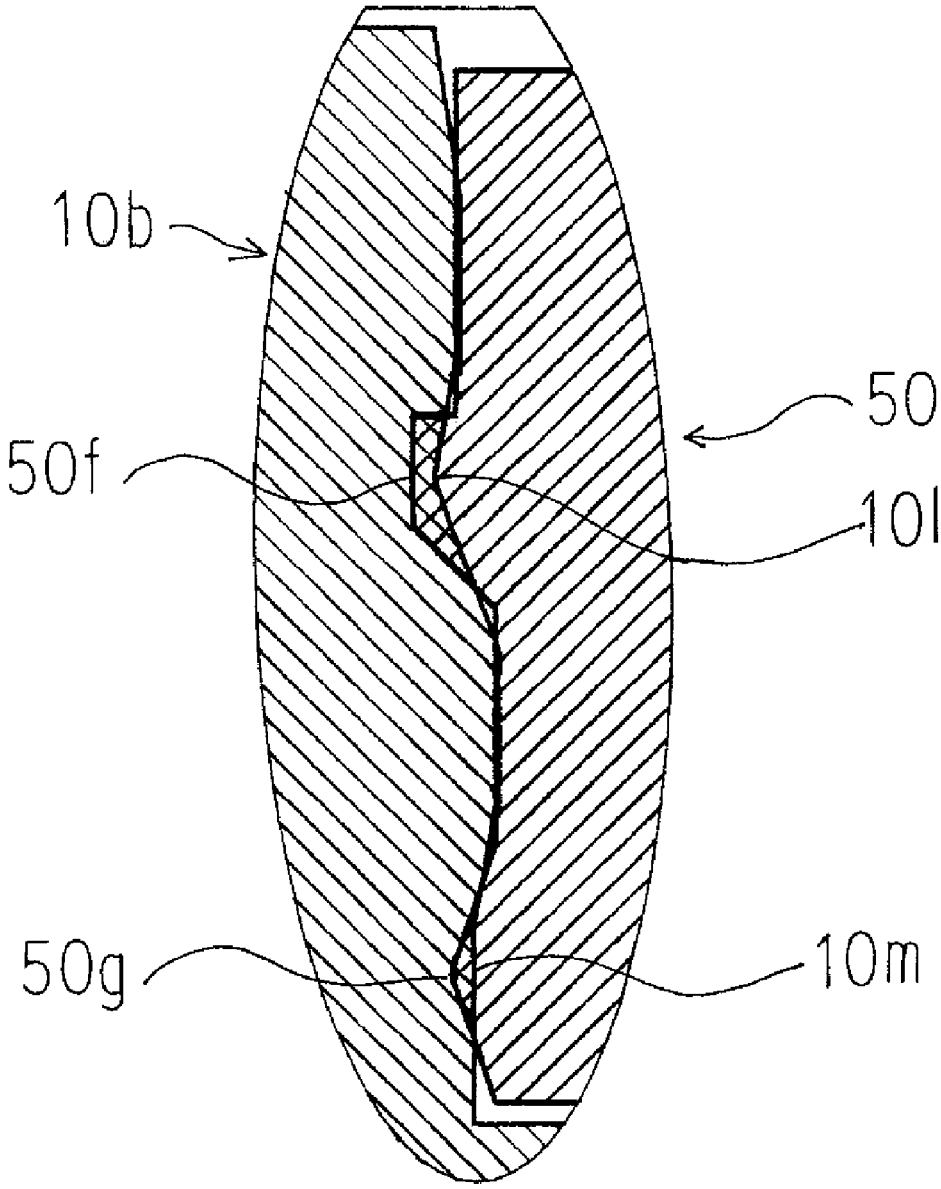
FIG. 10 is an enlarged cross-sectional view of the main part in portion D in FIG. 7.

Next, a description is given of the structural relation between the cap 50 and the recess 10*e* in portion D in FIG. 7. As shown in FIGS. 9 and 10, which are enlarged cross-sectional views of the portion D, an engaging portion is formed on the outer surface of the circumferential portion 50*b* of the cap 50. The engaging portion includes: a first engaging portion 50*f* having a protruding ledge-like shape (wedge-like cross-section or sawtooth like cross-section); and a second engaging portion 50*g* having a smoothly protruding convex shape and located axially below the first engaging portion 50*f*. The first engaging portion 50*f* has an inclined surface 50*f*1, so that the first engaging portion 50*f*, as well as the second engaging portion 50*g*, facilitates the insertion of the cap 50. An engaged portion that is engaged with the above engaging portion is formed on the inner circumferential wall of the recess 10*e*. This engaged portion includes a first engaged portion 10*l* and a second engaged portion 10*m* each extending in the circumferential direction. In this manner, a fit portion engaging the first engaging portion 50*f* and the second engaging portion 50*g* is formed.

When the cap 50 is pressed into the recess 10*e* to cover the recess 10*e*, the circumferential portion 50*b* enters the recess 10*e* while distorted around the elastic hinge portion P. As shown in the cross-hatched portions in FIG. 10, the circumferential portion 50*b* is fitted to the recess 10*e* with the first engaging portion 50*f* engaged in the first engaged portion 10*l* and with the second engaging portion 50*g* engaged in the second engaged portion 10*m*. Since a wedge effect is produced by the fit between the first engaging portion 50*f* and the first engaged portion 10*l*, the cap 50 is prevented from coming off in the radial direction. In addition, since a large contact area is provided by the fit between the second engaging portion 50*g* and the second engaged portion 10*m*, the cap 50 is prevented from rotating in the circumferential direction.

Returning to FIGS. 6 and 7, the Teflon membrane 24 is placed on the Teflon membrane-placing portion 10*i*; the pressing ring 26 is placed on the Teflon membrane 24; and the valve element 22 is placed on the pressing ring 26. Therefore, the air flow control unit 20 having the three stacked layers is disposed in the recess 10*e*. Subsequently, the valve element-placing portion 50*c* is brought into contact with the upper surface of the valve element 22, and the cap 50 is pressed into the recess 10*e* to cover the recess 10*e*. In this manner, the air flow control unit 20 is held in the recess 10*e* while being pressurized.

In the above case, the first engaging portion engages the first engaged portion, and the second engaging portion engages the second engaged portion, whereby the engagement portion, or the fit portion, is formed. However, of course, the fit portion may be composed of one engaging portion and one engaged portion engageable therewith so long as the fit portion has a function of substantially preventing the disconnection and rotation of the cap 50. Moreover, in the above case, the first engaging portion 50*f* is formed above the second engaging portion 50*g*. However, of course, the first engaging portion 50*f* can be formed below the second engaging portion 50*g*. In addition, in the above case, the engaging portion is formed in the circumferential portion 50*b*, and the engaged portion is formed in the recess 10*e*. The engaging portion may be formed in the recess 10*e*, and the engaged portion is formed in the circumferential portion 50*b*.

Figure 11:
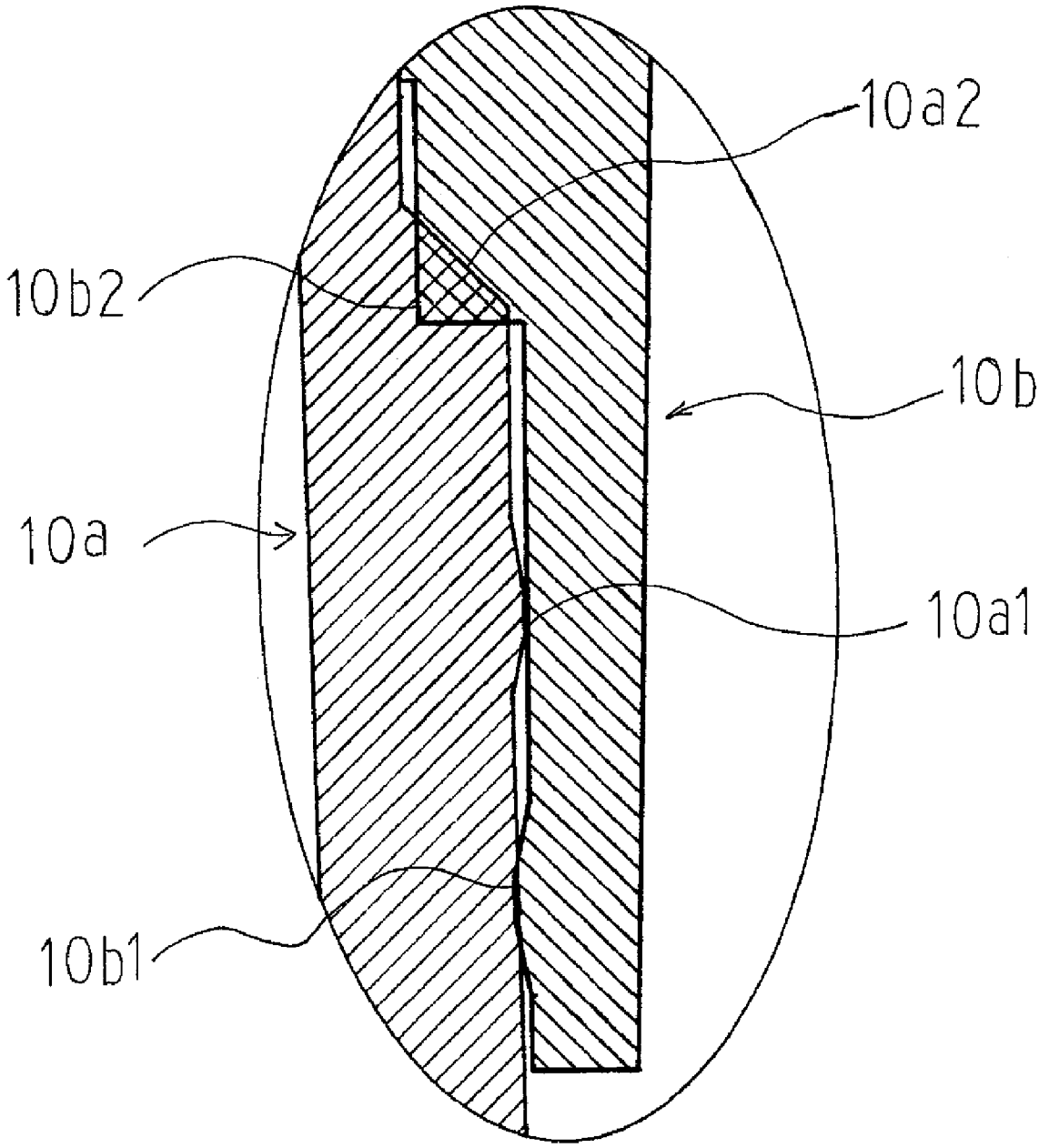
FIG. 11 is an enlarged cross-sectional view of a main part in portion B in FIG. 5.

As shown in the portion B in FIG. 5, the upper surface portion 10*b* in which the air flow control unit 20 is installed is fitted and secured to the main body 10*a*. Specifically, as shown in FIG. 11 (an enlarged view of the portion B), the upper surface portion 10*b* is secured to the main body 10*a* by fitting a bulged portion 10*b*1 formed in the upper surface portion 10*b* and a bulged portion 10*a*1 formed in the main body 10*a* to respective mating portions. As shown by the cross-hatched portion, a protruding portion 10*b*2 formed over the entire circumference of the upper surface portion 10*b* is engaged in an inclined portion formed over the entire circumference of the main body 10*a*, whereby a seal for preventing the ink from leaking is formed.

Figure 12:
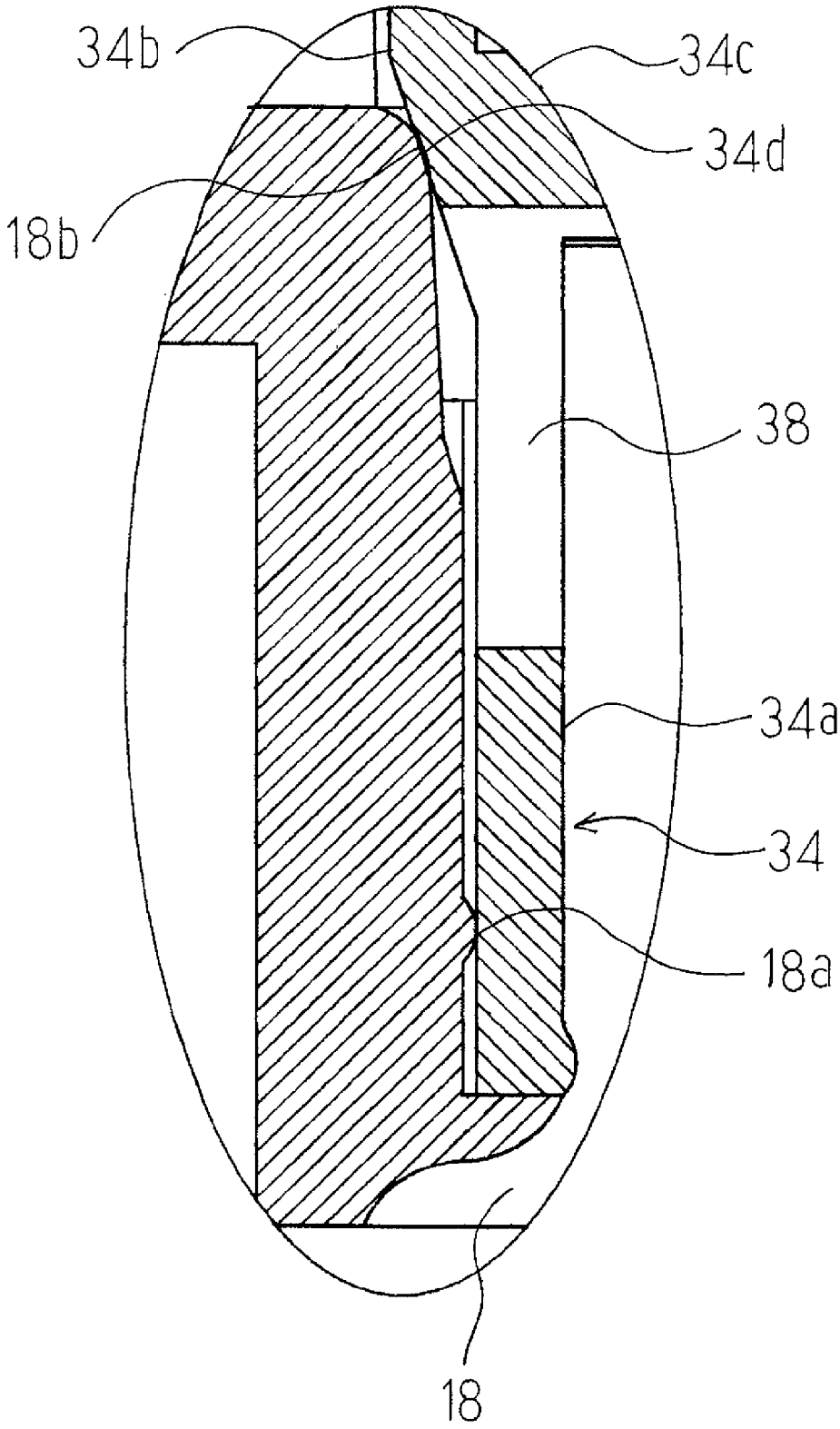
FIG. 12 is an enlarged cross-sectional view of a main part in portion C in FIG. 5.

Next, the ink ejection unit 30 is described with reference to FIGS. 5 and 12. Note that the pressure-contacting body 32 is not shown in FIG. 12. The ink ejection unit 30 in the present embodiment is configured to have substantially the same function as that of the ink ejection unit 30 in the first embodiment. Specifically, an ejection hole 18 having a circular horizontal cross-section is formed in the bottom surface 16 so as to protrude therefrom, and a moving valve 34 capable of moving vertically is contained in the ejection hole 18. The moving valve 34 includes a lower valve portion 34*a* having a smaller diameter and an upper valve portion 34*b* having a larger diameter, and the pressure-contacting body 32 is contained in the lower valve portion 34*a* so as to be integrated with the lower valve portion 34*a* as shown by the hatched portion in FIG. 12. The pressure-contacting body 32 is formed of a known material that allows the ink to pass therethrough. A guiding portion 16*a* having a slit is erected on the bottom surface 16 so as to be located outside the upper valve portion 34*b*. In this manner, the moving valve 34 integrated with the pressure-contacting body 32 is guided by the ejection hole 18 and the guiding portion 16*a* so as to be movable in the vertical direction.

A protruding portion 18*a* is provided on the inner circumference of the ejection hole 18 and comes in pressure contact with the moving valve 34. The moving valve 34 has an inclined surface 34*d* formed on the outer surface of an intermediate wall 34*c* thereof, i.e., along the circumferential boundary between the lower valve portion 34*a* and the upper valve portion 34*b*, and the inclined surface 34*d* abuts against a seal portion 18*b* of the ejection hole 18. A through hole 38 is provided in the lower valve portion 34*a*, so that the inner space 11 and the pressure-contacting body 32 are brought into communication with each other when the moving valve 34 is raised.

A coil spring 60 is provided between the upper surface portion 10*b* and the intermediate wall 34*c* of the moving valve 34. The coil spring 60 is disposed in a compressed state and always urges the moving valve 34 downwardly.

When the ink storage container 100 is not being attached to the carriage of an ink-jet printer (not shown), the moving valve 34 is pressed downward in the axial direction by the spring force of the coil spring 60, and the inclined surface 34*d* is brought into contact with the seal portion 18*b*, whereby the ink stored in the inner space 11 is prevented from leaking to the outside.

When the ink storage container 100 is being attached to the carriage of the ink-jet printer, the moving valve 34 is pressed upward against the spring force of the coil spring 60 by a corresponding contacting portion (not shown) of the carriage through the pressure-contacting body 32. Therefore, the moving valve 34 integrated with the pressure-contacting body 32 is moved upward while guided by the guiding portion 16*a* and the protruding portion 18*a*, so that the through holes 38 and the inner space 11 are brought into communication with each other. In this manner, the ink in the ink storage container 100 is supplied to the ink-jet printer through the pressure-contacting body 32.

In the technology described in the previous Japanese Patent Application Laid-Open No. 2001-277777, a cap is secured to a recessed portion by ultrasonic welding, and a valve corresponding to the air flow control unit in the second embodiment is contained in the recessed portion and is thereby secured therein. In the second embodiment, in contrast to the above technology, the air flow control unit 20 can be contained in the recess 10*e* by using a simple structure, i.e., by simply placing the cap 50. Therefore, the valve element 22 is prevented from deterioration due to thermal load. In other words, the air flow control function that must be provided in the air flow control unit 20 is prevented from being impaired.

In the second embodiment, the Teflon membrane 24 is disposed below the pressing ring 26, and the valve element 22 is thereby prevented from being directly exposed to the ink in the ventilation hole 14. Therefore, advantageously, the adhesion of the ink to the valve element 22 can be effectively prevented.

Moreover, in the second embodiment, the cap 50 is pressed into the recess 10*e* while the circumferential portion 50*b* is deformed with the hinge portion P serving as a fixed point. Therefore, the cap 50 can be secured in position without applying unnecessary external force to the valve element 22. In addition, since the cap is mechanically secured, the valve element 22 does not receive a thermal load caused by ultrasonic welding or the like. Therefore, the valve element 22 can be secured without any loss of the air flow control function of the valve element 22, and advantageously the ink storage container 100 can be produced at low cost.

After being secured with the cap 50, the air flow control unit 20 is pressed between the cap 50 and the bottom portion 10*f*. Therefore, even when the external shape of the valve element 22 is distorted, the pressure applied to the Teflon membrane 24 is made uniform through the pressing ring 26, so that a very good contact condition can be obtained and maintained. Advantageously, the ink can be efficiently prevented from infiltrating into the contact surface between the Teflon membrane 24 and the bottom portion 10*f* and into the contact surface between the Teflon membrane 24 and the pressing ring 26.

In the second embodiment, even if the infiltration of the ink occurs through the contact surface between the Teflon membrane 24 and the pressing ring 26, the air layer (gap layer) 29 formed by the through hole 26*a* of the pressing ring 26 advantageously prevents adhesion of the ink to the lower surface of the valve element 22. Therefore, the clogging of the very fine pores caused by the adhesion of the ink to the valve element 22 can be prevented, and therefore the air flow control function of the air flow control unit 20 that is provided by the valve element 22 can be maintained.

Moreover, since the pressing ring 26 is formed of a metal, the upper and lower surfaces thereof have improved smoothness. In addition, since the smooth surface is also formed on the Teflon membrane-placing portion 10*i*, the contact condition of each of the upper and lower contact surfaces of the Teflon membrane with the corresponding contacting member is improved. Therefore, advantageously, the infiltration of the ink through the gap between the Teflon membrane 24 and the Teflon membrane-placing portion 10*i* can be prevented.

In the second embodiment, the Teflon membrane-placing portion 10*i* and the valve element-placing portion 50*c* are disposed so as to face each other, and each of the placing portions is formed as an annular dent. Therefore, the air flow control unit 20 (the Teflon membrane, pressuring ring, and valve element) can be incorporated into the recess 10*e* without positional displacement, and this leads to the practical effect that the assembling work can be easily performed.

Since the lower end portion of the circumferential portion 50*b* of the cap 50 is formed so as to be capable of abutting against the lower edge-receiving portion 10*j*, the lower end portion functions as a stopper. Therefore, even when the cap 50 is excessively pressed into the recess 10*e*, the stopper function prevents the valve element 22 from being excessively compressed or from undergoing tensile deformation, and the air flow control function of the valve element 22 can be prevented from being impaired.

In the second embodiment, three ventilation holes 50*d* are provided in the valve element-placing portion 50*c*. Therefore, if the ink accidentally adheres to the ceiling portion 50*a* through the hand of a user and one of the ventilation holes 50*d* is clogged with the ink, the rest of the ventilation holes 50*d* advantageously ensure the air permeability.

Moreover, in the second embodiment, the fit between the first engaging portion 50*f* and the first engaged portion 10*l* prevents the cap 50 from coming off in the axial direction, and the fit between the second engaging portion 50*g* and the second engaged portion 10*m* prevents the cap 50 from rotating in the circumferential direction. In this manner, the cap 50 ensures that the valve element 22 is contained in the recess 10*e* without positional displacement. Therefore, the initial pressurized installation state of the valve element 22 can be stably maintained, and a reduction in the air flow control function can thereby be prevented.

While the present invention has been described based on the first and second embodiments, the invention is not limited thereto, and modifications and changes made without departing from the gist of the invention fall within the scope of the invention.

Figure 13:
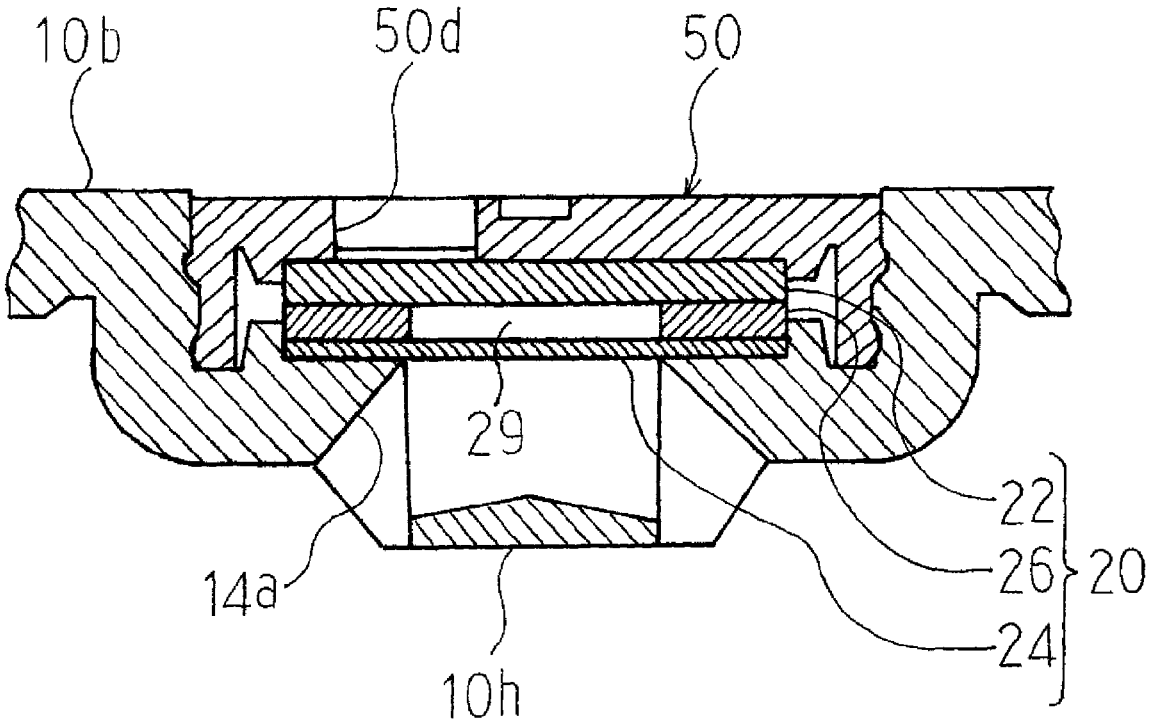
FIG. 13 is a cross-sectional view of an air flow control unit, and the vicinity thereof, in a modified embodiment of the second embodiment.

FIG. 13 shows a modified embodiment. For example, a conically tapered surface 14*a* tapered upwardly may be formed in the ventilation hole 14, as shown in FIG. 13. In this case, the tapered surface 14*a* may have a suitable number of grooves formed along the circumferential or generatrix direction thereof. Moreover, it is preferable to subject at least the tapered surface 14*a* to liquid repellent treatment. In such a case, the ink adhering to the lower surface of the Teflon membrane 24 and the tapered surface 14*a* can be effectively dropped.

Figure 14:
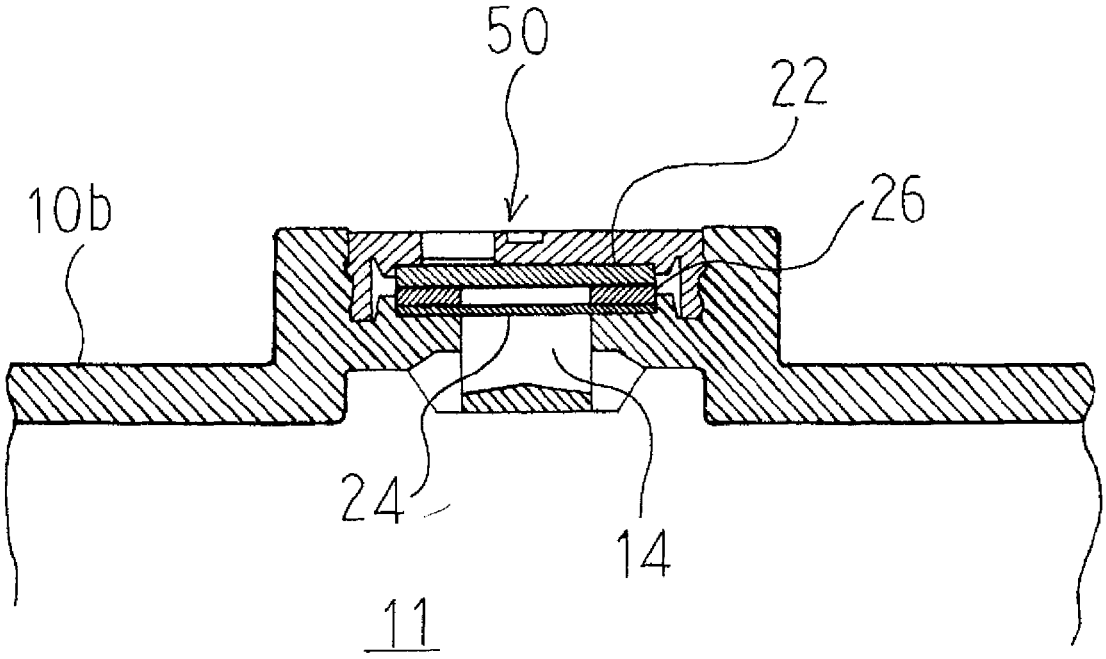
FIG. 14 is a cross-sectional view of an air flow control unit, and the vicinity thereof, in another modified embodiment of the second embodiment.

In the second embodiment and the modified embodiment thereof, the recess 10*e* is formed so as to be recessed from the upper surface portion 10*b*. FIG. 14 shows another modified embodiment. As shown in FIG. 14, the air flow control unit 20 may be contained in a protruding portion 70 protruding upward from the upper surface portion 10*b*. Moreover, in the second embodiment, the buffering portion 10*h* is provided near the ventilation hole 14, but the invention is not limited thereto. Of course, the buffering portion 10*h* may not be provided.

Figure 15:
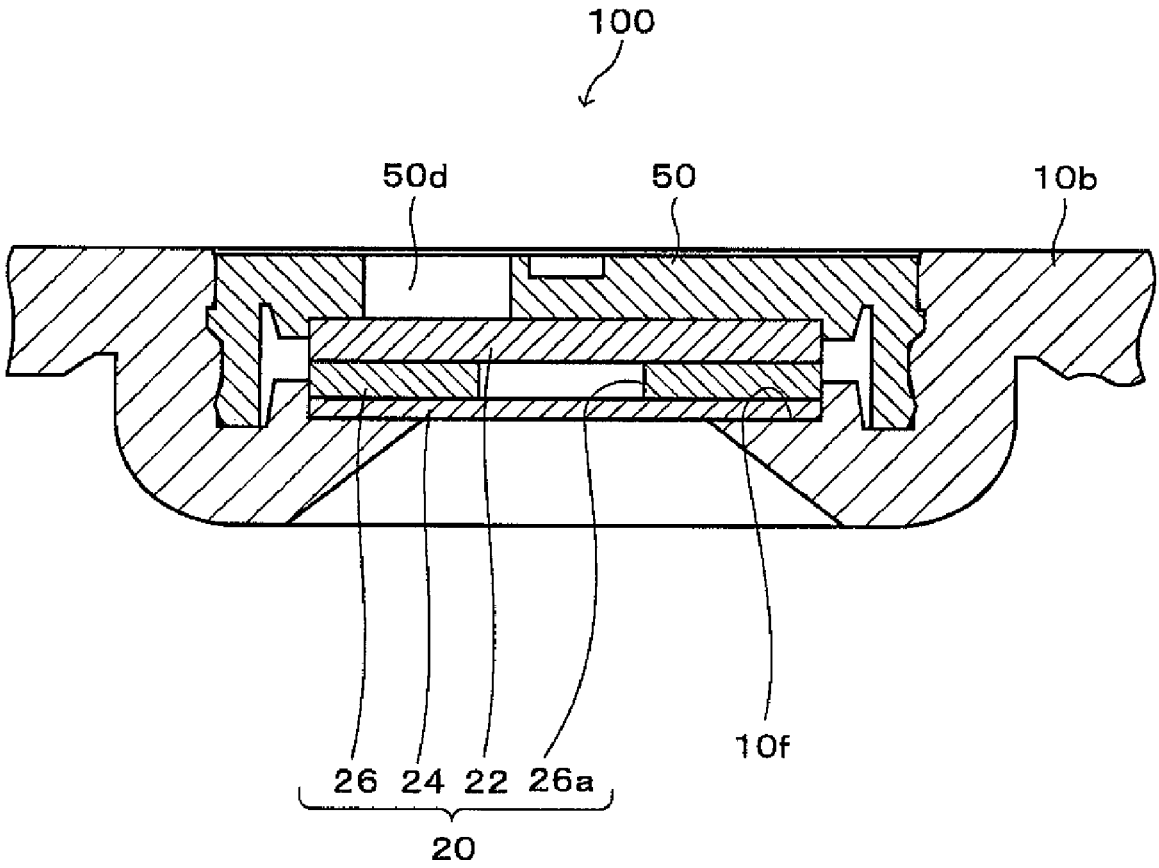
FIG. 15 is an enlarged cross-sectional view of a part of an ink storage container according to a third embodiment of the present invention.

Next, a description is given of a third embodiment of the present invention with reference to FIG. 15. Components the same as or equivalent to those of the second embodiment are designated by the same reference numerals used in the second embodiment, and components different from those of the second embodiments are mainly described.

The air flow control unit 20 includes: a disk-like Teflon membrane 24; an annular (washer-like) pressing ring 26 placed on the upper surface of the Teflon membrane 24; and a valve element 22 placed on the upper surface of the pressing ring 26. The disk-like Teflon membrane 24 has air permeability and has been subjected to liquid repellent treatment. The pressing ring 26 has flat upper and lower surfaces and has a through hole 26*a* in the central portion thereof. The above components 24, 26, and 22 are stacked in that order from the bottom, whereby the air flow control unit 20 is formed.

Figure 16:
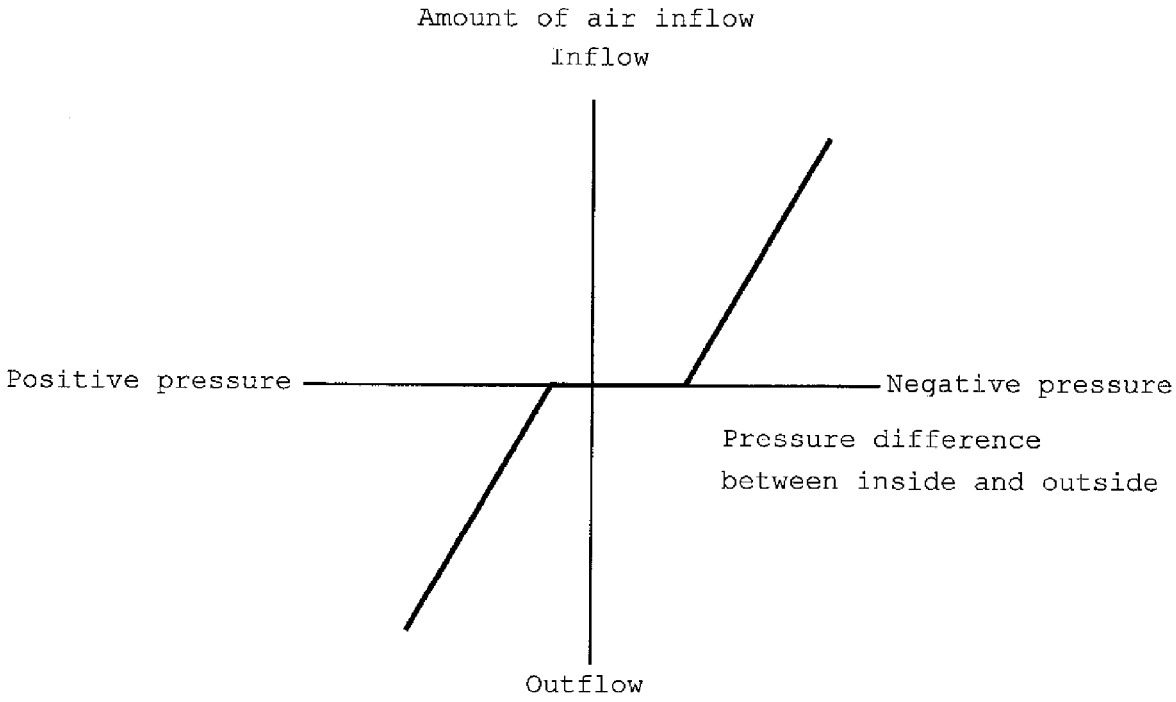
FIG. 16 is a graph showing the relationship between the pressure difference between the inside and outside to the ink storage container and the amount of air exchange.

In the third embodiment, the pressing ring 26 is disposed so as to abut against the ink side (lower side) of the valve element 22, and the area of the through hole 26*a* of the pressing ring 26 is set smaller than the area of the communication region of the valve element 22 that is in communication with the side opposite to the ink side (on the upper side), i.e., three ventilation holes 50*d* formed in the cap 50. In the above configuration, the area of the ventilation holes 26*d*, which is the communication region on the lower side of the valve element 22 is smaller than the area of the communication region on the upper side of the valve element 22. Therefore, the valve element 22 is not easily deformed elastically toward the ink side (the inner side of the container) but is easily deformed toward the side opposite to the ink side (the outer side of the container). Since the extent of the elastic deformation is asymmetric as described above, the flow of air from the inner side to the outer side of the container (the outflow of air) can be facilitated, and the flow of air from the outer side to the inner side of the container (the inflow of air) can be suppressed, as shown in FIG. 16, so that the pressure inside the ink storage unit can be further reduced.

Figure 17:
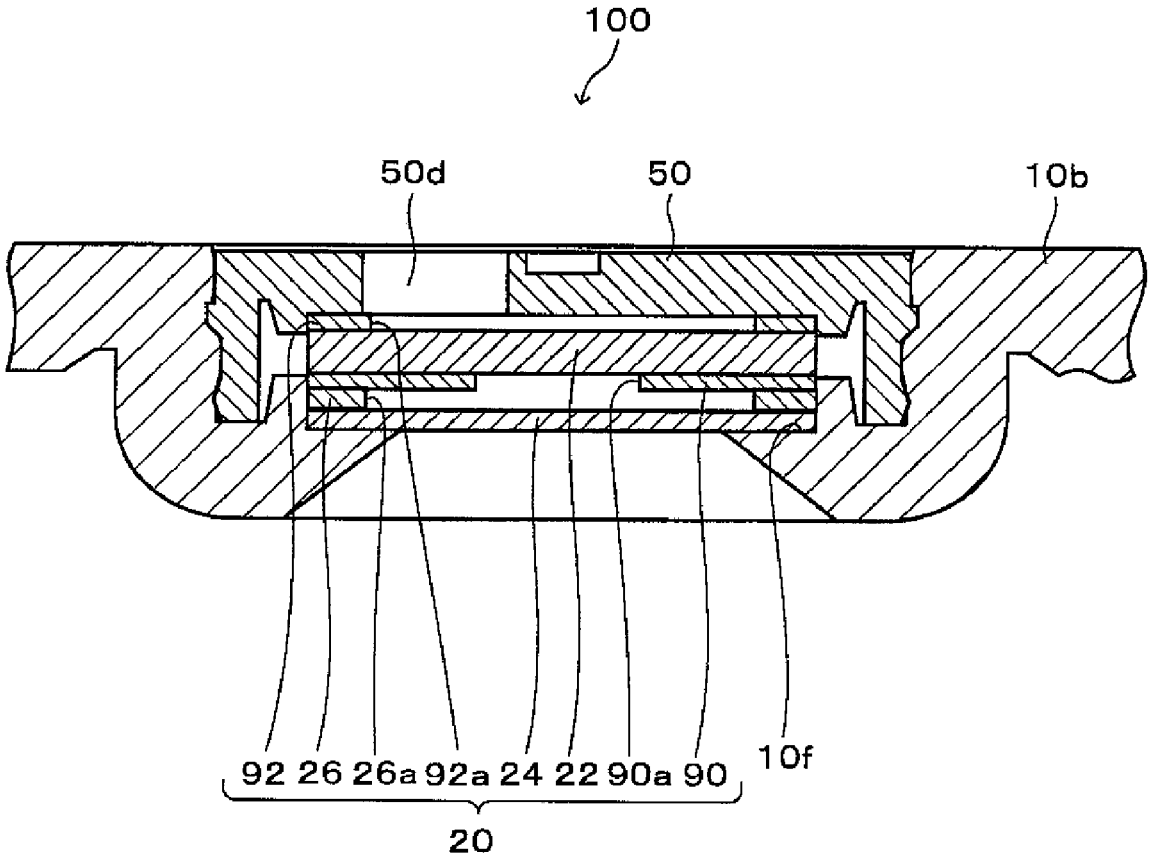
FIG. 17 is a cross-sectional view of a modified embodiment of the third embodiment.

In this embodiment, the pressing ring 26 is effectively used. Specifically, the size of the through holes 26*d* is reduced, whereby the amount of air exchange is made asymmetric with respect to the pressure difference between the inside and outside. However, the present invention is not limited to this configuration. For example, as shown in FIG. 17, an annular lower-side support ring 90 may be inserted between the valve element 22 and the pressing ring 26, and an upper-side support ring 92 may be inserted between the valve element 22 and the cap 50. When a communication hole 90*a* of the lower-side support ring 90 is formed so as to have an area smaller than the area of a communication hole 92*a* of the upper-side support ring 92, the valve element 22 can have vertically asymmetric elastically deformable areas. Also in this manner, the inside of the ink storage unit can be held at lower pressures.

Next, a fourth embodiment of the present invention is described with reference to FIGS. 18 to 20. Components the same as or equivalent to those of the first embodiment are designated by the same reference numerals used in the first embodiment, and components different from those of the first and second embodiments are mainly described.

Figure 18:
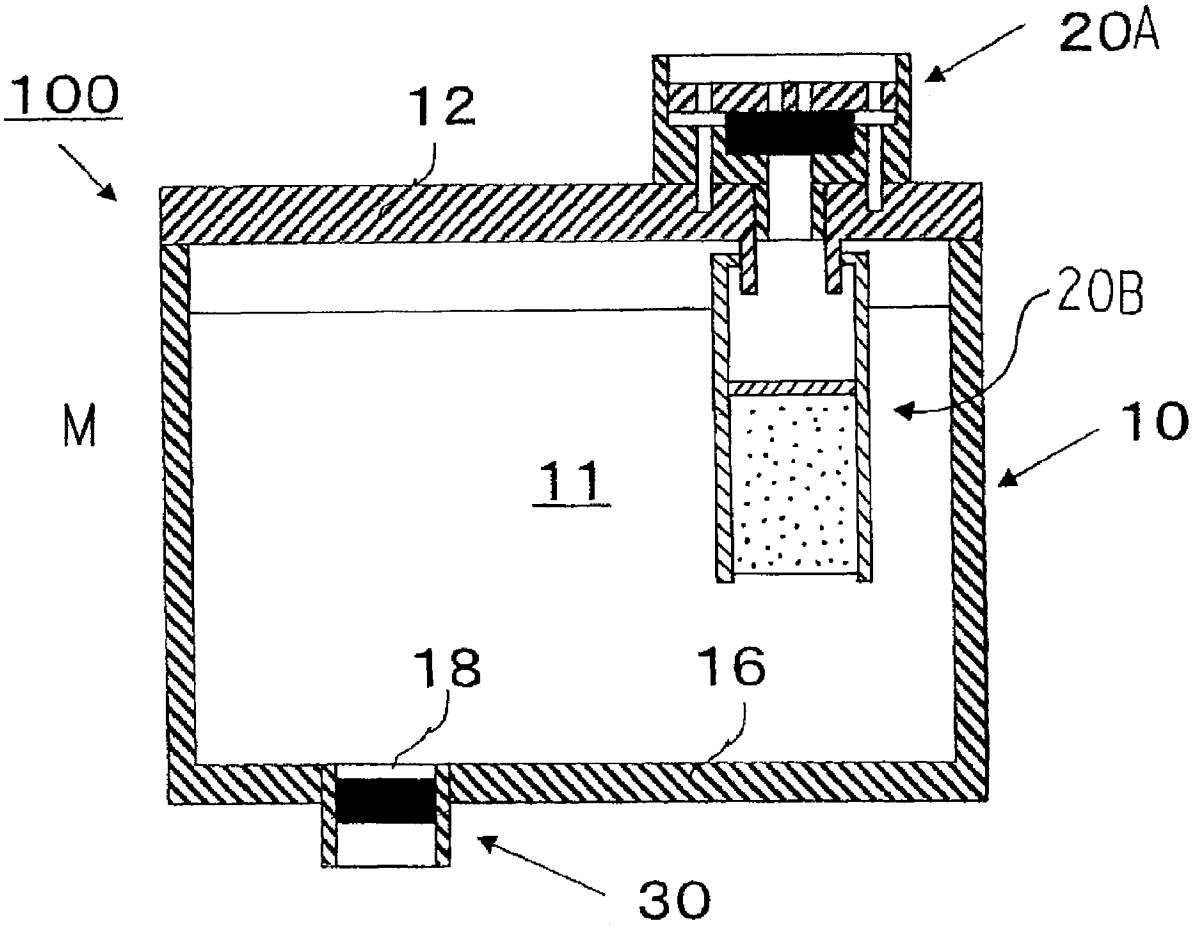
FIG. 18 is a schematic cross-sectional view of an ink storage container of a fourth embodiment of the present invention.

FIG. 18 is a schematic cross-sectional view illustrating the general structure of an ink storage container 100 of the fourth embodiment, which is an ink cartridge of an ink-jet printer. An air flow control unit 20A for controlling the air flow between the inside and outside of the ink storage unit 10 is provided in an upper surface portion 12 of the ink storage container 100. Moreover, an ink utilization valve 20B in communication with the air flow control unit 20A is disposed below the air flow control unit 20A.

Figure 19:
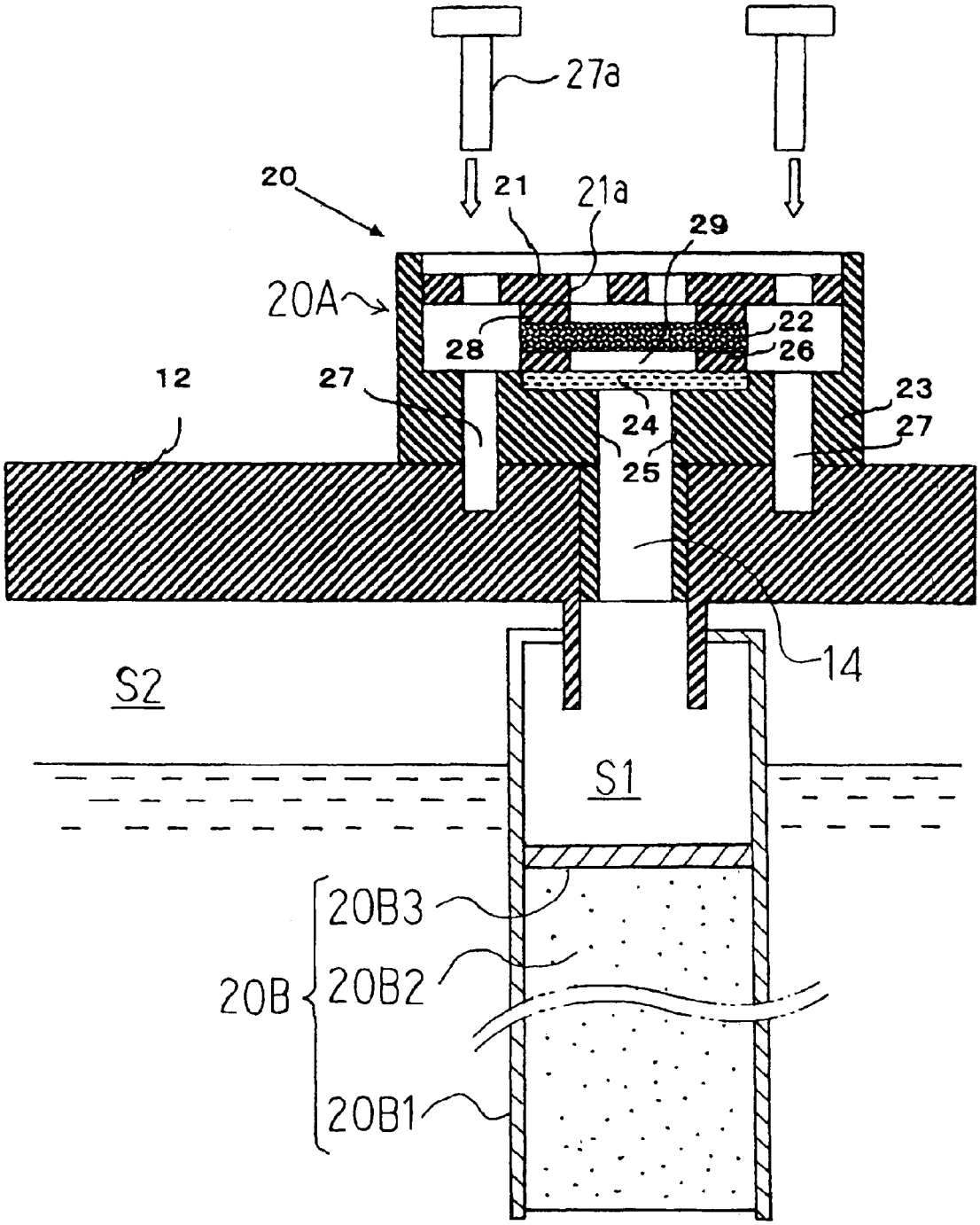
FIG. 19 is a schematic cross-sectional view of an air flow control unit, and the vicinity thereof, of the ink storage container.
Figure 20:
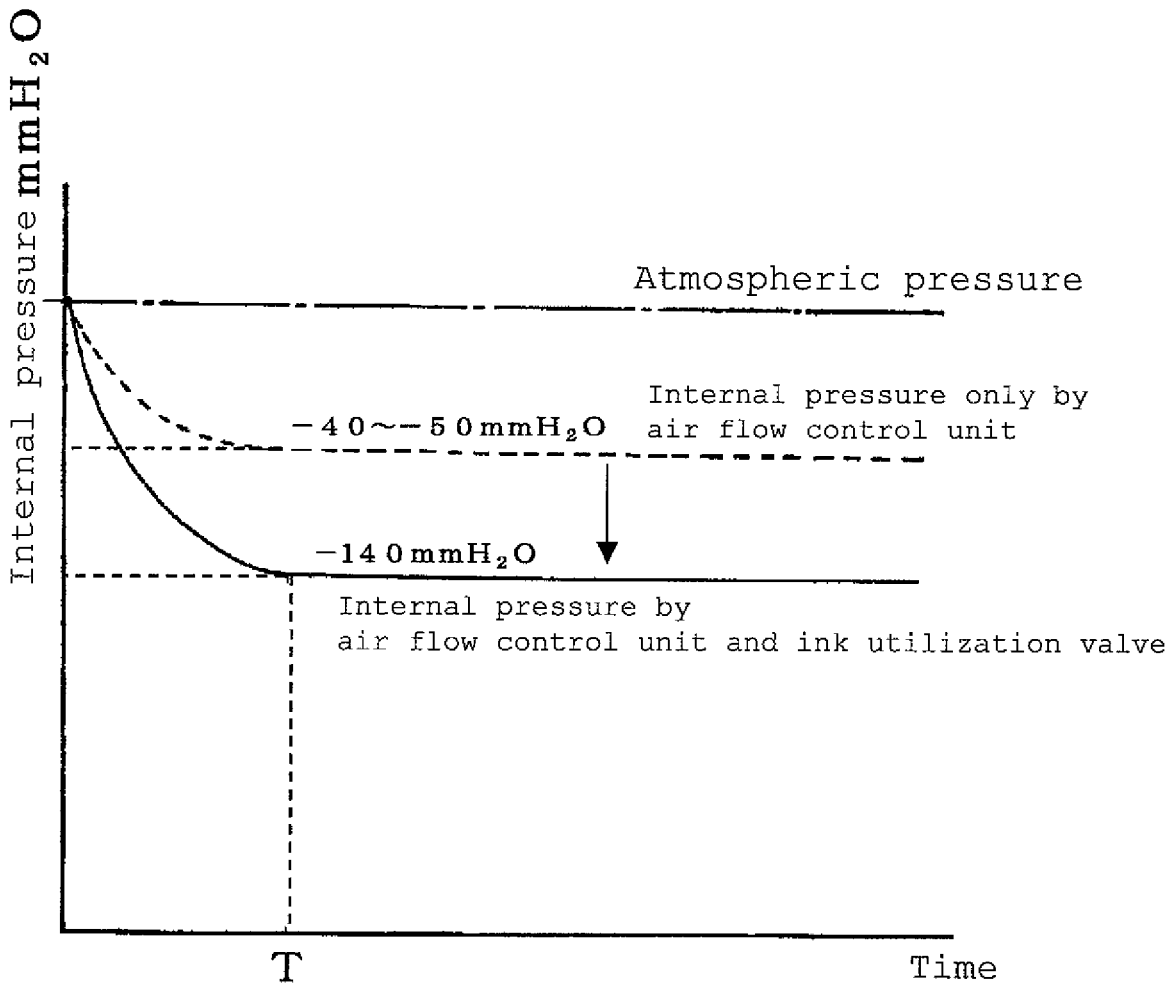
FIG. 20 is a graph showing the relation between the negative pressure inside the ink storage unit and the elapsed time.

As shown in FIG. 19, the ink utilization valve 20B includes an ink absorbing body 20B2 that does not allow air to pass therethrough under normal conditions but allows air to be exchanged between the outside and the ink storage unit 10 according to a change in the internal pressure of the ink storage unit 10. Therefore, the ink utilization valve 20B is brought into communication with the air flow control unit 20A and has a function of controlling the amount of air flow by increasing the resistance to air flow into the ink storage unit 10 according to the amount of the absorbed ink stored in the ink storage unit 10. More specifically, the ink utilization valve 20B includes: a retaining portion 20B1 suspended downwardly from the inner side of the upper surface portion 12; the ink absorbing body 20B2 disposed in the retaining portion 20B1; and a liquid repellent membrane 20B3 placed above the ink absorbing body 20B2. The retaining portion 20B1 is in communication with the air flow control unit 20A. More specifically, the retaining portion 20B1 is in communication with the air flow control unit 20A while a portion directly below the ventilation hole 14 is maintained in a hermetically sealed state.

The retaining portion 20B1 is, for example, a cylindrical body having a closed upper end and an open lower end, has a predetermined vertical length, and is immersed in ink M.

The ink absorbing body 20B2 is formed of a material, such as urethane or felt, having a function of absorbing the ink M. Specifically, a porous body containing a large number of fine pores is formed by compressing such a material. These fine pores are in communication with each other, and the function of absorbing the ink M is obtained by utilizing the capillarity of the ink M. Air passes through the ink absorbing body 20B2, and air bubbles flow into the ink storage unit 10 from the lower end of the retaining portion 20B1. The ink absorbing body 20B2 accordingly absorbs the ink M and is impregnated with the ink M. The ink absorbing body 20B2 is formed such that the resistance to air flow from the air flow control unit 20A, i.e., the air flow resistance, increases according to an increases in the amount of absorbed ink.

The liquid repellent membrane 20B3 is a flat circular sheet formed of PTFE that is substantially the same material as that for the ink proof membrane 24 used in the air flow control unit 20A. Specifically, the liquid repellent membrane 20B3 is a membrane for preventing the contact of the ink, and any material having air permeability can be used therefor. In order to obtain good air permeability, the liquid repellent membrane 20B3 has a plurality of interconnected pores. The liquid repellent membrane 20B3 prevents an excessive increase of the ink level when the ink absorbing body 20B2 is saturated with the absorbed ink.

An air layer S1 intervenes between the liquid repellent membrane 20B3 and the air flow control unit 20A.

When the ink storage container 100 is being attached for use to the carriage of a printer, the air flow control unit 20A and the ink utilization valve 20B generate a negative pressure of about −40 $mmH_2O$ in the air layer S1, and a negative pressure of about −140 $mmH_2O$ is generated in space S2 (see FIG. 19), whereby the air flow can be controlled.

As described above, in the fourth embodiment, when the ejection hole 18 is attached to the supply hole of an ink-jet printer to start the use of the ink storage container 100, the internal pressure of the air layer S1 reaches about −40 $mmH_2O$ and the internal pressure of the space S2 reaches about −140 $mmH_2O$ after a predetermined time elapses. Therefore, a good pressure balance with the external pressure can be obtained.

In the fourth embodiment, when the ink storage container 100 is attached for use to an ink-jet printer, a predetermined amount of the ink M is ejected from the ejection hole 18. The level of the ink M decreases accordingly, and outside air flows into the ink storage unit 10 through the air flow control unit 20A and the ink utilization valve 20B. Specifically, the air passes through the air flow control unit 20A and flows into the ink storage unit 10 by way of the ink absorbing body 20B2. Therefore, as shown in FIG. 20, after an initial time period T elapses, the negative pressure inside the space S2 of the ink storage unit 10 is stabilized. In other words, the internal pressure of the air layer S1 is about −40 $mmH_2O$ and the internal pressure of the space S2 is about −140 $mmH_2O$, so that a good pressure balance with outside air is obtained.

In the fourth embodiment, the ink absorbing body 20B2 in the ink utilization valve 20B is additionally provided as negative pressure control means, i.e., means for proving the function of controlling the air flow by increasing the air flow resistance, so that the negative pressure inside the ink storage unit 10 can be increased. Therefore, the ink can be prevented from excessively ejected from the ink ejection hole 18, and therefore the consumption of the ink can be effectively reduced.

In addition, in the fourth embodiment, the liquid repellent membrane 20B3 is disposed above the ink absorbing body 20B2. Therefore, an excessive increase in the ink level can be effectively prevented when the ink absorbing body 20B2 is saturated with the absorbed ink.

Figure 21:
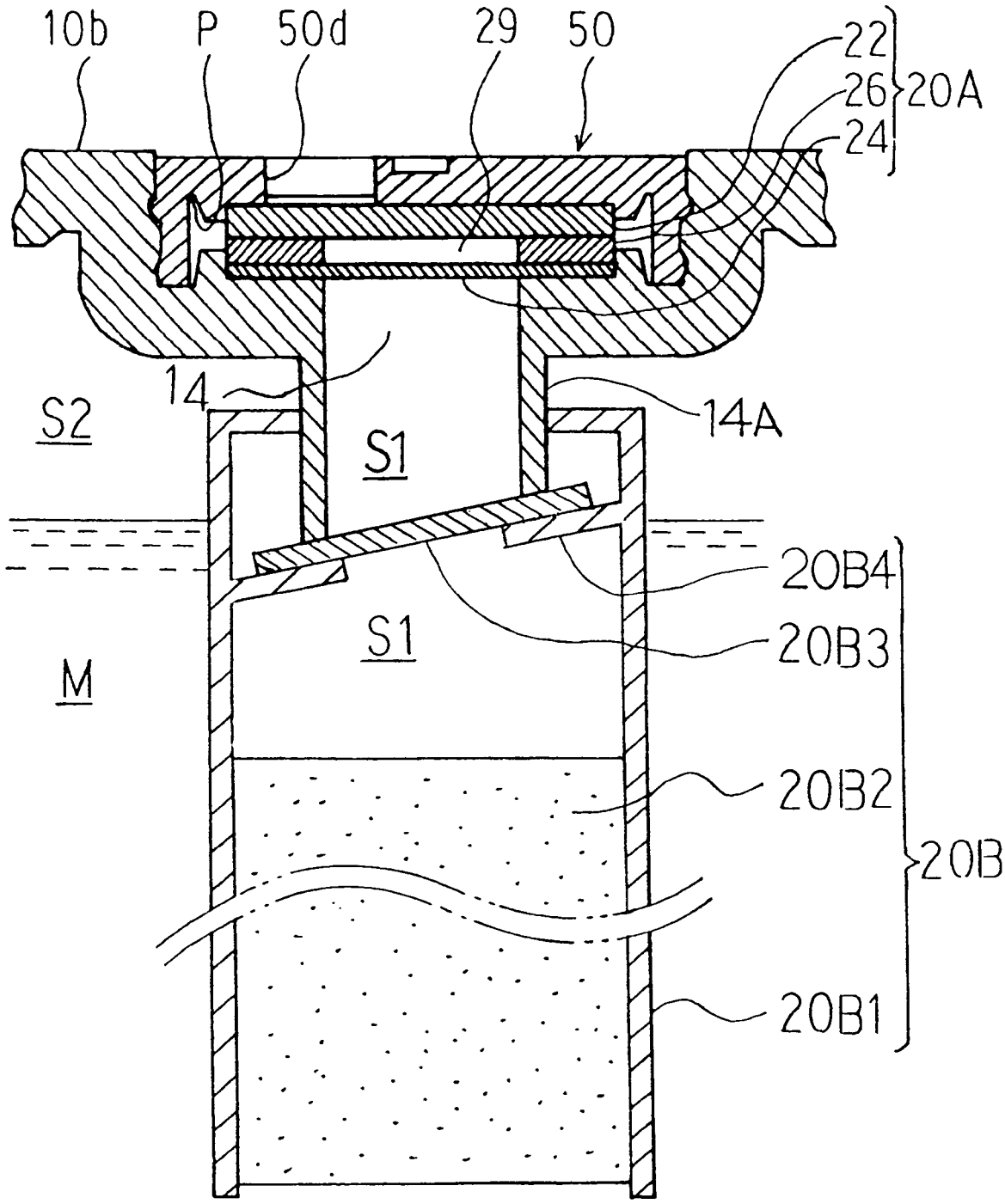
FIG. 21 is an enlarged cross-sectional view of a part of an ink storage container of a fifth embodiment of the present invention.

Next, a fifth embodiment of the present invention is described with reference to FIG. 21. In the present embodiment, components the same as or equivalent to those of the fourth embodiment, except for important components in the present embodiment, are designated by the same reference numerals used in the fourth embodiment, and the description thereof will be omitted.

An ink utilization valve 20B of an ink storage container 100 in the present embodiment has substantially the same structure as that of the fourth embodiment. However, a different connection structure is used. Specifically, as shown in FIG. 21, the ink utilization valve 20B is disposed below the air flow control unit 20A so as to be in communication therewith and has a function of controlling the amount of air flow by increasing the resistance to air flow into the ink storage unit 10 according to the amount of the absorbed ink stored in the ink storage unit 10.

More specifically, a connection tube 14A for forming the ventilation hole 14 is formed below the air flow control unit 20A so as to extend from the lower portion of the air flow control unit 20A. The lower end of the connection tube 14A is inclined at a predetermined angle with respect to the horizontal. A tubular retaining portion 20B1 is coaxially connected to the connection tube 14A. In this manner, the ink utilization valve 20B is brought in communication with the air flow control unit 20A. More specifically, the ink utilization valve 20B is brought in communication with the air flow control unit 20A while a portion directly below the ventilation hole 14 is maintained in a hermetically sealed state. The lower end of the retaining portion 20B1 is immersed in the ink M.

An annular step portion 20B4 that can abut against the connection tube 14A is formed on the inner wall of the retaining portion 20B1. The step portion 20B4 is also inclined with respect to the horizontal. The step portion 20B4 has an annular shape because air must be allowed to pass through the inner portion of the annular shape. A liquid repellent membrane 20B3 is sandwiched between the connection tube 14A and the step portion 20B4. In this manner, the liquid repellent membrane 20B3 is properly secured.

The ink utilization valve 20B includes: the retaining portion 20B1 having the step portion 20B4 thereinside; the ink absorbing body 20B2 disposed in the retaining portion 20B1; and the liquid repellent membrane 20B3 placed above the ink absorbing body 20B2.

The ink absorbing body 20B2 is formed of a material, such as urethane or felt, having a function of absorbing the ink M. Specifically, a porous body containing a large number of fine pores is formed by compressing such a material. These fine pores are in communication with each other, and the function of absorbing the ink M is obtained by utilizing the capillarity of the ink M. Air passes through the ink absorbing body 20B2, and air bubbles flow into the ink storage unit 10 from the lower end of the retaining portion 20B1. The ink absorbing body 20B2 accordingly absorbs the ink M and is impregnated with the ink M. The ink absorbing body 20B2 is formed such that the resistance to air flow from the air flow control unit 20A, i.e., the air flow resistance, increases according to an increases in the amount of absorbed ink. The ink absorbing body 20B2 is not limited to the material mentioned above. Various materials can be used such as: fiber strands formed by bundling fibers, such as polyester fibers, acrylic fibers, nylon fibers, and polypropylene fibers, along their lengthwise direction; sintered bodies of polyethylene and the like; felt materials formed of natural fibers such as wool and rayon and of synthetic fibers such as polyester and polypropylene; and polyurethane foam (an interconnected foamed body of urethane).

The liquid repellent membrane 20B3 is formed of PTFE, which is substantially the same material as that for the ink proof membrane 24 used in the air flow control unit 20A, and is a flat circular sheet similar to the ink proof membrane 24 shown in FIG. 6. Specifically, the liquid repellent membrane 20B3 is a membrane for preventing the contact of the ink, and any material having air permeability can be used for the liquid repellent membrane 20B3. In order to obtain good air permeability, the liquid repellent membrane 20B3 has a plurality of interconnected pores. The liquid repellent membrane 20B3 can prevent the ink from reaching a level on the air flow control unit 20A side when the ink absorbing body 20B2 is saturated with the absorbed ink. The liquid repellent membrane 20B3 is inclined. Therefore, even when ink droplets adhere to the liquid repellent membrane 20B3, the ink droplets move in one direction along the inclined surface, and therefore the deterioration of the air permeability of the liquid repellent membrane 20B3 can be prevented. Moreover, an air layer S1 is provided between the liquid repellent membrane 20B3 and the air flow control unit 20A and between the liquid repellent membrane 20B3 and the ink absorbing body 20B2. Therefore, the deterioration of air permeability caused by an increase in the ink level can be further reduced.

Figure 22:
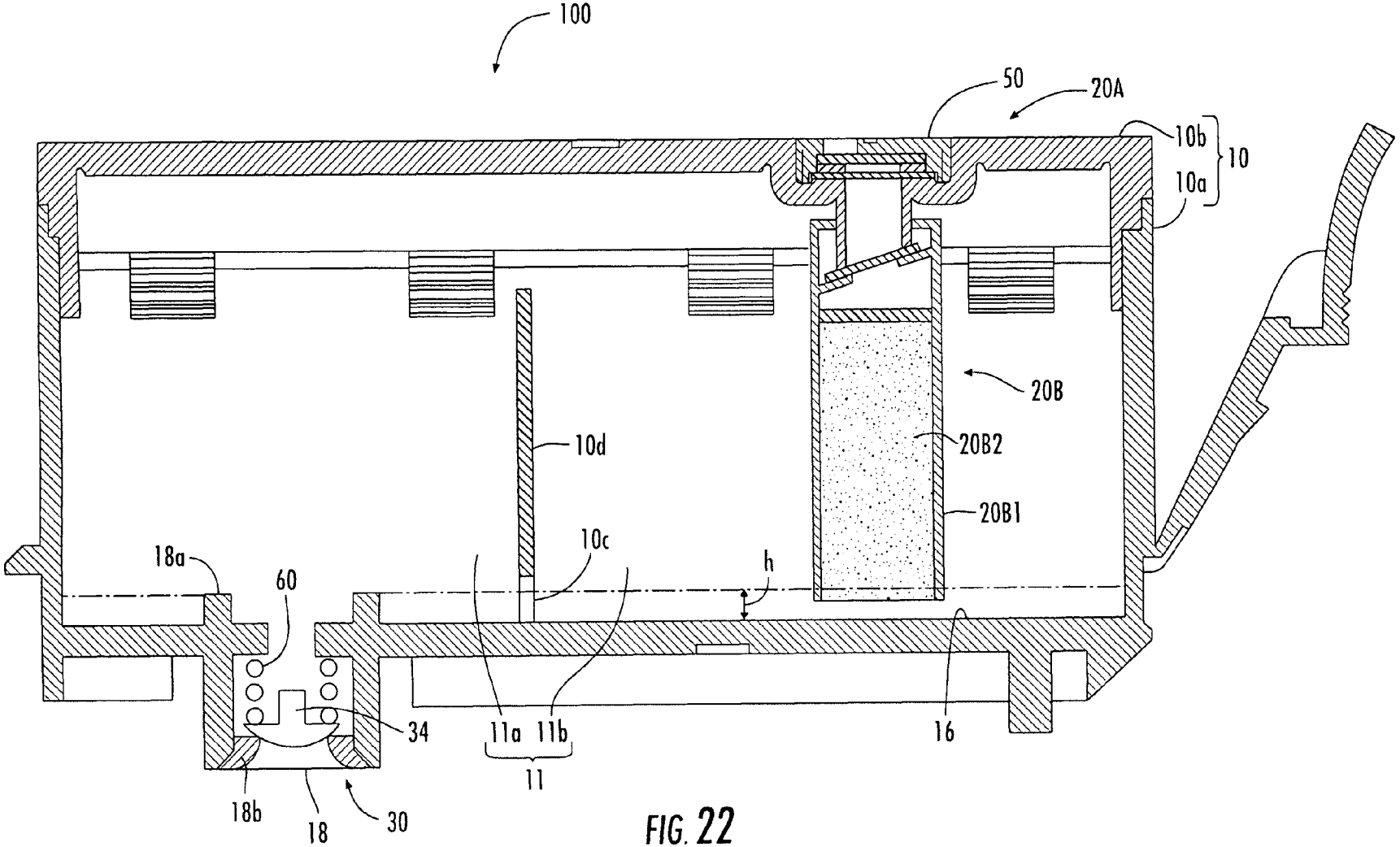
FIG. 22 is a vertical cross-sectional view of an ink storage container of a sixth embodiment of the present invention.

Next, a sixth embodiment of the present invention is described with reference to FIG. 22. In the present embodiment, components the same as or equivalent to those of the fifth embodiment, except for important components in the present embodiment, are designated by the same reference numerals used in the fifth embodiment, and the description thereof will be omitted.

An ink storage container 100 include a main body 10*a* formed of a suitable synthetic resin and an upper surface portion 10*b* fitted to the main body 10*a* to cover the main body 10*a*. The main body 10*a* and the upper surface portion 10*b* are connected through portion B. The shape of the ink storage container 100 is a rectangular parallelepiped having a width in the depth direction smaller than the height. Two chambers 11*a* and 11*b* separated by a partition wall 10*d* having a through hole 10*c* formed in its lower portion are provided in the inner space 11 of the ink storage container 100. An air flow control assembly 20 including an air flow control unit 20A and an ink utilization valve 20B described later is provided in portion A. An ink ejection unit 30 is provided in the bottom of the main body 10*a*.

The ink ejection unit 30 of this embodiment has an ejection hole 18 having a circular cross-section in the bottom surface 16 thereof, and a moving valve 34 movable in the vertical direction is contained in the ejection hole 18. A coil spring 60 is contained in the ejection hole 18 and urges the moving valve 34 downwardly (in an ejection direction).

An annular seal portion 18*b* formed of a rubber is secured to the lower end of the ejection hole 18. The moving valve 34 urged downward abuts against the seal portion 18*b*, so that the ink inside the ejection hole 18 is prevented from leaking when the ink storage container 100 is not in use. When the ink storage container 100 is set in the carriage of an ink-jet printer (not shown), the moving valve 34 is pressed upward against the urging force of the coil spring 60, and the ink is supplied to the ink-jet printer under a predetermined negative pressure.

Moreover, a bank portion 18*a* is formed on the bottom surface 16 of the ink ejection unit 30 so as to protruding inwardly from the bottom surface 16. The bank portion 18*a* is provided for ensuring a minimum level h in the container by retaining the ink in the container even when the ink in the ink ejection unit 30 has been exhausted. By ensuring the minimum level h, the negative pressure function of the ink utilization valve 20B described later can be maintained to the end.

The ink utilization valve 20B has substantially the same structure as that of the fifth embodiment but is different in length. Specifically, the ink utilization valve 20B is disposed below the air flow control unit 20A and is in communication therewith, but the lower end of the ink utilization valve 20B extends below the minimum level h. In other words, the lower end of the ink utilization valve 20B is lower than the upper end of the bank portion 18*a*.

Therefore, even when the amount of ink in the ink ejection hole 18 is reduced, the lower ends of the retaining portion 20B1 and the ink absorbing body 20B2 remain immersed in the ink, so that the negative pressure in the container can be maintained at a high level until the ink is completely ejected.

Figure 23:
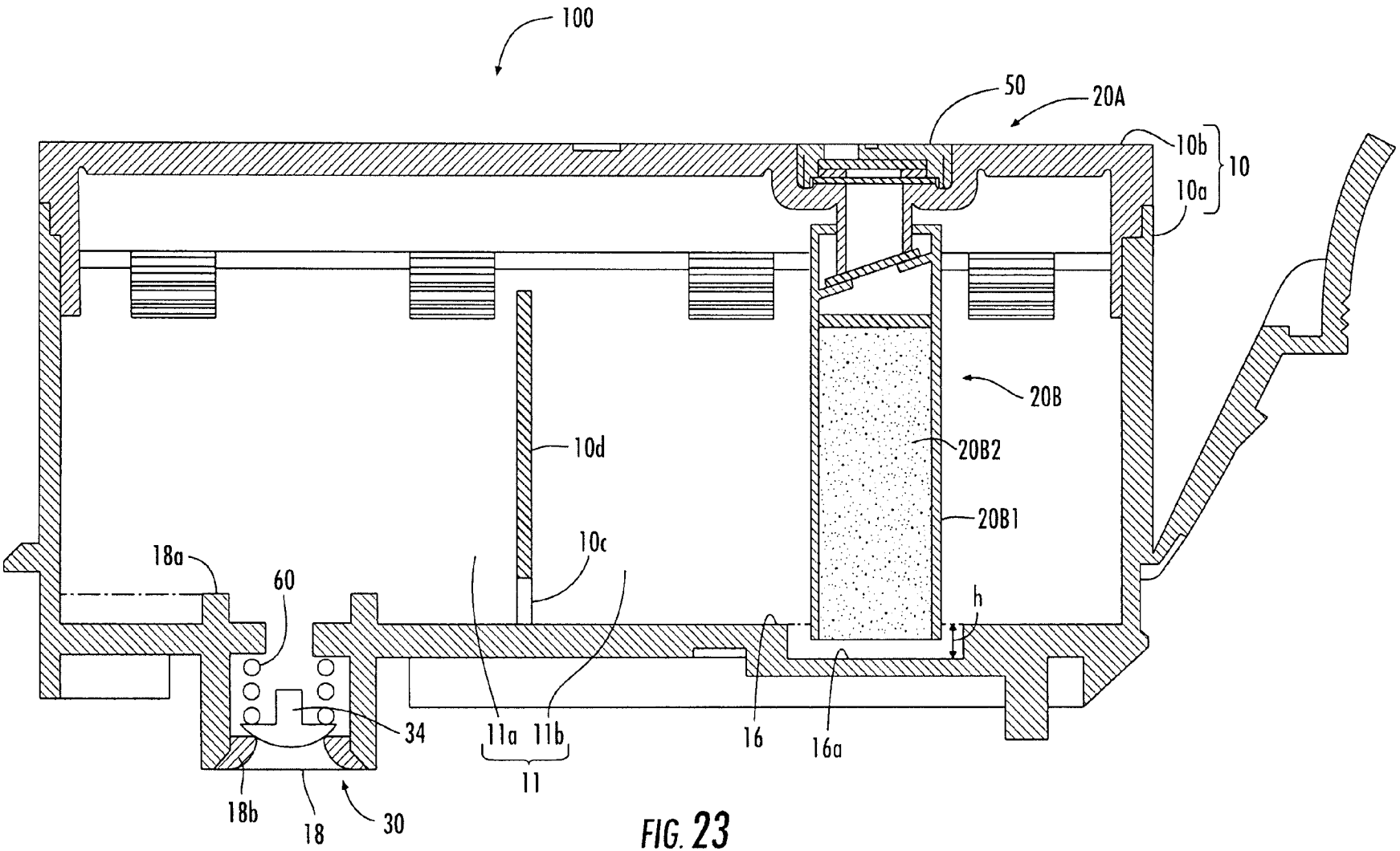
FIG. 23 is a vertical cross-sectional view of an ink storage container of a modified embodiment of the sixth embodiment.

In the sixth embodiment, the minimum level h is maintained by forming the inwardly protruding bank portion 18*a* on the bottom surface 16, but the invention is not limited thereto. For example, as shown in FIG. 23, an ink retaining recess 16*a* recessed outwardly (downwardly) from the bottom surface 16 may be formed. The ink retaining recess 16*a* is formed below the ink utilization valve 20B and may have a size capable of containing the lower end of the ink utilization valve 20B. In this case, the length of the ink utilization valve 20B is set such that the lower end thereof is contained in the ink retaining recess 16*a*. In this manner, the ink is retained in the ink retaining recess 16*a* even when the amount of the ink in the ink ejection unit 30 is reduced, so that the minimum level h can be partially maintained. Since the ink absorbing body 20B2 is immersed in the ink in the ink retaining recess 16*a* to the end, the negative pressure in the container can be maintained at a high level. Moreover, since the amount of the ink remaining to the end is less than that in the embodiment shown in FIG. 22, the ink can be effectively used.

While the present invention has been described based on the first to sixth embodiments, the invention is not limited thereto, and modifications and changes made without departing from the gist of the invention fall within the scope of the invention.

Figure 24:
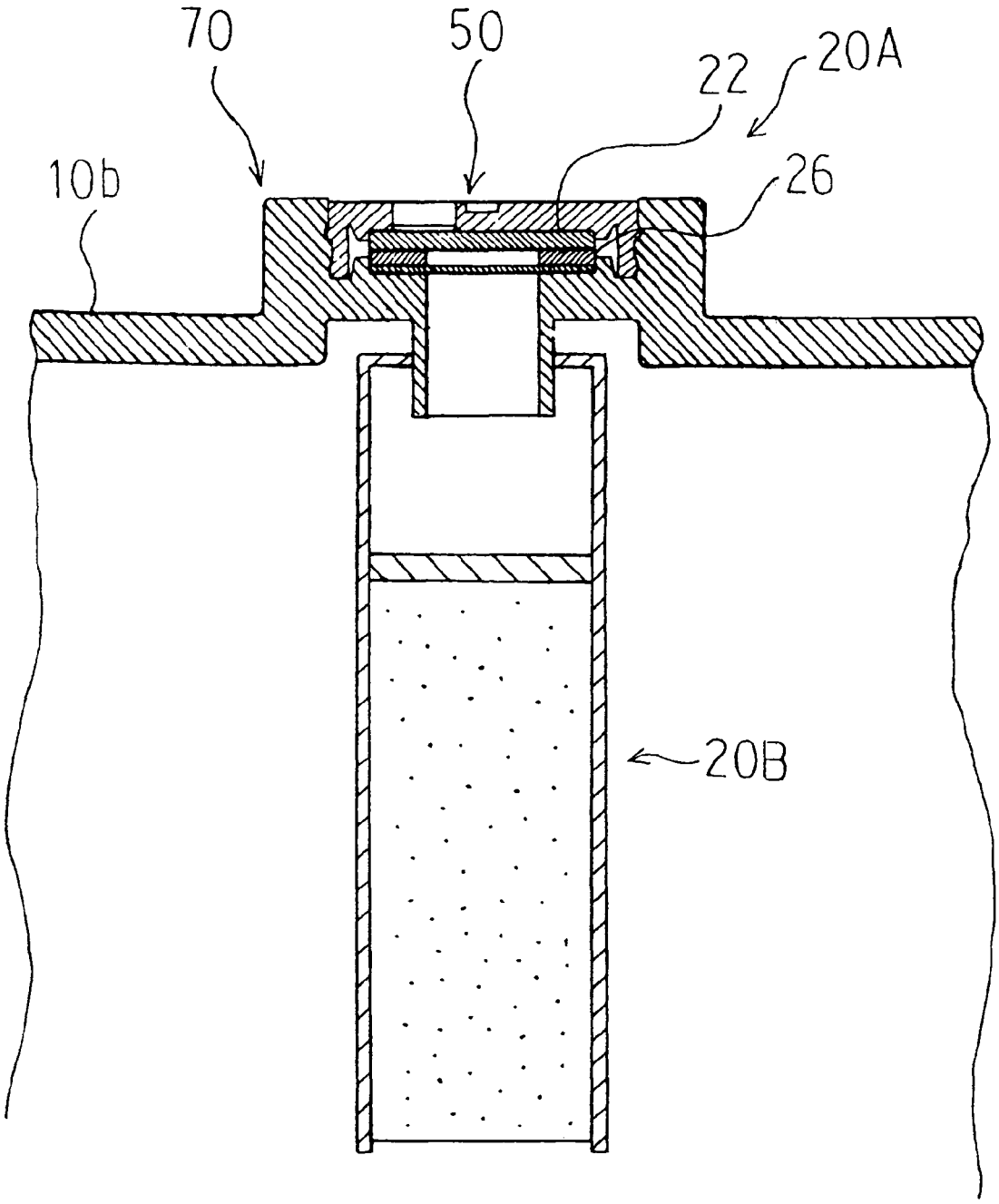
FIG. 24 is a partial cross-sectional view of an air flow control unit, and the vicinity thereof, in a modified embodiment of the present invention.
Figure 25:
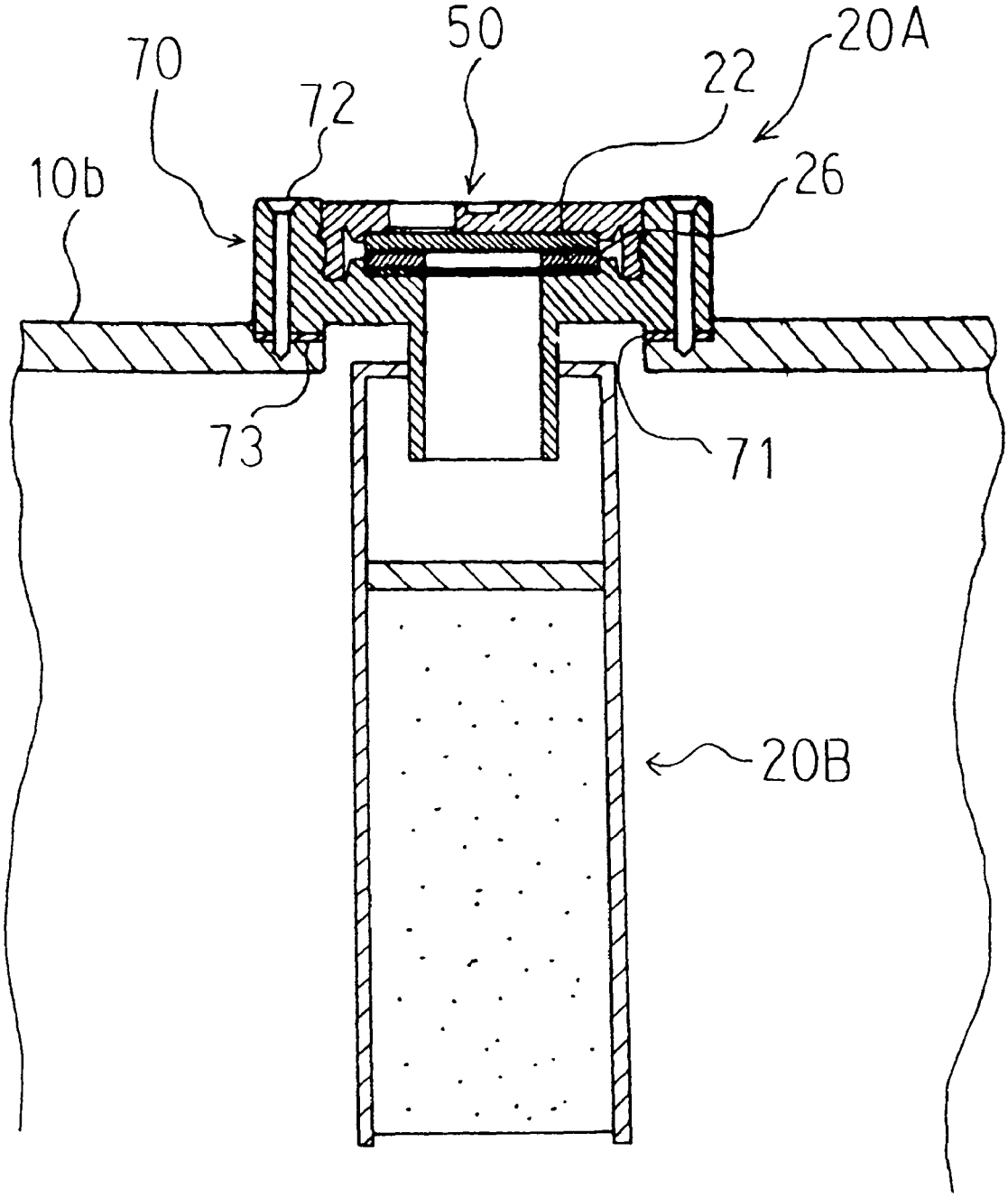
FIG. 25 is a partial cross-sectional view of an air flow control unit, and the vicinity thereof, in another modified embodiment of the present invention.
Figure 26:
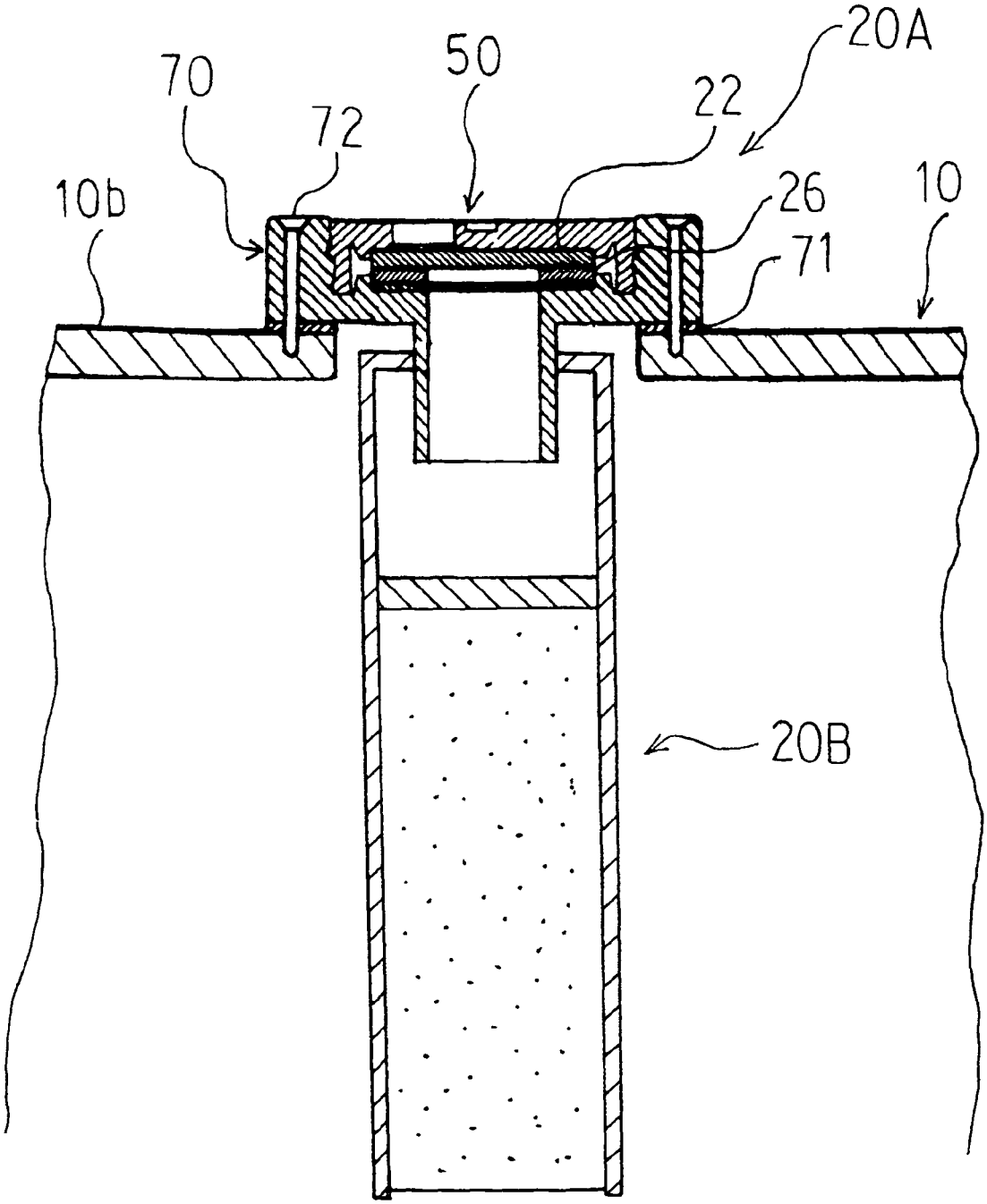
FIG. 26 is a partial cross-sectional view of an air flow control unit, and the vicinity thereof, in still another modified embodiment of the present invention.
Figure 27:
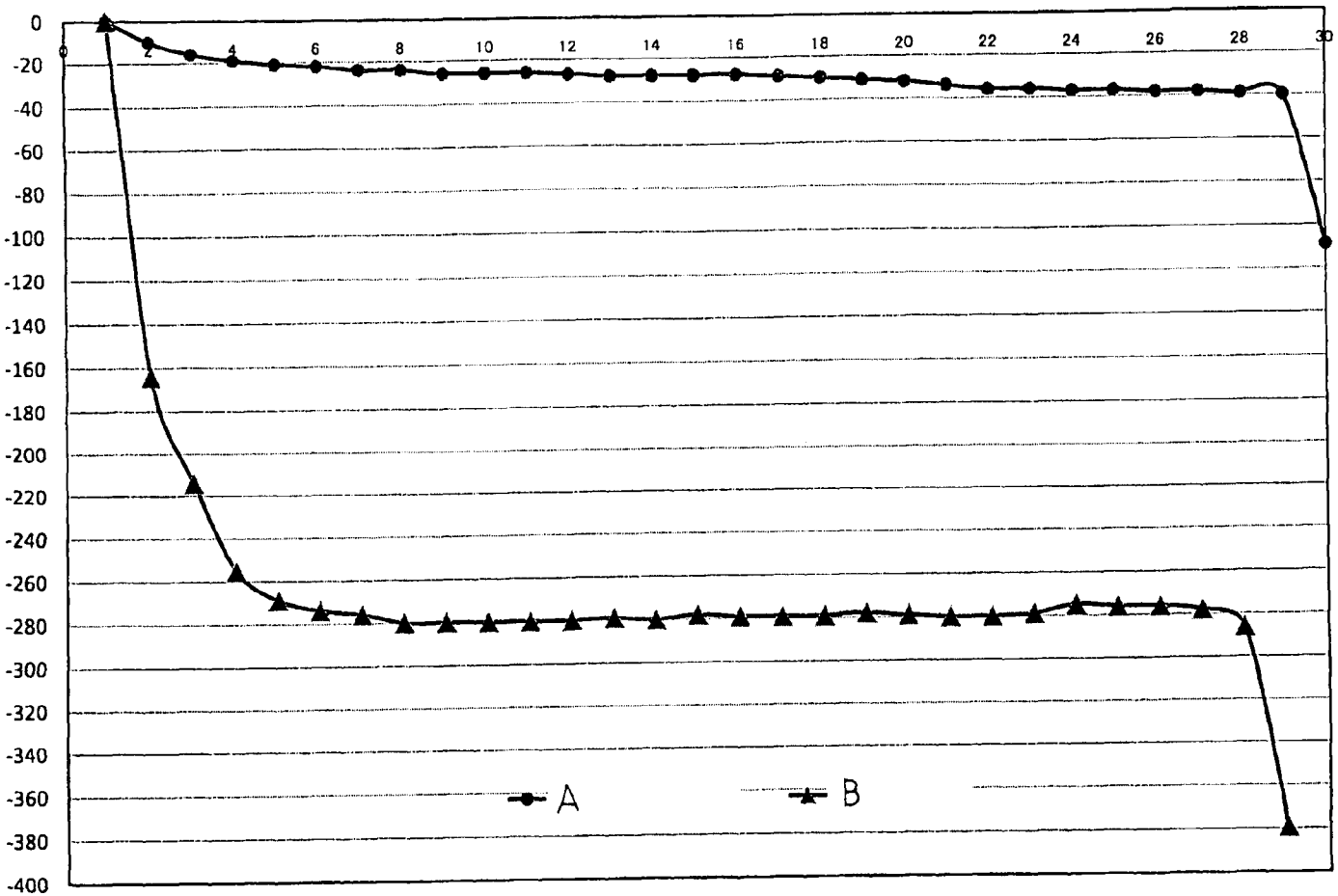
FIG. 27 is a graph showing a negative pressure state inside the ink storage container of each of the first and third embodiments.

For example, in the second to sixth embodiments, the recess 10*e* is formed so as to be recessed from the upper surface portion 10*b*. However, as shown in a modified embodiment in FIG. 24, a protruding portion 70 protruding upward from the upper surface portion 10*b* may be formed integrally with the upper surface portion 10*b*, and the air flow control unit 20A may be contained in the protruding portion 70. Moreover, as shown in FIGS. 25 and 26, a protruding portion 70 formed separately from the upper surface portion 10*b* may be secured to the upper surface portion 10*b* with bolts 72, and the air flow control unit 20A may be disposed in the protruding portion 70. In this case, a seal member 71 may be provided in the abutment portion between the upper surface portion 10*b* and the protruding portion 70. In this manner, the hermeticity of the ink storage unit 10 can be maintained.

In each of the third to fifth embodiments, the retaining portion 20B1 of the ink utilization valve 20B is mounted on the upper surface portion 12 or 10*b* of the ink storage unit 10. However, of course, the retaining portion 20B1 may be mounted on the protruding portion 70 or on the base portion 23, which is the component of the air flow control unit 20A, as shown in FIGS. 24 to 26.

In each of the embodiments, the air flow control unit 20 or 20A and the ink ejection unit 30 are disposed at diagonal positions in the ink storage container 100, but the invention is not limited thereto. The air flow control unit 20 and the ink ejection unit 30 can be disposed at any suitable positions.

In each of the embodiments, since the ink storage container 100 is used as an ink cartridge of an ink-jet printer, the ink ejection unit 30 must be provided. However, if the ink storage container 100 is used for other application, the ink ejection unit 30 may not be provided.

In the first embodiment, the air flow control unit 20 is provided so as to protrude from the upper surface of the ink storage unit 10. However, the air flow control unit 20 may be partially embedded in the upper surface portion 12 of the ink storage unit 10 or may be fully embedded in the upper surface portion 12 so that a flat surface with no protruding portion is formed on the upper surface portion 12 of the ink storage unit 10.

EXPERIMENTAL EXAMPLES

The ink storage containers described in the first and third embodiments were provided. In the ink storage container of the third embodiment, the diameter of the ink absorbing body 20B2 was set to 5 mm, and the vertical length was set to 30 mm. Ink ejection experiments were performed using an ink-jet printer, and the results obtained are shown in FIG. 24. The results for the ink storage container of the first embodiment are shown by line A, and the results for the ink storage container of the third embodiment are shown by line B. The vertical axis of the graph represents the negative pressure ($mmH_2O$) in the container, and the horizontal axis represents the time course (minutes) of the ink ejection experiment.

For the ink storage container of the first embodiment that is provided only with the air flow control unit, the negative pressure reached −20 to −40 $mmH_2O$ as shown by line A. Moreover, the level of the negative pressure is relatively stable. Therefore, it is clear that the ink-jet printer is satisfactorily usable in this stable state.

For the ink storage container of the third embodiment, a high negative pressure state was obtained shortly after the ejection of ink was started, and the negative pressure level reached about −280 $mmH_2O$, as shown by line B. This negative pressure level was almost stable from the initial stage of the ink ejection until the ink was exhausted.

The present invention is applicable to ink storage containers and particularly to ink cartridges for ink-jet printers.

The entire disclosure of Japanese Patent Application No. 2007-294998 filed on Nov. 14, 2007, No. 2008-080402 filed on Mar. 26, 2008 and No. 2008-184073 filed on Jul. 15, 2008 including specification, claims, drawings, and summary are incorporated herein by reference in its entirety.

What is claimed is:

1. An ink storage container comprising an ink storage unit that stores an ink, the ink storage unit including an air flow control unit that controls an amount of air flow between inside and outside of the ink storage unit, wherein the air flow control unit includes:

a valve element that is formed of an interconnected porous material and allows air to be exchanged between the inside and outside of the ink storage unit according to positive and negative changes in internal pressure of the ink storage unit; and a liquid repellent membrane having air permeability and liquid repellency, the liquid repellent membrane being disposed on an ink side of the valve element; and the liquid repellent membrane has a plurality of fine pores of a diameter of 0.01 μm or more and 5 μm or less, and the liquid repellent membrane has a critical surface tension of 25 dyn/cm or less.

2. The ink storage container according to claim 1, wherein the valve element is elastically deformable.

3. The ink storage container according to claim 1, wherein a gap for allowing elastic deformation of the valve element is formed on each side of the valve element in a flow direction of air.

4. The ink storage container according to claim 1, wherein the air flow control unit further includes an annular holding member that holds the valve element such that a portion near a circumference of the valve element is held thereby.

5. The ink storage container according to claim 1, wherein the valve element is a sheet member having a thickness of 0.5 mm or more and 5.0 mm or less.

6. The ink storage container according to claim 1, wherein the valve element has an outer dimension of 4 mm or more and 20 mm or less.

7. The ink storage container according to claim 1, wherein the liquid repellent membrane is formed of a fluorocarbon resin or a fluorocarbon rubber.

8. The ink storage container according to claim 1, wherein the air flow control unit further includes an annular lower-side support ring that has a communication hole formed in a central portion thereof and abuts against an ink side of the valve element, and an area of the communication hole of the lower-side support ring is less than an area of an communication region on a side opposite to the ink side of the valve element.

9. An ink storage container comprising an ink storage unit that stores an ink, the ink storage unit including an air flow control unit that controls an amount of air flow between inside and outside of the ink storage unit, wherein the air flow control unit includes:

a valve element that is formed of an interconnected porous material and allows air to be exchanged between the inside and outside of the ink storage unit according to positive and negative changes in internal pressure of the ink storage unit; and a liquid repellent membrane having air permeability and liquid repellency, the liquid repellent membrane being disposed on an ink side of the valve element; and the air flow control unit further includes an annular pressing ring having flat surfaces on upper and lower sides thereof and having a through hole in a central portion thereof, and the liquid repellent membrane, the pressing ring, and the valve element are held in a pressed manner.

10. The ink storage container according to claim 9, wherein the pressing ring is disposed so as to abut against the ink side of the valve element, and an area of the through hole of the pressing ring is smaller than an area of a communication region on a side opposite to the ink side of the valve element.

11. The ink storage container according to claim 9, wherein the valve element is elastically deformable.

12. The ink storage container according to claim 9, wherein a gap for allowing elastic deformation of the valve element is formed on each side of the valve element in a flow direction of air.

13. The ink storage container according to claim 9, wherein the air flow control unit further includes an annular holding member that holds the valve element such that a portion near a circumference of the valve element is held thereby.

14. The ink storage container according to claim 9, wherein the valve element is a sheet member having a thickness of 0.5 mm or more and 5.0 mm or less.

15. The ink storage container according to claim 9, wherein the valve element has an outer dimension of 4 mm or more and 20 mm or less.

16. The ink storage container according to claim 9, wherein the liquid repellent membrane is formed of a fluorocarbon resin or a fluorocarbon rubber.

17. An ink storage container comprising an ink storage unit that stores an ink, the ink storage unit including an air flow control unit that controls an amount of air flow between inside and outside of the ink storage unit, wherein the air flow control unit includes:

a valve element that is formed of an interconnected porous material and allows air to be exchanged between the inside and outside of the ink storage unit according to positive and negative changes in internal pressure of the ink storage unit; and a liquid repellent membrane having air permeability and liquid repellency, the liquid repellent membrane being disposed on an ink side of the valve element;

an object-accommodating portion is provided on an upper surface portion of the ink storage unit;

a liquid repellent membrane-placing portion for placing the liquid repellent membrane is formed in the object-accommodating portion;

a ventilation hole is formed in a bottom portion of the object-accommodating portion; and the air flow control unit is mounted in the object-accommodating portion.

18. The ink storage container according to claim 17, wherein the liquid repellent membrane-placing portion has an annular smooth surface that comes into intimate contact with the liquid repellent membrane.

19. The ink storage container according to claim 17, wherein the liquid repellent membrane-placing portion is formed as an annular dent and is formed of an olefin-based resin.

20. The ink storage container according to claim 17, further comprising a cap that is mounted on an upper side of the object-accommodating portion.

21. The ink storage container according to claim 20, wherein the cap includes: a plurality of ventilation holes formed in a ceiling portion thereof; and a valve element-placing portion for supporting the valve element, the valve element-placing portion being formed on a lower side of the ceiling portion and formed as an annular dent.

22. The ink storage container according to claim 20, wherein: the cap includes a tubular circumferential portion axially extending from a circumferential portion of the ceiling portion; and when the cap is attached to the object-accommodating portion, a lower end of the tubular circumferential portion abuts against the bottom portion of the object-accommodating portion and becomes a stopper.

23. The ink storage container according to claim 22, wherein:

a thin-wall annular elastic hinge is provided on an inner base portion of the tubular circumferential portion of the cap;

an engaging portion is formed on an outer surface of the circumferential portion of the cap; and an engaged portion that is engaged with the engaging portion is formed on an inner circumferential wall of the object-accommodating portion.

24. The ink storage container according to claim 23, wherein: the engaging portion and the engaged portion form a plurality of fit portions disposed in an axial direction of the circumferential portion; and one of the plurality of fit portions prevents the cap from coming off the object-accommodating portion in the axial direction, and the rest of the plurality of fit portions prevent the cap from rotating in a circumferential direction of the tubular circumferential portion.

25. The ink storage container according to claim 17, wherein: a buffering portion having a disk-like shape is formed below the ventilation hole formed in the bottom portion, the buffering portion restricting the motion of the ink toward the ventilation hole; and the buffering portion has a conical surface on a ventilation hole side thereof, a center of the conical surface protruding toward the ventilation hole.

26. The ink storage container according to claim 17, wherein the valve element is elastically deformable.

27. The ink storage container according to claim 17, wherein a gap for allowing elastic deformation of the valve element is formed on each side of the valve element in a flow direction of air.

28. The ink storage container according to claim 17, wherein the air flow control unit further includes an annular holding member that holds the valve element such that a portion near a circumference of the valve element is held thereby.

29. The ink storage container according to claim 17 wherein the valve element is a sheet member having a thickness of 0.5 mm or more and 5.0 mm or less.

30. The ink storage container according to claim 17, wherein the valve element has an outer dimension of 4 mm or more and 20 mm or less.

31. The ink storage container according to claim 17, wherein the liquid repellent membrane is formed of a fluorocarbon resin or a fluorocarbon rubber.

32. An ink storage container comprising an ink storage unit that stores an ink, the ink storage unit including an air flow control unit that controls an amount of air flow between inside and outside of the ink storage unit, wherein the air flow control unit includes:

a valve element that is formed of an interconnected porous material and allows air to be exchanged between the inside and outside of the ink storage unit according to positive and negative changes in internal pressure of the ink storage unit; and a liquid repellent membrane having air permeability and liquid repellency, the liquid repellent membrane being disposed on an ink side of the valve element; and a distance between an upper surface of the valve element and a lower surface of the liquid repellent membrane is 1.5 mm or more and 20 mm or less.

33. The ink storage container according to claim 32, wherein the valve element is elastically deformable.

34. The ink storage container according to claim 32, wherein a gap for allowing elastic deformation of the valve element is formed on each side of the valve element in a flow direction of air.

35. The ink storage container according to claim 32, wherein the air flow control unit further includes an annular holding member that holds the valve element such that a portion near a circumference of the valve element is held thereby.

36. The ink storage container according to claim 32, wherein the valve element is a sheet member having a thickness of 0.5 mm or more and 5.0 mm or less.

37. The ink storage container according to claim 32, wherein the valve element has an outer dimension of 4 mm or more and 20 mm or less.

38. The ink storage container according to claim 32, wherein the liquid repellent membrane is formed of a fluorocarbon resin or a fluorocarbon rubber.

39. An ink storage container comprising an ink storage unit that stores an ink, the ink storage unit including an air flow control unit that controls an amount of air flow between inside and outside of the ink storage unit, wherein the air flow control unit includes:

a valve element that is formed of an interconnected porous material and allows air to be exchanged between the inside and outside of the ink storage unit according to positive and negative changes in internal pressure of the ink storage unit; and a liquid repellent membrane having air permeability and liquid repellency, the liquid repellent membrane being disposed on an ink side of the valve element; and a minimum dimension of a communication region of the valve element that is in communication with the ink side is at least two times of a thickness of the valve element.

40. The ink storage container according to claim 39, wherein the valve element is elastically deformable.

41. The ink storage container according to claim 39, wherein a gap for allowing elastic deformation of the valve element is formed on each side of the valve element in a flow direction of air.

42. The ink storage container according to claim 39, wherein the air flow control unit further includes an annular holding member that holds the valve element such that a portion near a circumference of the valve element is held thereby.

43. The ink storage container according to claim 39, wherein the valve element is a sheet member having a thickness of 0.5 mm or more and 5.0 mm or less.

44. The ink storage container according to claim 39, wherein the valve element has an outer dimension of 4 mm or more and 20 mm or less.

45. The ink storage container according to claim 39, wherein the liquid repellent membrane is formed of a fluorocarbon resin or a fluorocarbon rubber.

* * * * *